US008132680B2

(12) United States Patent
Takashima et al.

(10) Patent No.: US 8,132,680 B2
(45) Date of Patent: Mar. 13, 2012

(54) CIGARETTE DISPLAY SYSTEM, FRAME UNIT, TRAY UNIT, MAGAZINE UNIT, AND SLIDER UNIT

(75) Inventors: Norikazu Takashima, Tokyo (JP); Yukihiro Yamamoto, Tokyo (JP); Hiroshi Kawaida, Tokyo (JP); Fuyuko Terakado, Tokyo (JP); Tadahiko Mori, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 369 days.

(21) Appl. No.: 12/443,394

(22) PCT Filed: Sep. 28, 2007

(86) PCT No.: PCT/JP2007/001053

§ 371 (c)(1),
(2), (4) Date: Mar. 27, 2009

(87) PCT Pub. No.: WO2008/041360

PCT Pub. Date: Apr. 10, 2008

(65) Prior Publication Data

US 2010/0072150 A1 Mar. 25, 2010

(30) Foreign Application Priority Data

| | | |
|---|---|---|
| Sep. 29, 2006 | (JP) | 2006-266640 |
| Sep. 29, 2006 | (JP) | 2006-266649 |
| Sep. 29, 2006 | (JP) | 2006-266658 |
| Sep. 29, 2006 | (JP) | 2006-266682 |
| Sep. 29, 2006 | (JP) | 2006-266694 |
| Sep. 29, 2006 | (JP) | 2006-266734 |

(51) Int. Cl.
*A47F 7/00* (2006.01)

(52) U.S. Cl. ..... 211/59.3; 211/87.01

(58) Field of Classification Search ..... 211/50, 211/49.1, 59.2, 59.3, 126.1, 189, 94.01, 87.01; 206/526, 817, 739, 774; 108/144.11, 147.11
See application file for complete search history.

(56) References Cited

U.S. PATENT DOCUMENTS

| | | | | | |
|---|---|---|---|---|---|
| 2,098,844 | A | * | 11/1937 | Waxgiser | 211/59.3 |
| 2,934,212 | A | * | 4/1960 | Jacobson | 211/59.3 |
| 4,923,070 | A | * | 5/1990 | Jackle et al. | 211/59.2 |
| RE33,913 | E | * | 5/1992 | Kral et al. | 211/59.2 |
| 5,181,623 | A | * | 1/1993 | Linden et al. | 211/183 |
| 5,295,592 | A | * | 3/1994 | Thorne | 211/59.2 |
| 5,411,146 | A | * | 5/1995 | Jarecki et al. | 211/59.2 |
| 5,505,315 | A | * | 4/1996 | Carroll | 211/59.2 |
| 5,673,801 | A | * | 10/1997 | Markson | 211/59.3 |

(Continued)

FOREIGN PATENT DOCUMENTS

JP 64-56014 A 3/1989

(Continued)

*Primary Examiner* — Jennifer E. Novosad
(74) *Attorney, Agent, or Firm* — Birch, Stewart, Kolasch & Birch, LLP

(57) ABSTRACT

An apparatus main body of a frame structure and an apparatus main body of a wall structure are formed separately, tray units 200 are attached to the frame main body and the wall main body, and magazine units 100 which are held by the tray unit 200 hold cigarette packs T. Since the two types of main bodies use the tray units 200 and the magazine units 100, the cigarette packs T can be displayed in various ways without decreasing productivity. In this way, the present invention provides a cigarette display system 1000 having a structure which can display the cigarette packs T in various ways without decreasing productivity.

13 Claims, 40 Drawing Sheets

U.S. PATENT DOCUMENTS

| | | | | |
|---|---|---|---|---|
| 5,749,478 | A * | 5/1998 | Ellis | 211/59.2 |
| 5,788,090 | A * | 8/1998 | Kajiwara | 211/59.2 |
| 5,878,895 | A * | 3/1999 | Springs | 211/59.3 |
| 5,887,732 | A * | 3/1999 | Zimmer et al. | 211/59.2 |
| 5,944,203 | A | 8/1999 | Vlah et al. | |
| 6,659,293 | B1 * | 12/2003 | Smith | 211/59.2 |
| 6,739,461 | B1 * | 5/2004 | Robinson | 211/59.2 |
| 6,901,946 | B2 * | 6/2005 | Frazier | 137/312 |
| 6,932,449 | B2 * | 8/2005 | Collins et al. | 312/405.1 |
| 7,325,697 | B2 * | 2/2008 | Lim et al. | 211/133.1 |
| 2003/0106867 | A1 * | 6/2003 | Caterinacci | 211/40 |
| 2004/0060884 | A1 | 4/2004 | Nook et al. | |
| 2004/0211736 | A1 * | 10/2004 | Mason | 211/59.2 |
| 2004/0256341 | A1 * | 12/2004 | Donnell et al. | 211/187 |
| 2006/0032827 | A1 * | 2/2006 | Phoy | 211/59.2 |
| 2006/0243683 | A1 * | 11/2006 | Onachilla et al. | 211/59.2 |
| 2007/0062891 | A1 * | 3/2007 | Stievenard | 211/59.2 |
| 2008/0078729 | A1 * | 4/2008 | Bazany et al. | 211/59.2 |
| 2008/0164229 | A1 * | 7/2008 | Richter et al. | 211/59.2 |
| 2010/0025345 | A1 * | 2/2010 | Takashima et al. | 211/59.3 |
| 2010/0072150 | A1 * | 3/2010 | Takashima et al. | 211/59.3 |
| 2010/0140197 | A1 * | 6/2010 | Schneider et al. | 211/59.3 |
| 2010/0307992 | A1 * | 12/2010 | Robertson et al. | 211/59.2 |
| 2010/0314342 | A1 * | 12/2010 | Vardaro et al. | 211/59.3 |

FOREIGN PATENT DOCUMENTS

| | | | |
|---|---|---|---|
| JP | 2-141259 | U | 11/1990 |
| JP | 9-94137 | A | 4/1997 |
| JP | 10-151047 | A | 6/1998 |
| JP | 2005-237566 | A | 9/2005 |
| JP | 2005-334326 | A | 12/2005 |

* cited by examiner (a)

(b)

(a)

(b)

(a)

(b)

(a)

(b)

(a)

(b)

(a)

(b)

CIGARETTE DISPLAY SYSTEM, FRAME UNIT, TRAY UNIT, MAGAZINE UNIT, AND SLIDER UNIT

TECHNICAL FIELD

The present invention relates to a cigarette display system for displaying cigarette packs to be sold, and more particularly the present invention relates to a cigarette display system placed in a convenience store, and the like.

BACKGROUND ART

Cigarette packs are currently displayed and sold in stores such as so-called convenience stores. The "cigarette pack" mentioned here does not mean a cigarette which is actually smoked, but means a rectangular solid package which accommodates a plurality of cigarettes.

The cigarette display system for displaying cigarette packs includes a plurality of magazine units and a system frame, for example. The magazine unit is formed in the shape of a box which is elongated in a direction from front to back and has an opened top, using a colorless, transparent resin, for example.

The magazine unit can then accommodate upright cigarette packs arranged in the direction from front to back, which are provided from above. A slider member is attached to the magazine unit on its bottom surface so as to be slidable in a direction from front to back.

More specifically, at the bottom of the magazine unit, an elongated opening is formed in a direction from front to back. Upward-protruded ribs are formed on both left and right sides of the opening. And, the slider member is attached to the pair of ribs and the opening so as to be slidable in a direction from front to back.

And, a wound plate spring to serve as an urging mechanism is attached at a rear of the slider member. One end of the plate spring is pulled out from the slider member and attached to a front bottom part of the magazine unit.

Accordingly, a slider member, which is slidable in a direction from front to back, is resiliently urged by the plate spring. Therefore, a plurality of cigarette packs accommodated in the magazine unit is pushed to a forefront by the slider member.

The system frame holds a plurality of magazine units arranged in the vertical and lateral directions. The system frame includes a plurality of guide rails and a single main frame. A pair of guide rails holds both sides of the magazine unit. The main frame is formed by, for example, metal bars in a solid shape. The plurality of guide rails is fixed in pairs to key points of the main frame.

In the cigarette display system as mentioned above, for example, 20 magazine units are mounted in the system frame in an array of 4 rows and 5 columns. For example, 10 cigarette packs are accommodated in each of the magazine units.

In such the cigarette display system, since cigarette packs are accommodated in colorless, transparent magazine units while the cigarette packs are in an upright state, the cigarette packs are displayed while their representative surfaces facing the front. Therefore, in the cigarette display system, it is possible to display 20 types of cigarette packs, while 10 packs for each kind are accommodated, for example.

When selling a cigarette pack, the cigarette pack is pulled out upward from the forefront part of the magazine unit and remaining cigarette packs accommodated in the magazine unit are pushed forward by the slider member. Thereby, the magazine unit may keep the state of displaying the cigarette packs at the forefront position, even after one cigarette pack is pulled out.

When replenishing cigarette packs in the cigarette display system, a magazine unit is detached from the system frame. Cigarette packs are accommodated in the magazine unit, and the magazine unit having the cigarette packs accommodated therein is mounted in the system frame. Therefore, it is not necessary to perform a troublesome operation for replenishing cigarette packs in a magazine unit fixed in the system frame.

In a cigarette display system as mentioned above, it is possible to wash and clean a magazine unit, by detaching the magazine unit from the system frame, for example.

[Patent Document 1]

Japanese Laid-open patent publication NO. 10-151047

DISCLOSURE OF THE INVENTION

Problems to be Solved by the Invention

The conventional cigarette display systems are fixed in the overall shape. For this reason, if the space for installing the system is small, the cigarette display system may not be installable. On the other hand, if the space for installing the system is large, a dead space may be created.

In short, the conventional cigarette display system cannot flexibly adapt to various types of installation space. Thereby, it is not possible to set up an effective sales space while optimizing a store space.

Therefore, conventional stores could not display cigarette packs in various ways. Thereby, stores have not set up a highly-appealing sales space by strategically designing modes of displaying cigarette packs, and companies which provide cigarette packs to stores have been unable to propose various modes of display.

Furthermore, the conventional cigarette display systems have been enlarged in order to display a sufficient quantity of cigarette packs. Therefore, the conventional cigarette display systems are generally heavy. It is therefore not easy to bring in and install the system in a store.

For example, many convenience stores operate 24 hours a day. The cigarette display system therefore needs to be brought in and installed while the store is opened. In other words, the cigarette display system needs to be brought in and installed quickly in a space-saving manner. However, this is difficult so far as the conventional cigarette display systems are used.

Further, conventionally, for example, advertisement units are attached to the cigarette display system to display cigarette packs to customers in an appealing manner. In other words, conventionally, advertisement units are required to display the cigarette packs in a more appealing manner.

As mentioned in the above, it is difficult to readily and quickly bring in and install the conventional cigarette display systems, and there is no flexibility with regards to installation and the modes of display of the cigarette packs. Therefore, it is impossible to set up a highly-appealing space of sales so far as the conventional cigarette display systems are used.

To solve these problems, it is considered to prepare a plurality of cigarette display systems having different display methods. However, this results in producing many types of cigarette display systems in limited small amounts, and decreasing total productivity. Therefore, conventionally, a few types of cigarette display systems are mass-produced.

The present invention was accomplished considering the above problems, and provides a cigarette display system having a structure in which cigarette packs can be displayed in various ways without decreasing productivity.

Means for Solving the Problems

According to the present invention, there is provided a first cigarette display system for displaying cigarette packs to be sold, the cigarette display system including: a frame main body formed in the shape in which box structures with an opened front are successively arranged both in vertical and lateral directions; a wall main body formed in a flat plate shape flattened in a direction from front to back, having a front surface with recesses and protrusions of a predetermined shape, the wall main body being a body separate from the frame main body; a plurality of magazine units formed in the shape of a box which is elongated in a direction from front to back and has an opened top, the magazine units having a shape which allows a plurality of the cigarette packs to be held therein while being arranged in the direction from front to back; a plurality of tray units formed in the shape of a box having an opened top, the tray units having a shape which allows a plurality of the magazine units arranged in the lateral direction to be held detachably; a plurality of tray support members provided at vertically different positions to be separated apart in each of a plurality of the box structures in the frame main body, the tray support members detachably holding the tray units respectively; and a plurality of tray attachments for detachably engaging with the recesses and protrusions of the wall main body, the tray attachments detachably holding the tray units.

Therefore, in the cigarette display system of the present invention, a plurality of cigarette packs are held by the magazine unit, and a plurality of the magazine units are held by the tray unit. Although a plurality of the tray units are attached to the frame main body and the wall main body, the frame main body and the wall main body are formed separately and have different structures.

According to the present invention, there is provided a first frame unit used in a cigarette display system for displaying cigarette packs to be sold, the frame unit including: a plurality of main frames made of a metal plate which is bent so that a front shape becomes a rectangular, the main frames being arranged in a direction from front to back; and a plurality of support frames made of a metal plate which is formed in a rail shape elongated in a direction from front to back for supporting a tray unit which is a different body from the frame unit, each pair of the support frames being arranged in the vertical, up-down, direction and joined to an inner surface of the plurality of main frames.

Therefore, when a plurality of frame units of the present invention are arranged in the vertical direction, the main frames made of a metal plate bent to a rectangular frame contact each other at their surfaces. Because of this, a plurality of frame units are stably arranged in the vertical direction. Further, the main frames contacted each other at their surfaces are easily and securely joined each other. Since the support frame and the main frame both of which are made of a metal plate have high rigidity, and a plurality of main frames arranged in a direction from front to back and each pairs of the support frames arranged in the vertical direction are joined together, the frame unit has high rigidity as a whole. Since a plurality of frame units each of which has high rigidity are stably joined together in the vertical direction, a totally strong cigarette display system is realized by a plurality of frame units. The support frame and the main frame both of which are made of a metal plate are easily and securely joined together by spot welding, adhesion, or the like. Since the frame unit is formed to have high rigidity by using a pair of main frames and a plurality pairs of support frames, the number of parts and the number of joint places are decreased.

According to the present invention, there is provided a second frame unit used in a cigarette display system for displaying cigarette packs to be sold, the frame unit including: a plurality of support frames formed in a rail shape elongated in a direction from front to back for supporting a tray unit which is a body separate from the frame unit, each lateral pair of the support frames being arranged in a vertical direction; and a plurality of main frames formed in a rectangular frame inside of which the support frames are joined to, the main frames being arranged in a direction from front to back; wherein guide concave parts engaging with tray protrusions formed on both sides of a bottom surface of the tray unit is formed in the support frame, and when a plurality of the frame units are arranged in the lateral, left-right, direction while alternately front-back inverted in such an arrangement that the main frames are adjacent to each other in a direction from front to back, the positions of the guide concave parts of each frame unit in a direction from front to back are lined up in well-positioned.

Therefore, when a plurality of frame units are alternately front-back inverted and arranged in the lateral direction in an arrangement in which the main frames are adjacent to each other in a direction from front to back, a gap between adjacent tray units becomes a lateral width of a single main frame. Further, since the positions of the guide concave parts of the support frames in a direction from front to back are aligned, the positions of the tray units in a direction from front to back whose tray protrusions engage with the guide concave parts are lined up in well-positioned.

According to the present invention, there is provided a second cigarette display system for displaying cigarette packs each of which is packaged in a rectangular solid shape and cigarette cartons in each of which a plurality of the cigarette packs are packaged in a rectangular solid shape, the cigarette display system including: a plurality of magazine units formed in the shape of a box which is elongated in a direction from front to back and has an opened top, the magazine units having a shape for holding a plurality of the cigarette packs arranged in a direction from front to back in a condition in which each cigarette pack is elongated in a vertical direction and flattened in a direction from front to back; a plurality of tray units formed in the shape of a box having an opened top, the tray units having a shape for detachably holding a plurality of the magazine units which are arranged in five lines in the lateral direction, the tray units being formed in a shape in which the cigarette cartons elongated in the lateral direction are placed; and a system main body for arranging a plurality of the tray units in the vertical and lateral directions.

In the cigarette display system of the present invention, the magazine units arranged in five lines in the lateral direction are held in the tray unit, so that the cigarette packs are displayed in the tray unit in five lines in a condition in which representative surfaces of the cigarette packs facing the front. Furthermore, by removing the magazine units from the tray unit, the cigarette cartons can be displayed in the tray unit in a lateral long state in a condition in which representative surfaces of the cigarette cartons facing the front.

According to the present invention, there is provided a tray unit of the cigarette display system of the present invention formed in the shape of a box having an opened top, the tray unit has a shape for detachably holding a plurality of the magazine units which are arranged in five lines in the lateral direction, and the tray unit is formed in a shape capable of placing the cigarette carton elongated in the lateral direction therein.

According to the present invention, there is provided a third cigarette display system for holding a plurality of cigarette packs arranged in a direction from front to back in each of a plurality of magazine units arranged in vertical and lateral directions, wherein the magazine unit includes: a magazine main body formed in the shape of a box which is elongated in a direction from front to back and has an opened top; a slider member arranged on a bottom surface of the magazine main body so as to be slidable in a direction from front to back; and an urging mechanism which resiliently urges the slider member forward, wherein a bottom surface of the magazine main body is made in a flat plane without a protrusion at least in a range where sliding movement is allowed for the slider member, but has a step which forms a rear surface is formed at a rear part thereof, and a bottom end of a front surface of the slider member detachably engages with the rear surface formed by the step of the magazine main body.

In the cigarette display system of the present invention, the slider member urged forward of the magazine unit by the urging mechanism engages with the step at the bottom rear part of the magazine main body, so that the cigarette packs can be easily replenished in the magazine unit. Further, since the bottom surface of the magazine main body is made of a flat plane at least in a range where the slider member 110 can make sliding movement, it is easy to clean and wash the magazine main body.

According to the present invention, there is provided a magazine unit of the cigarette display system of the present invention, and the magazine unit includes: a magazine main body formed in the shape of a box which is elongated in a direction from front to back and has an opened top; a slider member arranged on a bottom surface of said magazine main body so as to be slidable in a direction from front to back; and an urging mechanism which resiliently urges the slider member forward, wherein a bottom surface of the magazine main body is made in a flat plane without a protrusion at least in a range where the slider member 110 can make sliding movement, a step which forms a rear surface is formed at a rear part of the bottom surface, and a bottom end of a front surface of the slider member is formed by the step of the magazine main body.

According to the present invention, there is provided a fourth cigarette display system for displaying a cigarette pack which is packaged in a rectangular solid shape and a cigarette carton in which a plurality of the cigarette packs are packaged in a rectangular solid shape, the cigarette display system including: a plurality of tray units formed in the shape of a box having an opened top, the tray units being formed in a shape in which the cigarette carton elongated in the lateral direction is placed; a system main body for arranging a plurality of the tray units in vertical and lateral directions; and a plurality of slider units which are detachably attached to a bottom surface of the tray unit; wherein the slider unit includes: a guide rail elongated in a direction from front to back; an attaching and removing mechanism which detachably attaches the guide rail to the bottom surface of the tray unit; a slider member which is supported so as to be slidable by the guide rail, and an urging mechanism which resiliently urges the slider member forward.

Therefore, in the cigarette display system of the present invention, when a plurality of cigarette cartons are arranged in a direction from front to back on a top surface of the guide rail of the slider unit attached to the bottom surface of the tray unit, and the cigarette cartons are placed in front of the slider member, the cigarette cartons are pushed forward by the slider member which is urged by the urging mechanism.

According to the present invention, there is provided a slider unit of the cigarette display system of the present invention, and the slider unit includes; a guide rail elongated in a direction from front to back; an attaching and removing mechanism which detachably attaches the guide rail to the bottom surface of the tray unit; a slider member which is supported by the guide rail so as to be slidable, and an urging mechanism which resiliently urges the slider member forward.

Although the present invention defines a direction from front to back and a lateral direction in addition to a vertical direction, these are definitions of convenience to simply explain relative relationships between components of the present invention, and do not limit the directions upon producing or using the cigarette display system in the practice of the present invention.

Further, the components of the present invention are not necessarily independent entities. It is possible that a plurality of components may be formed as a single member, a single component may be formed as a plurality of members, a component may be a part of another component, and a part of a component may overlap a part of another component.

EFFECTS OF THE INVENTION

In the cigarette display system of the present invention, a plurality of cigarette packs are held by the magazine unit, and a plurality of the magazine units are held by the tray unit. The cigarette display system can be easily and quickly brought in and installed in a store. In addition, since there is flexibility in an installation area and a display configuration of the cigarette packs, it is possible to set up a sales space which can attract attention effectively. Especially, while a plurality of tray units are attached to the frame main body and the wall main body, the frame main body and the wall main body are formed separately and have different structures. Because of this, since the two types of main bodies use the tray units and the magazine units, the cigarette packs can be displayed in various ways without decreasing productivity.

BRIEF DESCRIPTION OF THE DRAWINGS

The objects mentioned above, and other objects, characteristics, and advantages are further revealed by a preferred embodiment to be mentioned below, and the following accompanying drawings thereof.

BEST MODE FOR CARRYING OUT THE INVENTION

Figure 1:
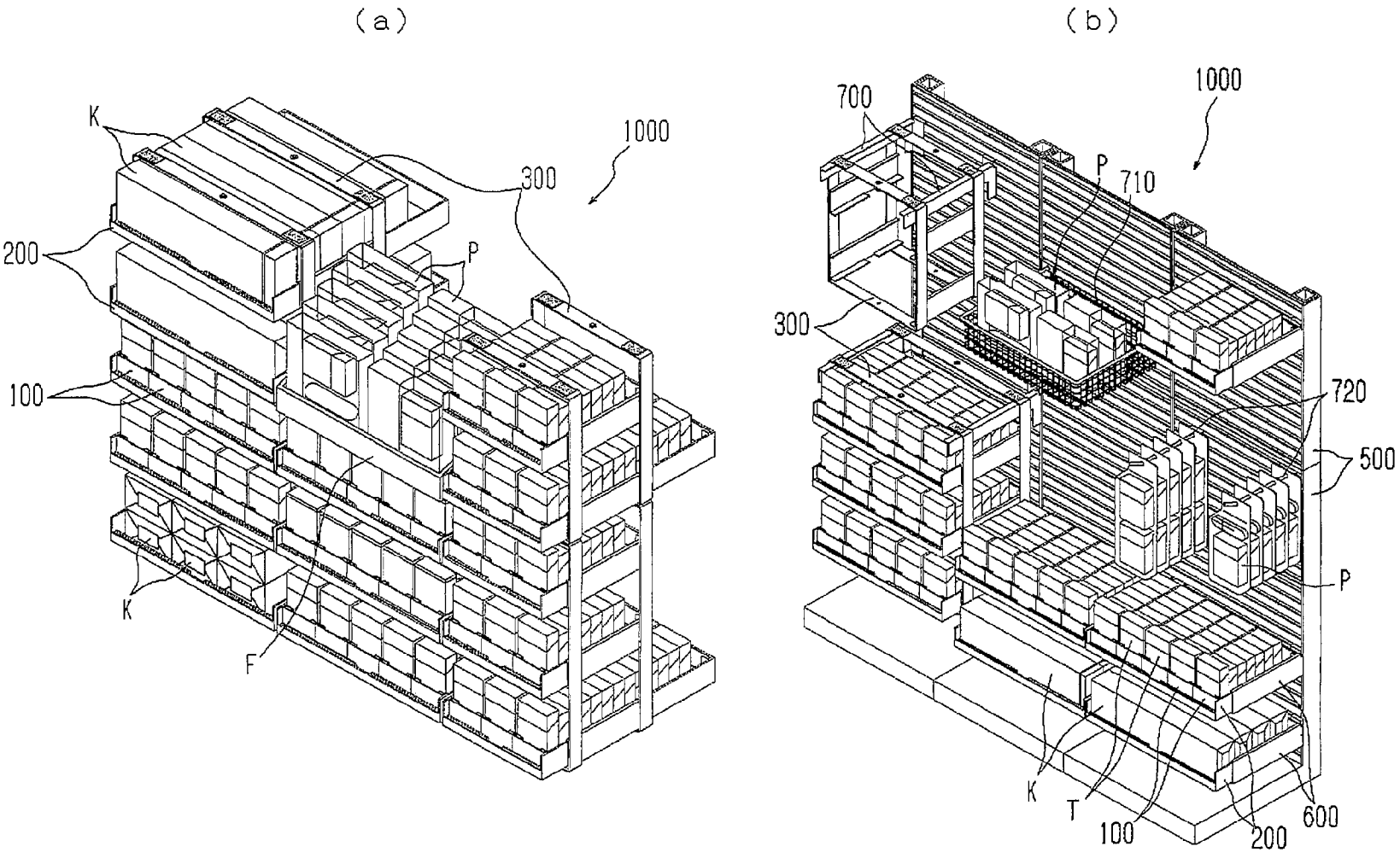
FIG. 1 is a perspective view showing an appearance of a cigarette display system of an embodiment of the present invention.

An embodiment of the present invention will be described with reference to the drawings. As shown in FIG. 1, a cigarette display system 1000 of the embodiment is used to display cigarette packs T to be sold.

Accordingly, as shown in FIG. 1 and each figure, the cigarette display system 1000 includes: a frame main body formed in the shape in which box structures with an opened front are successively arranged both in vertical and lateral directions; a wall main body formed in a flat plate shape flattened in a direction from front to back, having a front surface with recesses and protrusions of a predetermined shape including concavity channels 511, the wall main body being a body separate from the frame main body; a plurality of magazine units 100 formed in the shape of a box which is elongated in a direction from front to back and has an opened top, the magazine units having a shape which allows a plurality of cigarette packs T to be held therein while being arranged in the direction from front to back; a plurality of tray units 200 formed in the shape of a box having an opened top, the tray units 200 having a shape which allows a plurality of the magazine units 100 arranged in the lateral direction to be held detachably; support frames 320, which serve as tray support members, provided at vertically different positions to be separated apart in each of a plurality of the box structures in the frame main body, the tray support members detachably holding the tray units 200 respectively; and a plurality of tray attachments 600 for detachably engaging with the concavity channels 511 of the wall main body, the tray attachment detachably holding the tray unit 200.

As shown in FIG. 1(*a*) and FIGS. 9 to 15, the frame main body includes a plurality of frame units 300, each of which is individually formed in the structure of a box, formed separately from each other.

Figure 22:
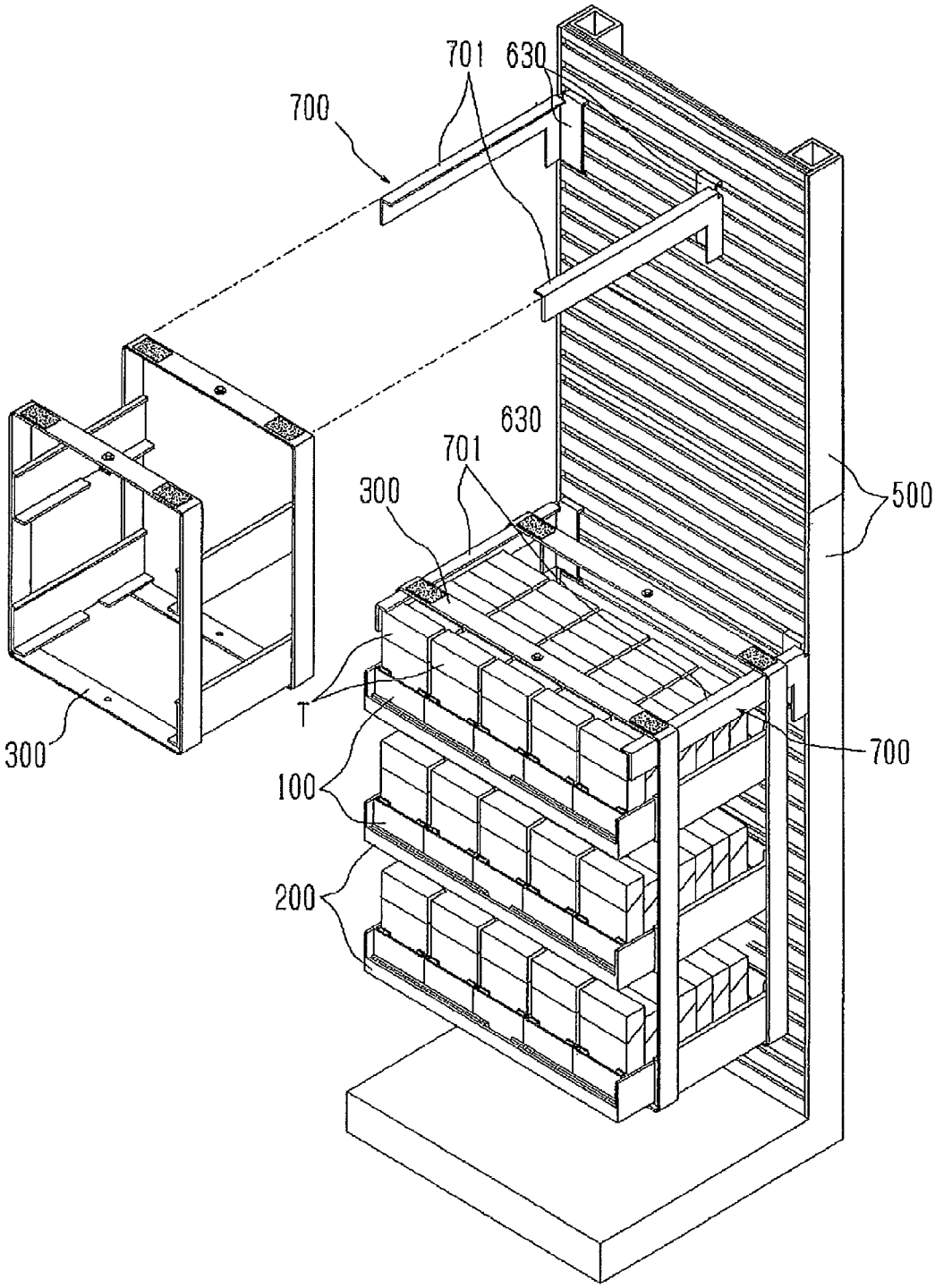
FIG. 22 is an exploded perspective view showing a condition in which a frame unit is being attached to a wall unit by a frame attachment.

As shown in FIG. 1(*b*), FIG. 22 and other drawings, the wall main body includes a plurality of wall units 500, each of which has a front surface on which the concavity channels 511 are formed, formed separately from each other.

More specifically, as shown in FIG. 1, the cigarette display system 1000 displays the cigarette packs T, cigarette cartons K in each of which a plurality of cigarette packs T are packed, campaign packs P in each of which a cigarette pack T and a free gift are packed together, and the like. The campaign packs P are provided to a store with simple fittings F formed by cardboard, for example.

At present, the cigarette packs T are formed in a rectangular solid shape, which generally has a common length from front to back and lateral width, whilst heights are not uniform. In the embodiment, it is defined that largest surfaces of the cigarette pack T are a front surface and a back surface, and smallest surfaces are a top surface and a bottom surface.

Generally, a brand name and the like are printed on the front surface (and the back surface) of the cigarette pack T. The cigarette packs T are preferably displayed in an appropriate direction so that the front surfaces are facing front. The magazine unit 100 accommodates the cigarette packs T, which are facing in the appropriate direction as mentioned above and arranged in a direction from front to back.

Figure 2:
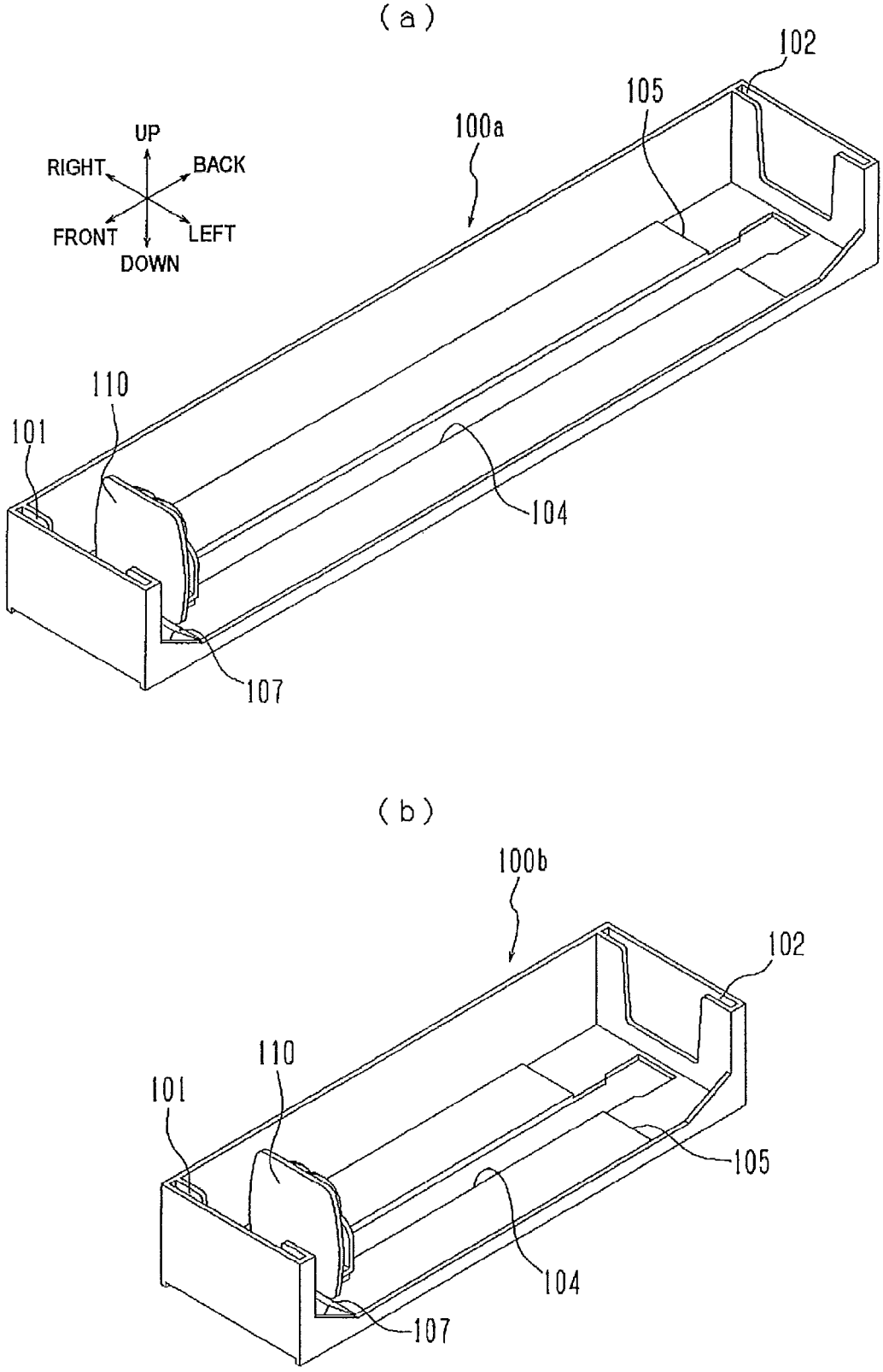
FIG. 2 is a perspective view showing appearances of two types of magazine units.

Here, as shown in FIG. 2, the cigarette display system 1000 of the embodiment includes: a magazine unit 100*a*, which has a long length from front to back to hold thirteen cigarette packs T; and a magazine unit 100*b*, which has a short length from front to back to hold seven cigarette packs T.

The magazine unit 100 is formed by a colorless, transparent resin. Pockets 101, 102 having an opened top are formed at front end and back end of the magazine unit 100.

Figure 34:
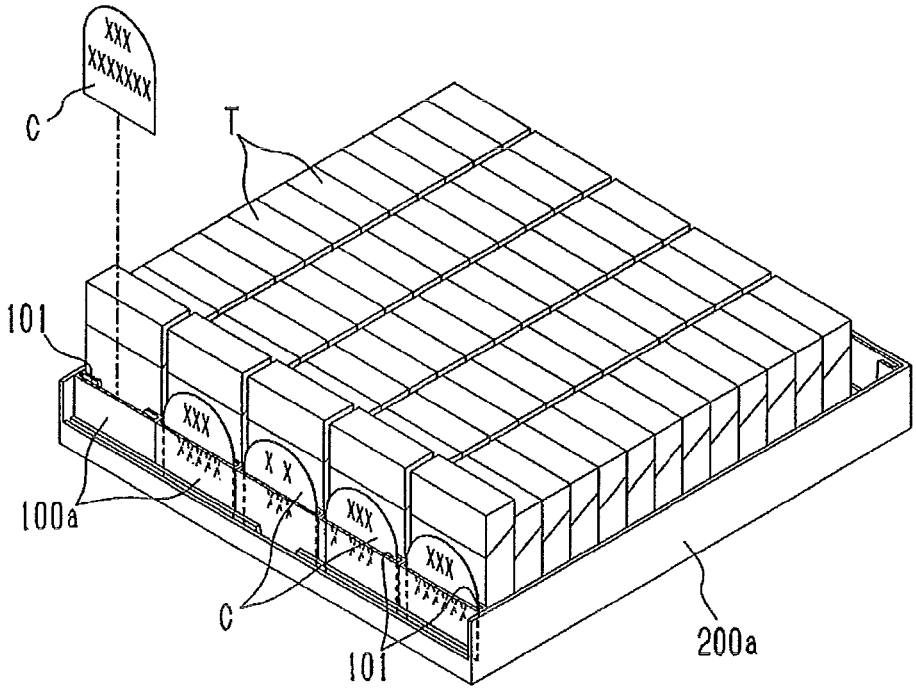
FIG. 34(*a*) is an exploded perspective view showing a condition in which advertisement cards are placed in the magazine units held by the tray unit, and FIG. 34(*b*) is a perspective view showing a condition in which an advertisement card is placed in the tray unit holding cigarette packs with the magazine units.
Figure 34:
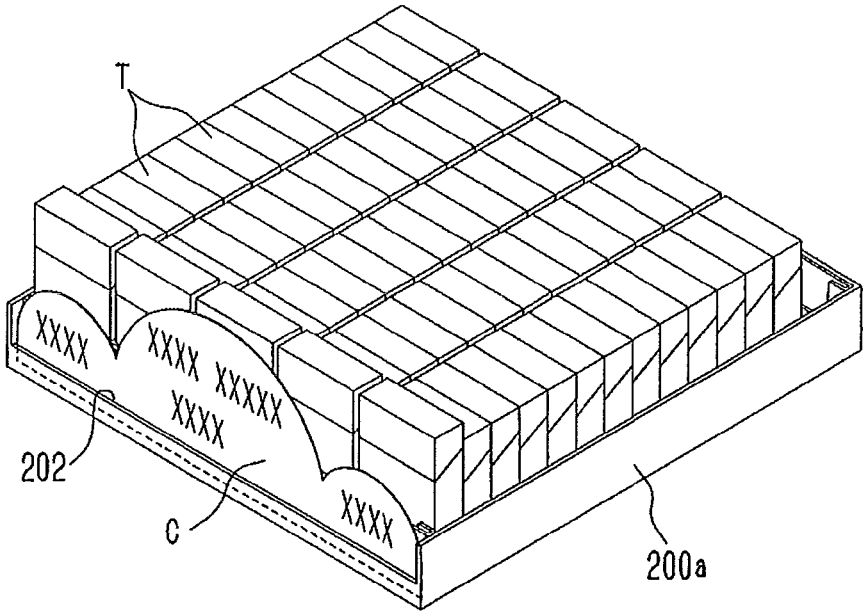

As shown in FIG. 34(*a*), for example, a price tag and an advertisement card C of a cigarette pack T or the like which are shown to customers is accommodated in the front pocket 101. For example, an information card of a cigarette pack T for a store clerk to check is accommodated in the back pocket 102.

Figure 38:
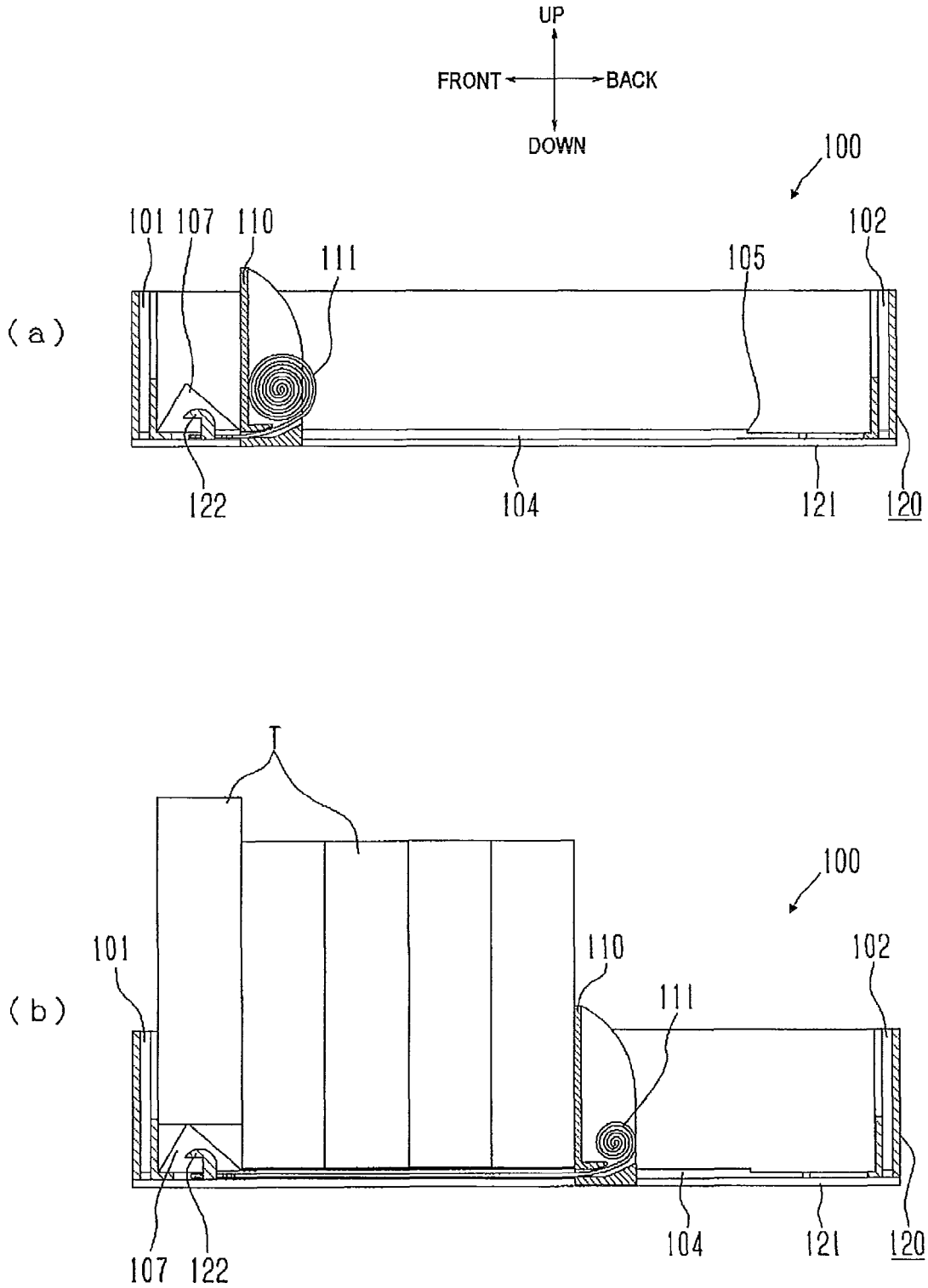
FIG. 38 is a vertical cross-sectional side view showing a structure of the magazine unit of the cigarette display system.

As shown in FIG. 38, the magazine unit 100 includes: a magazine main body 120 formed in the shape of a box which is elongated in a direction from front to back and has an opened top; a slider member 110 arranged on a bottom surface of the magazine main body 120 so as to be slidable in a direction from front to back; and an urging mechanism which resiliently urges the slider member 110 forward.

In addition, the magazine unit 120 has a bottom surface which is made in a flat plane without a protrusion at least in a range where the slider member 110 can make sliding movement, and the magazine unit 120 has a step 105 which forms a rear surface at a rear part of the bottom surface. And a bottom end of a front surface of the slider member 110 detachably engages with the rear surface formed by the step 105 of the magazine main body 120.

More specifically, an opening 104 elongated in a direction from front to back is formed at the center in the lateral direction of the bottom of the magazine main body 120. In the slider member 110, concavity channels are formed at left and right of the bottom of the slider member 110 so as to engage with left and right edges of the opening 104 of the magazine main body 120 in a slidable manner.

Because of this, the bottom surface of the slider member 110 is located lower than the bottom surface of the magazine main body 120. On the other hand, protrusions 121 which are located lower than the bottom surface of the slider member 110 are formed at both left and right sides of the bottom surface of the magazine main body 120.

In the slider member 110, a wound plate spring 111 is attached to a rear of the slider member 110 as an urging mechanism. One end of the plate spring 111 is pulled out from the bottom of the slider member 110 and attached to a front part of the magazine unit 100.

Accordingly, the slider member 110 is resiliently urged toward the front by the plate spring 111. Since the plate spring 111 pulled out from the slider member 110 is located inside the opening 104 of the magazine unit 100, the plate spring 111 does not come into contact with a bottom surface of the cigarette packs T accommodated in the magazine unit 100.

A step 105 is formed at a rear bottom of the magazine unit 100. While being engaged with the step 105, the slider member 110 stops against tension of the plate spring 111.

Figure 39:
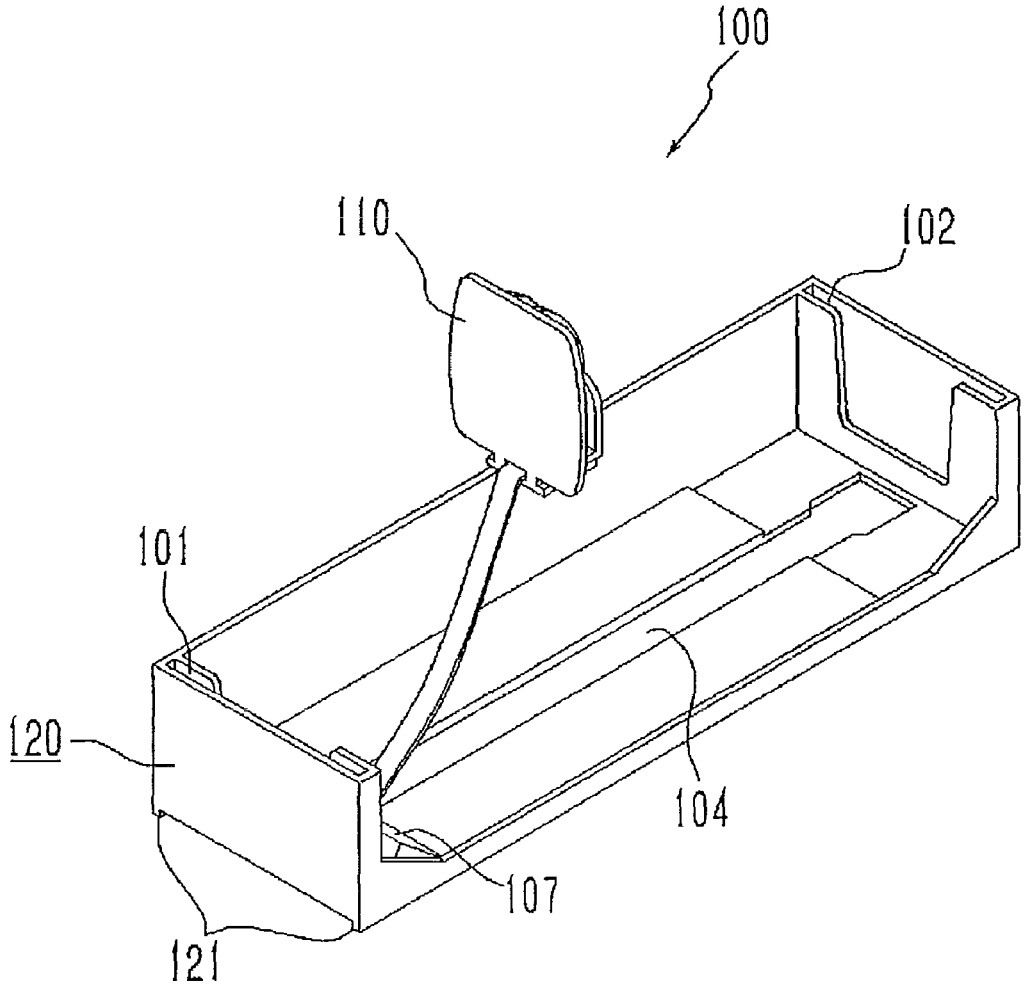
FIG. 39 is a perspective view showing a condition in which a slider member is removed from a magazine main body of the magazine unit.

Further, at a rear end of the opening 104 of the magazine main body 120, a wide opening part is formed. Therefore, as shown in FIG. 39, a bottom part of the slider member 110 is inserted from the wide opening part to the opening 104 of the magazine main body 120.

As shown in FIG. 38, as for the plate spring 111 of the magazine unit 100, the front end of the plate spring 111 is fixed to a front end of the magazine main body 120 and a wound part wound around its rear end, as the center, urging forward is located at a position where the wound part contacts the slider member 110 from behind. And, as shown in FIG. 38, as for the plate spring 111, a part located forward of a part below the slider member 110 is located inside the opening 104 of the magazine main body 120.

Further, in the magazine main body 120, an engaging hook 122 to which the front end of the plate spring 111 is attached is formed at a front center of the bottom surface. Further, at both left side and right sides of the engaging hook 122, protrusions 107 which displace a single cigarette pack T to upward are formed.

Figure 4:
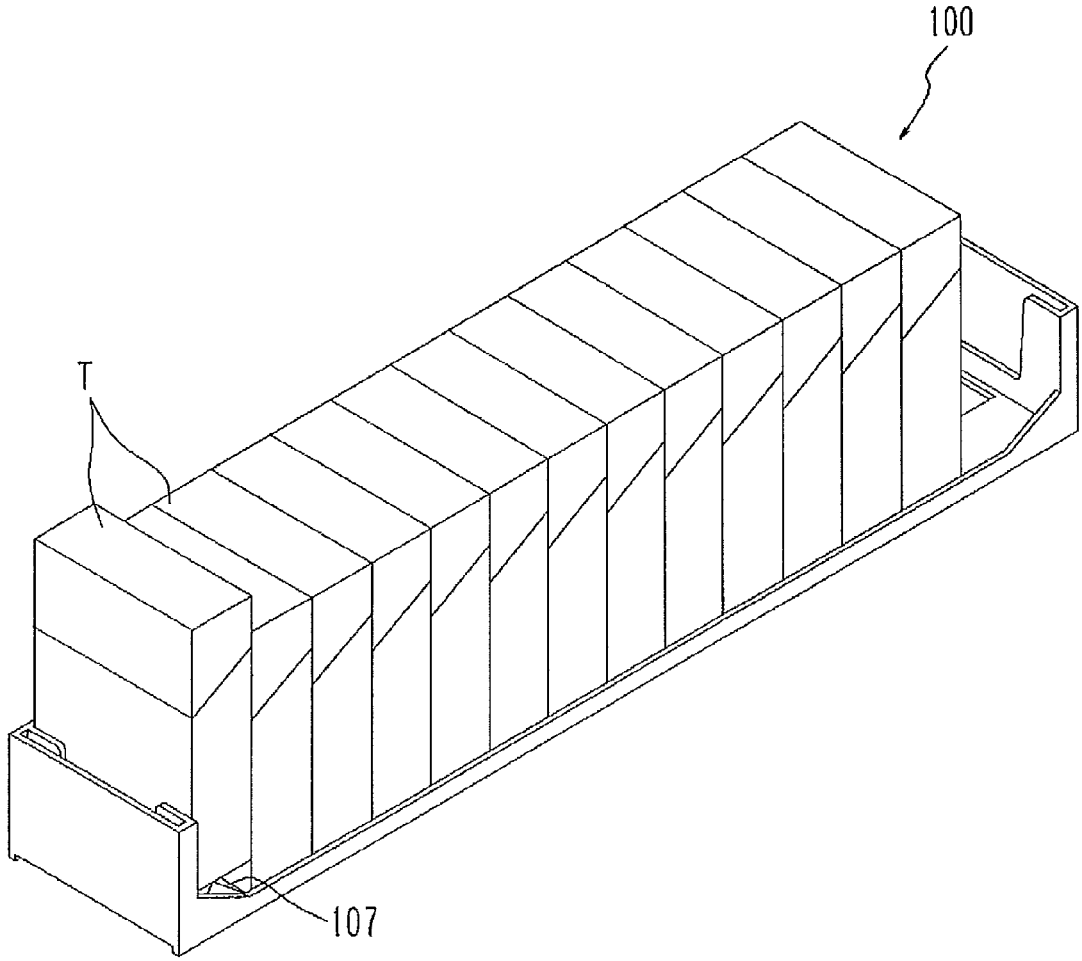
FIG. 4 is a perspective view showing a condition in which cigarette packs have been accommodated in the magazine unit.
Figure 5:
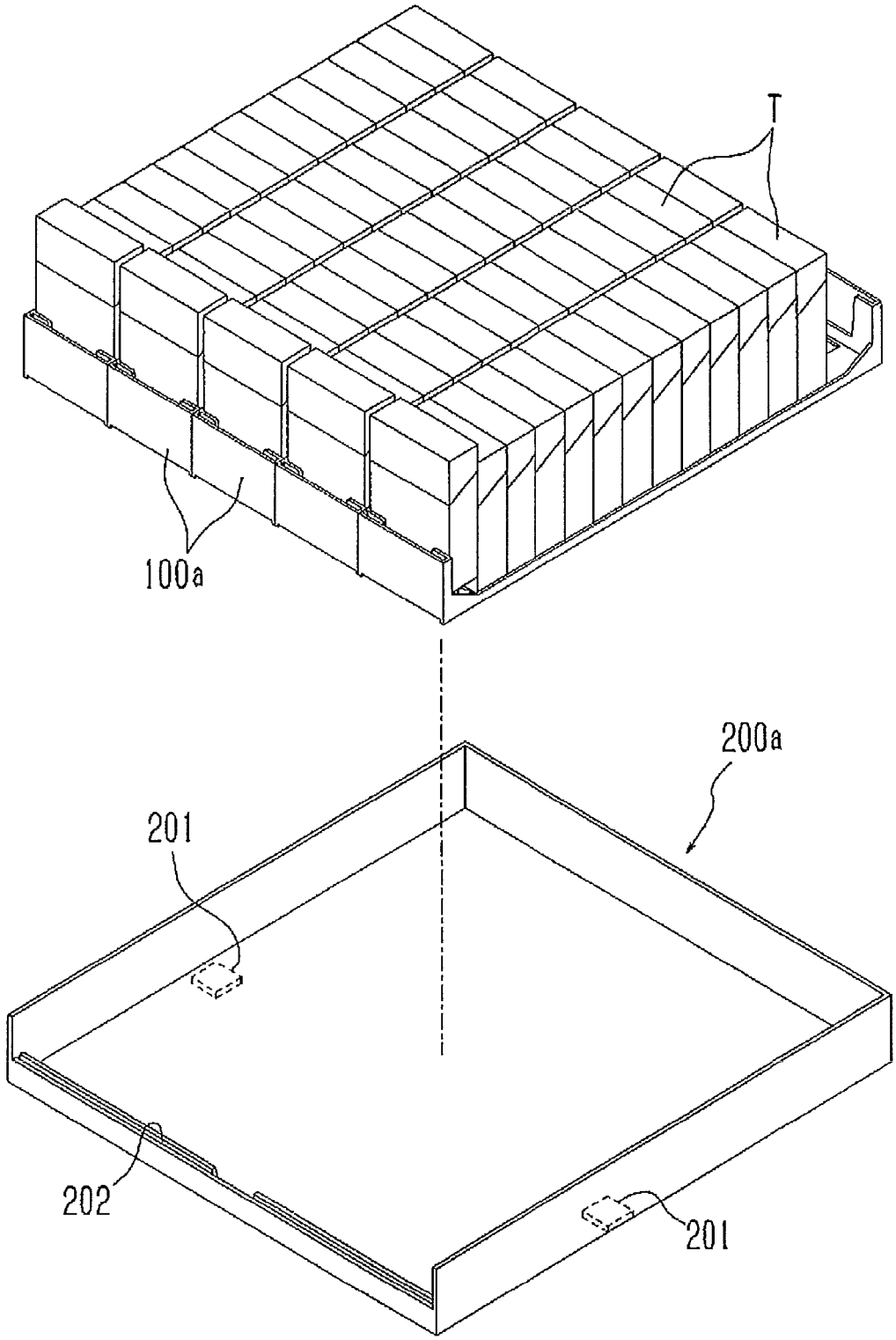
FIG. 5 is an exploded perspective view showing a condition in which the magazine units where the cigarette packs are accommodated are being set into one of four types of tray units.
Figure 6:
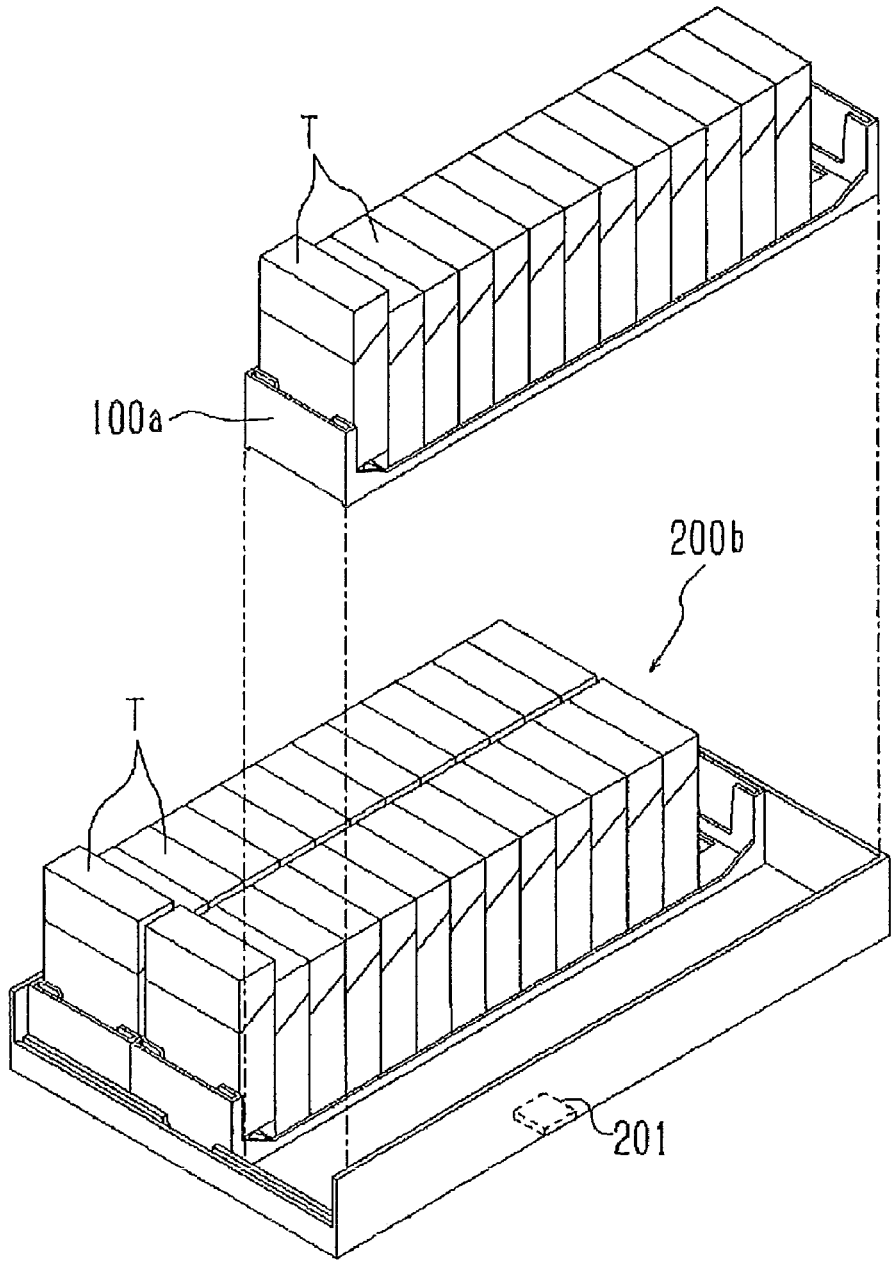
FIG. 6 is an exploded perspective view showing a condition in which the magazine units where the cigarette packs are accommodated are being set into one of four types of tray units.
Figure 7:
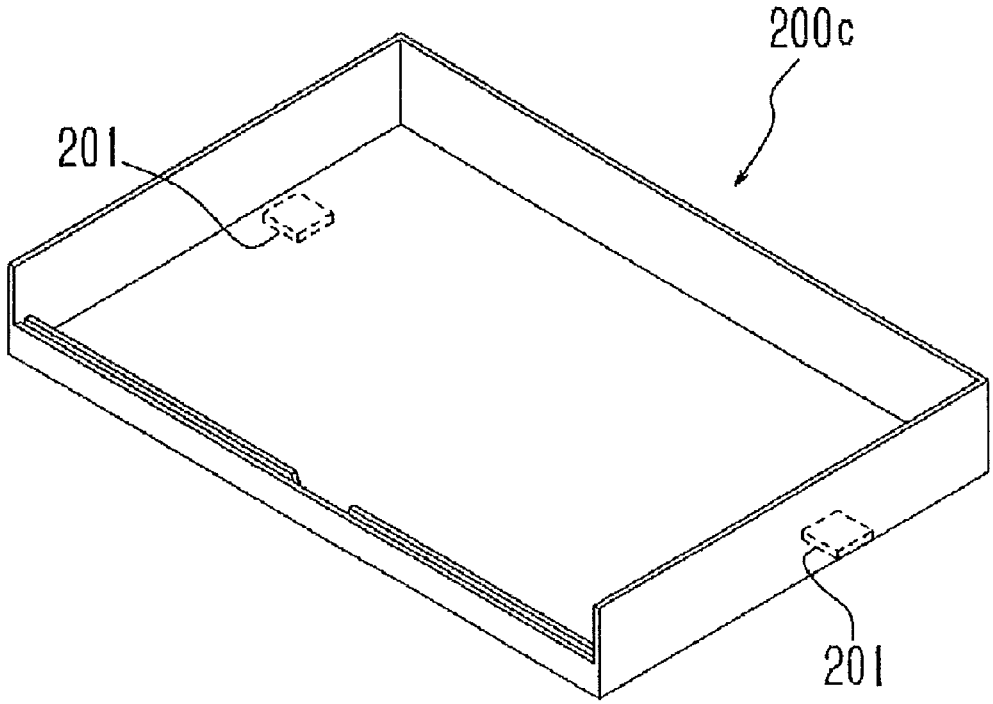
FIG. 7 is a perspective view showing one of the four types of tray units.
Figure 8:
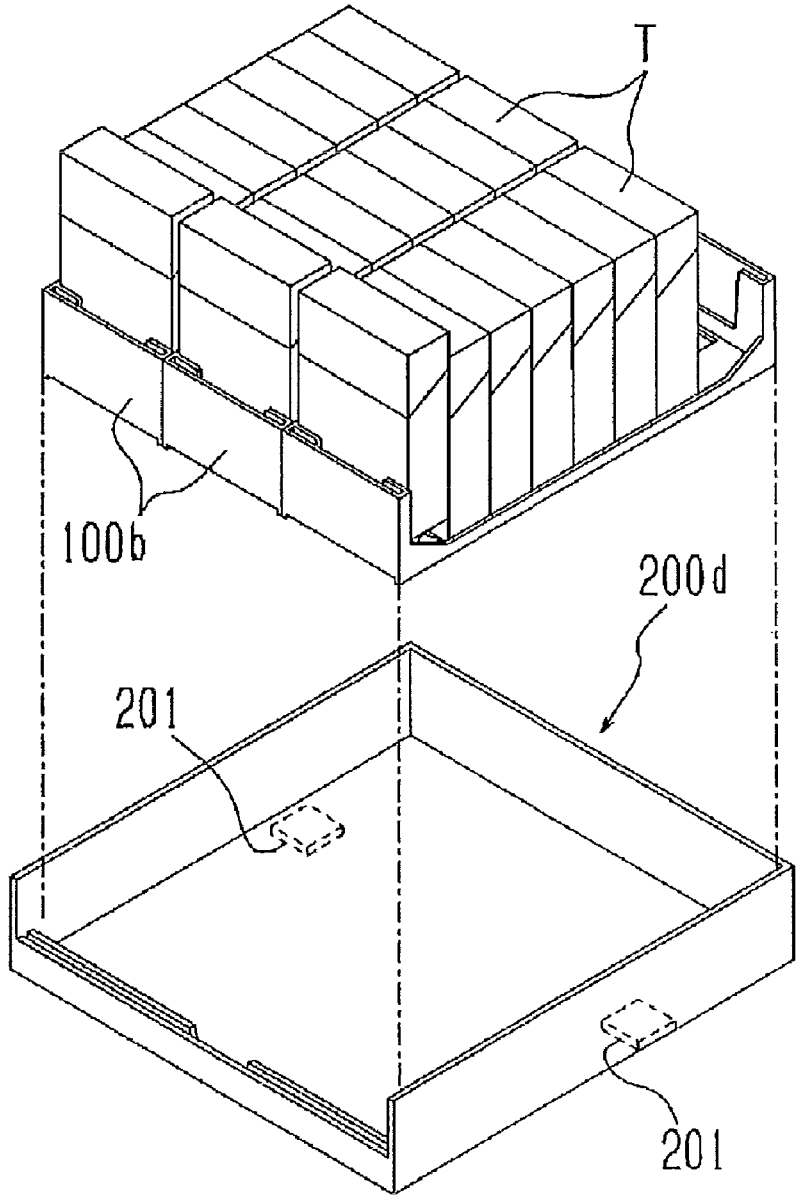
FIG. 8 is an exploded perspective view showing a condition in which the magazine units where the cigarette packs are accommodated are being set into one of four types of tray units.
Figure 9:
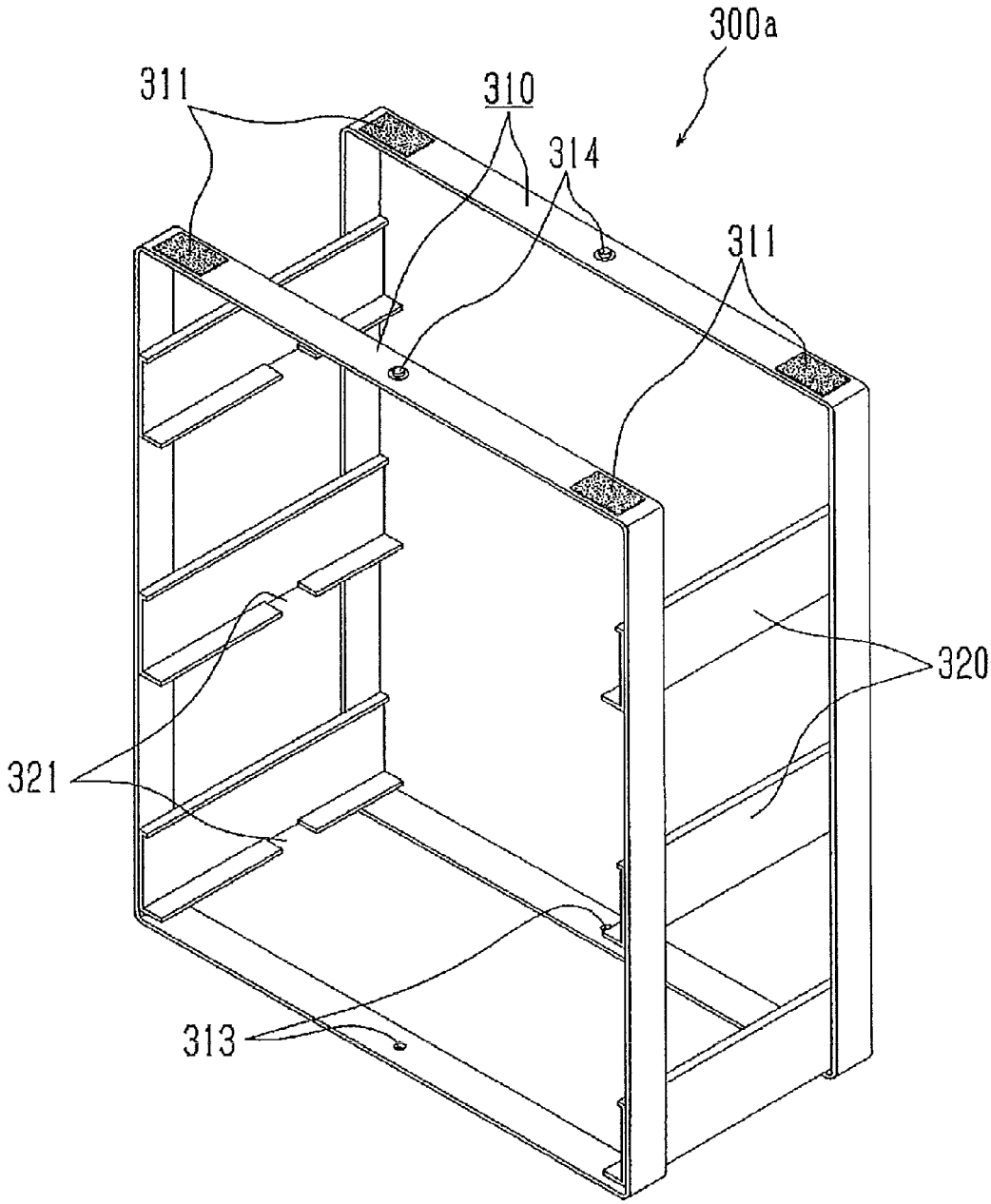
FIG. 9 is a perspective view showing one of four types of frame units.

The magazine protrusion 107 is formed to have a length from front to back same as that of a single cigarette pack T. Accordingly, as shown in FIG. 4, among the plurality of cigarette packs T, which are accommodated in the magazine unit 100 and pushed by the slider member 110 toward the front, only one at the front end protrudes upward.

Although the magazine protrusion 107 is formed at front bottom of the magazine unit 100 as mentioned above, in the backward range from the protrusion 107 where the slider member 110 can make sliding movement, the bottom surface is made in a flat plane without a protrusion.

As shown in FIGS. 5 to 8, the tray unit 200 is also formed in the shape of a box having an opened top using a colorless, transparent resin. A plurality of magazine units 100 is accommodated in the tray unit 200 while the magazine units 100 are arranged in a lateral direction. There are two types of magazine units 100*a* and 100*b* which have different lengths from front to back, as mentioned above.

Here, the cigarette display system 1000 of the present embodiment includes a tray unit 200*a* which accommodates five magazine units 100*a* having a long length from front to back, a tray unit 200*b* which accommodates three magazine units 100*a* having a long length from front to back, a tray unit 200*c* which accommodates five magazine units 100*b* having a short length from front to back, and a tray unit 200*d* which accommodates three magazine units 100*b* having a short length from front to back.

Tray protrusions 201 are formed at both sides of the bottom surface of the tray unit 200. Although, there are four types of tray units 200 of combinations of two types of width and two types of lengths from front to back, as mentioned above, the length between the tray protrusion 201 and the front surface is common to all types of tray units.

Although the details are described later, as shown in FIG. 34(*b*) and other drawings, a pocket 202 which accommodates, for example, an advertisement card C or the like for a plurality of cigarette packs T is formed at a front part of the tray unit 200.

As shown in FIGS. 9 to 13, the frame unit 300 includes a pair of main frames 310 and a plurality of support frames 320. The main frame 310 is made of a metal plate which is bent so that a front shape becomes a rectangular. A pair of the main frames 310 is arranged in a direction from front to back.

The support frame 320 is made of a metal plate which is formed in a rail shape elongated in a direction from front to back for supporting the tray unit 200, and a plurality of support frames 320 are arranged in the vertical direction and joined to an inner surface of the pair of the main frame 310.

However, as mentioned above, there are two types of lateral widths in the tray units 200. Therefore, as shown in FIGS. 9 to 12, the cigarette display system 1000 of the present invention includes a frame unit 300*a* for holding three of the tray units 200*a*, 200*c* having a large lateral width, a frame unit 300*b* for holding two of the tray units 200*a*, 200*c* having the large lateral width, a frame unit 300*c* for holding three of the tray units 200*b*, 200*d* having a small lateral width, and a frame unit 300*d* for holding two of the tray units 200*b*, 200*d* having the small lateral width.

In the frame unit 300, a guide concave part 321 is formed in the support frame 320. The tray protrusion 201 of the tray unit 200 engages with the guide concave part 321. As mentioned above, although there are two types of lengths from front to back for the tray units 200, the lengths from their front surfaces to the tray protrusions 201 are common.

Further, as for the four types of frame units 300, the length from each front surface to the guide concave part 321 is common. Because of this, as shown in FIGS. 1(*a*) and 13, positions of the front surfaces of the tray units 200 held by the frame units 300 are lined up in well-positioned to be flush-fitting.

Figure 14:
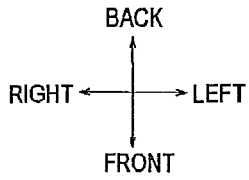
FIG. 14 is a plan view showing a relationship between a plurality of frame units and tray units both of which are arranged in a lateral direction.
Figure 14:
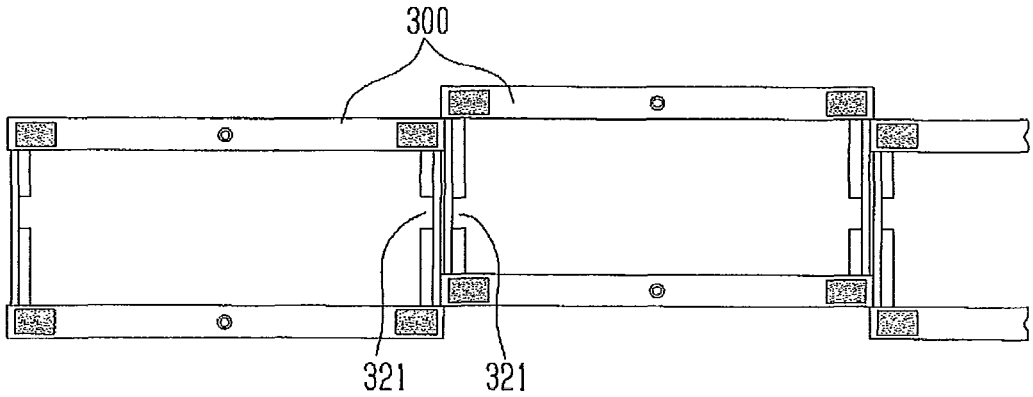
Figure 14:
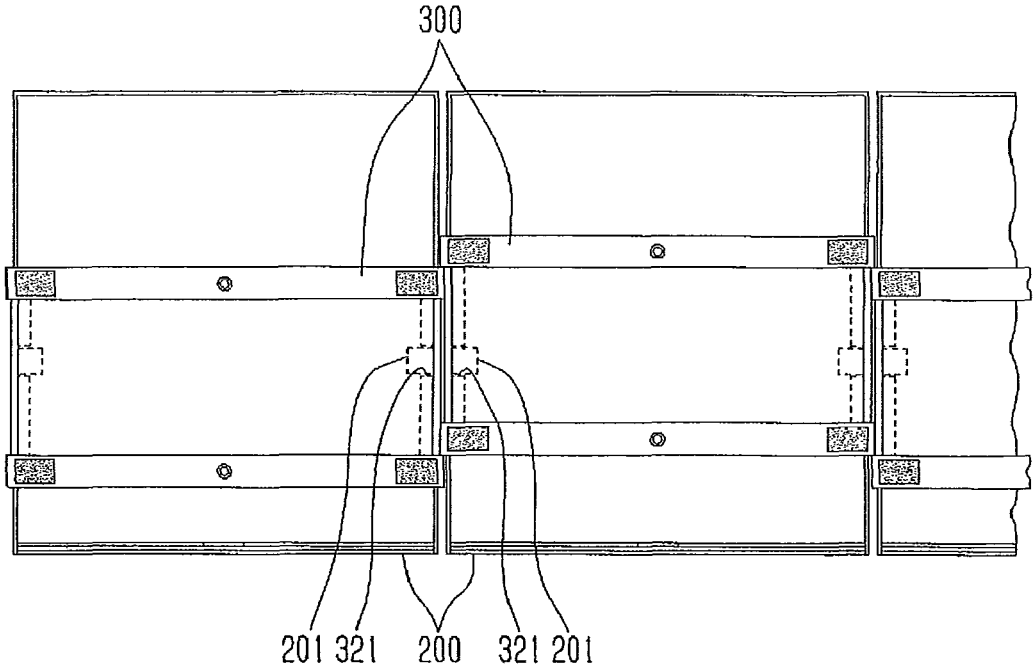

Furthermore, as shown in FIG. 14(*a*), when a plurality of the frame units 300 are arranged in the left-right direction (lateral direction) while alternately front-back inverted such that the main frames 310 are adjacent to each other in the front-back direction, the positions of the guide concave parts 321 of each respective frame units 300 are lined up in well-positioned in the front-back direction.

Figure 33:
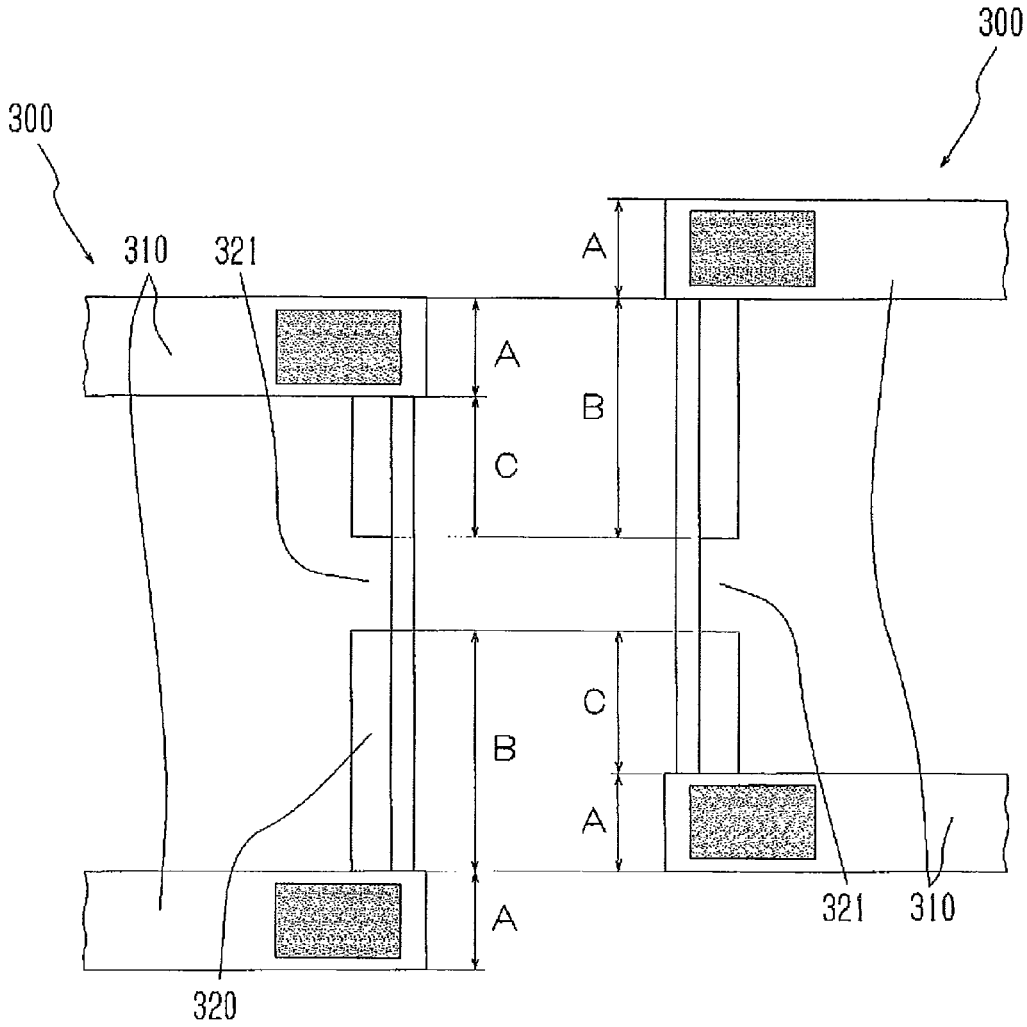
FIG. 33 is a plan view in an enlarged scale of relevant parts showing relationships between sizes of each part of the frame unit.

And, as shown in FIG. 33, a length from front to back A of the main frame 310, a length B from a rear edge of the front main frame 310 to a front edge of the guide concave part 321, and a length C from a rear end of the guide concave part 321 to a front end of the rear main frame 310 satisfy:

$$B=A+C.$$

Therefore, when arranging a plurality of frame units 300 in the lateral direction, if odd-numbered frame units 300 and even-numbered frame units 300 are alternately front-back inverted and the main frames 310 are arranged to be adjacent to each other in a direction from front to back, as shown in FIG. 14(*a*) and FIG. 33, positions of guide concave parts 321 of respective frame units 300 are matched in a direction from front to back. Therefore, as shown in FIG. 14(*b*), when the tray units 200 are mounted in the frame units 300 arranged in this way, positions of the front surface of the tray units 200 are lined up in well-positioned to be flush-fitting.

In the frame unit 300, surface fasteners 311, frame link mechanisms, are mounted on both sides of top surface and both sides of bottom surface of the main frames 310. At the center of the bottom surface of the main frame 310, a frame through-hole 313 which serves as a frame concave part is formed. At the center of the top surface of the main frame 310, a protrusion part 314 which serves as a frame protrusion is formed.

In the cigarette display system 1000 of the embodiment, as shown in FIG. 1, when installing a plurality of frame units 300 having a same lateral width in the vertical direction, the plurality of frame units 300 are linked by the surface fasteners 311. At this time, the frame through-holes 313 engage with the protrusion parts 314.

Figure 15:
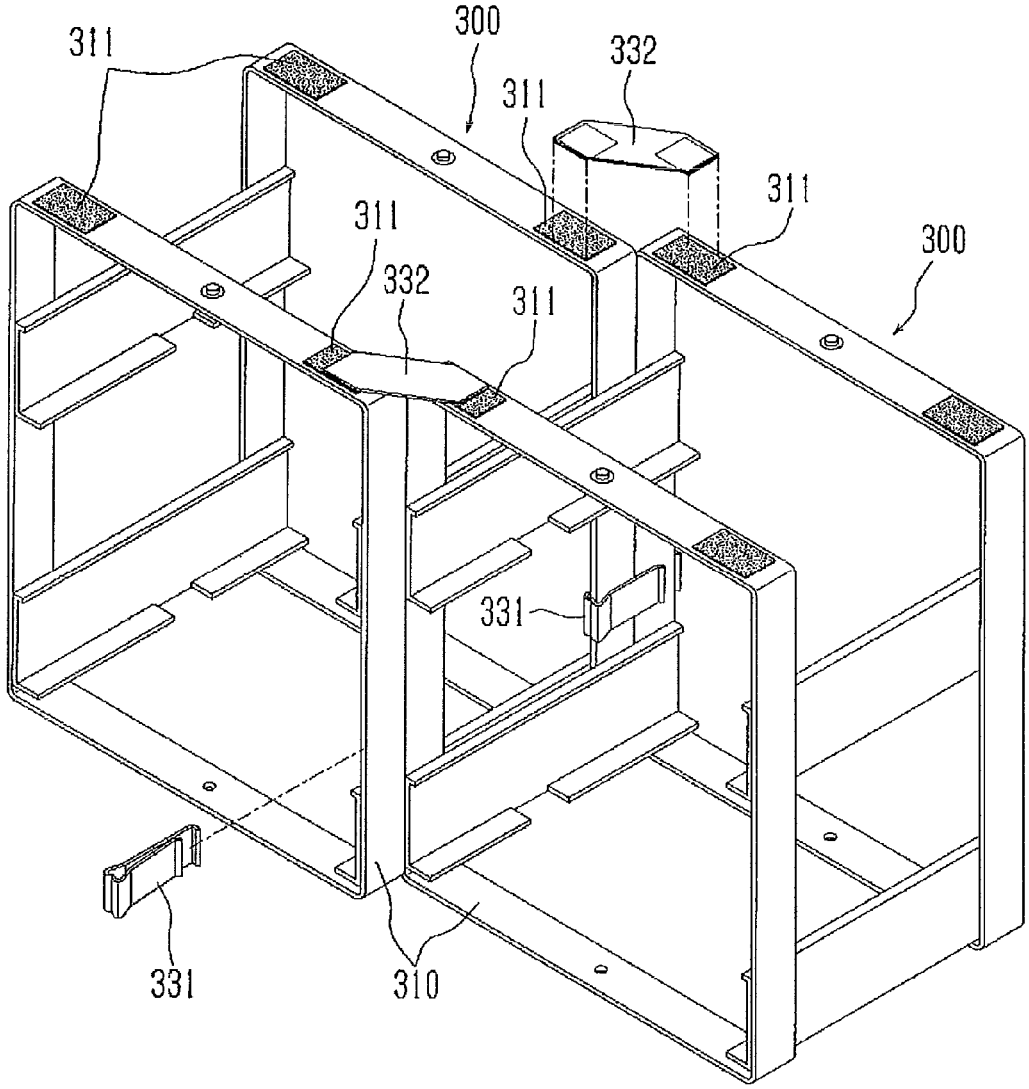
FIG. 15 is an exploded perspective view showing a condition in which a plurality of frame units arranged in the lateral direction are linked together by clip members and fastener members both of which are a lateral link mechanism.

As shown in FIG. 15, the cigarette display system 1000 has clip members 331 and fastener members 332, which serve as lateral link mechanisms for holding a plurality of frame units 300 which are alternately front-back inverted and arranged in the lateral direction as mentioned above.

The clip members 331 are formed by a spring material, and resiliently hold the main frames 310 which are adjacent to each other in a direction from front to back as mentioned above. The fastener members 332 have a structure in which a pair of surface fasteners is attached to a bottom surface of a resin plate. And the fastener members 332 are joined to the surface fasteners 311 adjacent to each other on top surfaces of the plurality of frame units 300 arranged as mentioned above.

Figure 16:
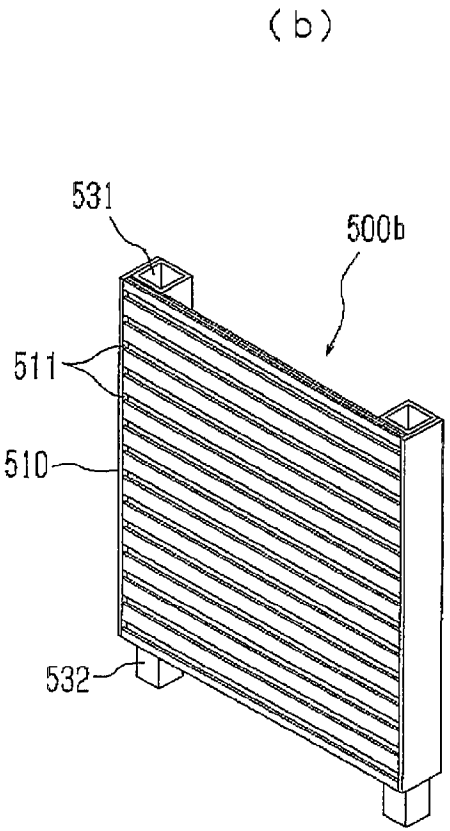
FIG. 16 is a perspective view showing appearances of two types of wall units.
Figure 16:
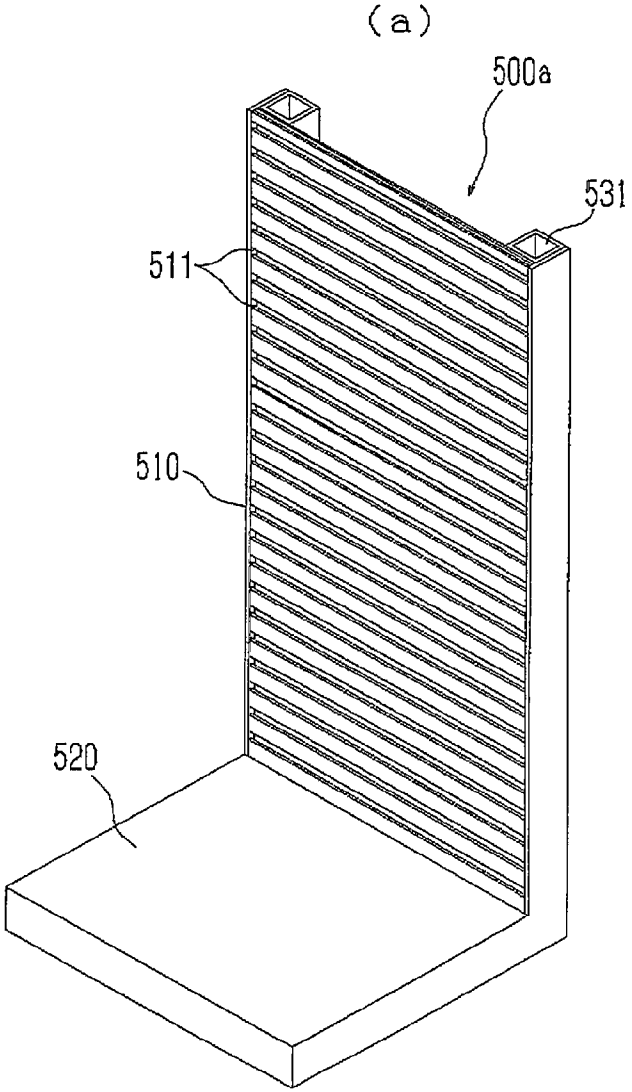

As shown in FIG. 16, the wall units 500 include a base wall 500*a* and a panel wall 500*b*. Each of the base wall 500*a* and the panel wall 500*b* has a wall part 510 which has a flat plate shape flattened in a direction from front to back.

In the base wall 500*a*, a pedestal 520 is integrally formed at a bottom end of the wall part 510, and a wall link mechanism is mounted at the top end of the wall part 510. In the panel wall 500*b*, the wall link mechanisms are mounted at the top end and the bottom end.

More specifically, in the wall unit 500, metal pipes 531 that are rectangular in cross-section and have additional function of reinforcement are attached at left and right of the back surface. In the panel wall 500*b*, metal pipes 532 having a diameter slightly smaller than that of the metal pipes 531 are fixed at the bottom end of the metal pipes 531.

The metal pipes 532 at the bottom end of the panel wall 500*b* engage with the metal pipes 531 at the top end of the base wall 500*a* and the panel wall 500*b* from the top in such a manner that the metal pipes 532 can be freely engaged and disengaged. By using the wall link mechanism including these metal pipes 531, 532, it is possible to link a plurality of panel walls 500*b* in the vertical direction and also link the panel wall 500*b* to the base wall 500*a* on the top thereof.

Figure 10:
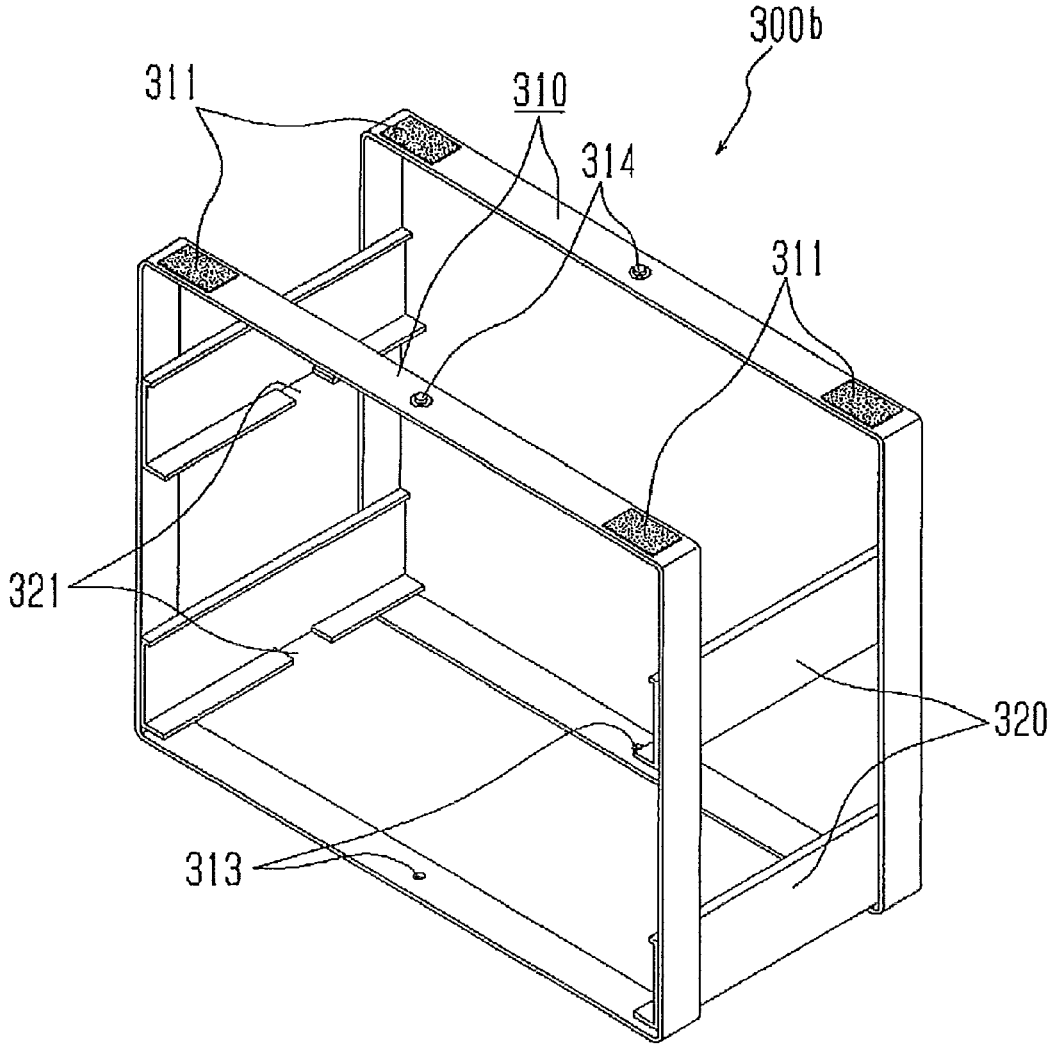
FIG. 10 is a perspective view showing one of the four types of frame units.
Figure 11:
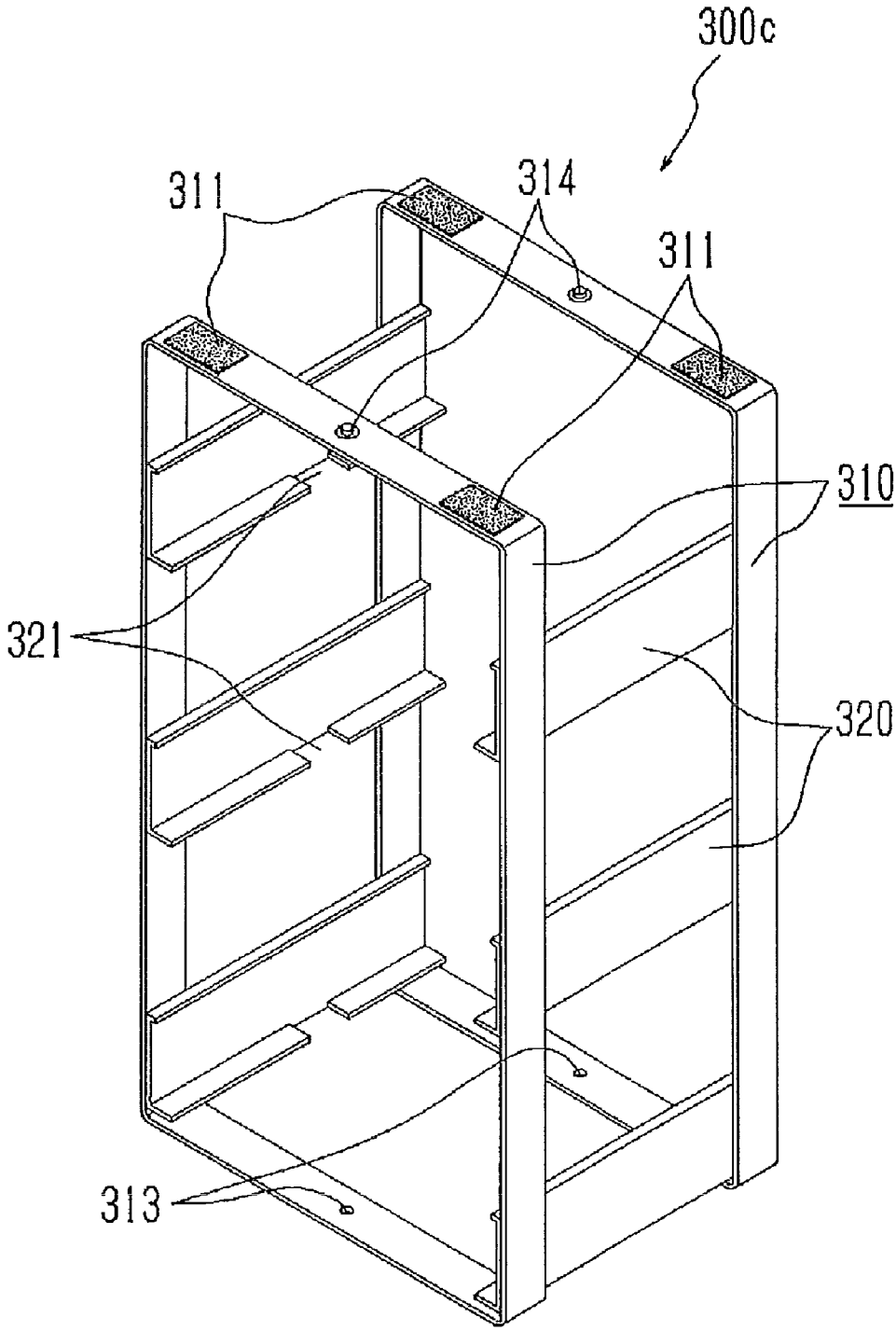
FIG. 11 is a perspective view showing one of the four types of frame units.
Figure 12:
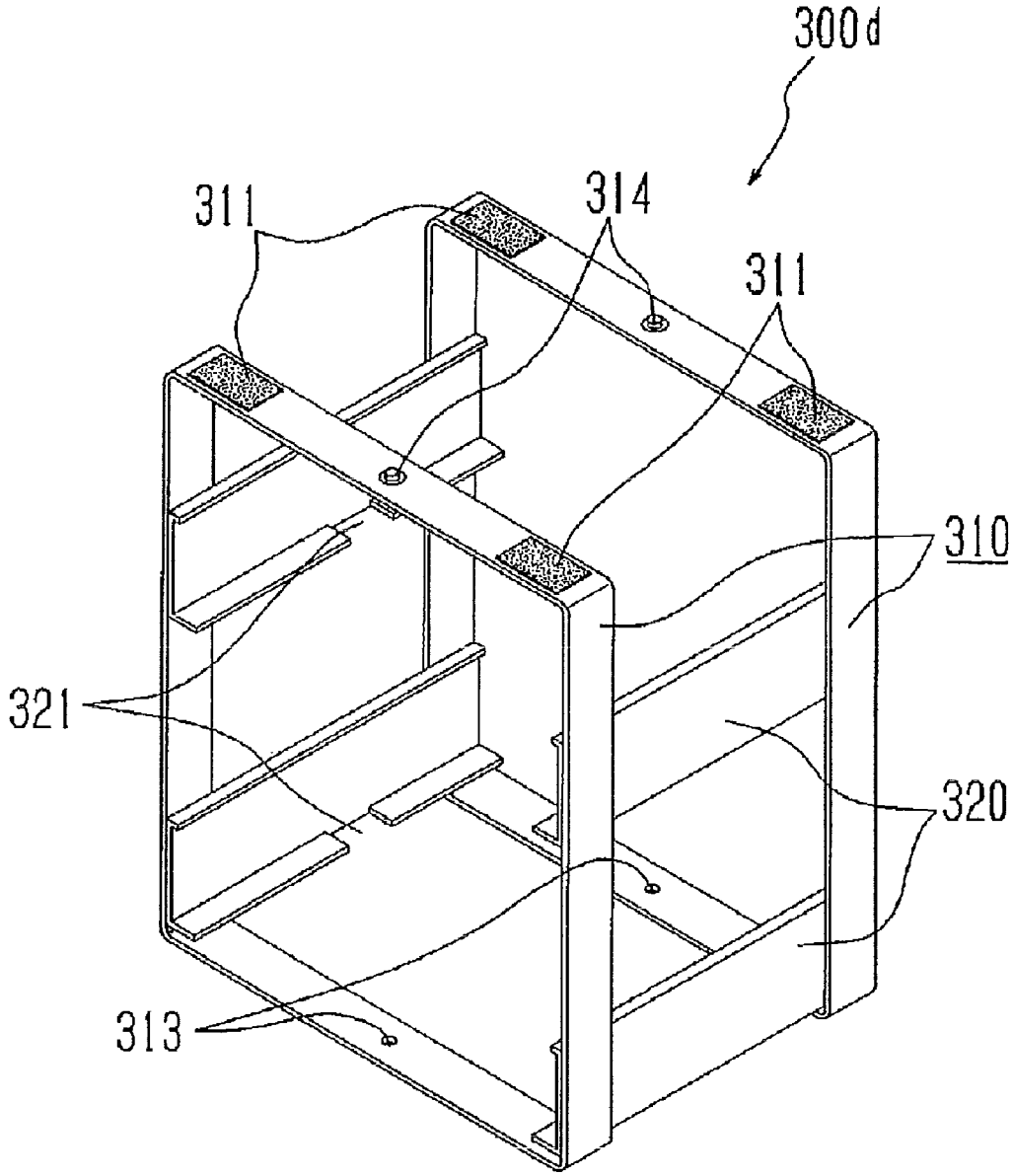
FIG. 12 is a perspective view showing one of the four types of frame units.
Figure 13:
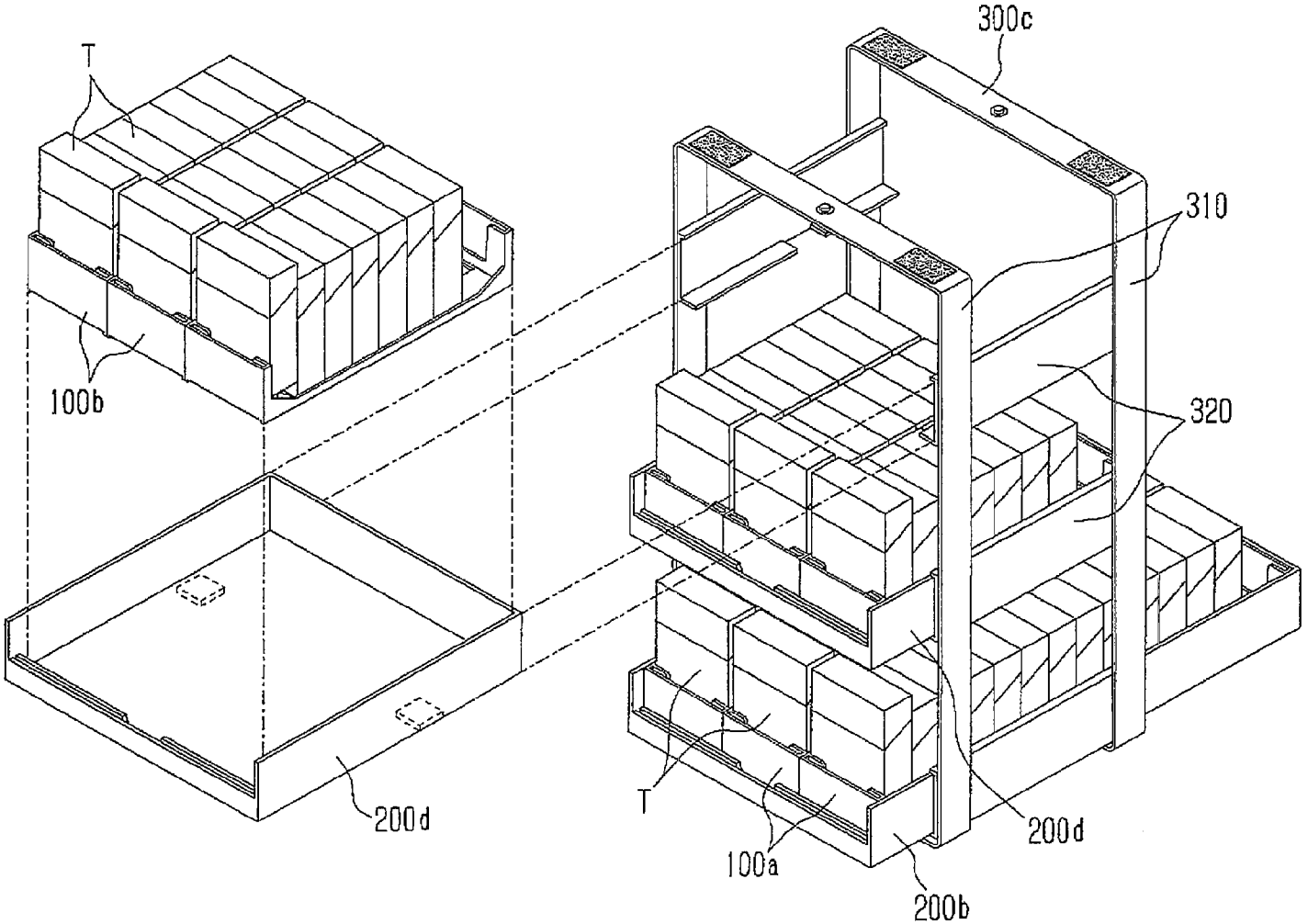
FIG. 13 is an exploded perspective view showing a condition where tray units in which cigarette packs are accommodated by magazine units are being set into one of the four types of frame units.

Recesses and protrusions of a predetermined shape are formed on the front surface of the wall part 510 of the base wall 500*a* and the panel wall 500*b*. More specifically, as recesses and protrusions, concavity channels 511 running in the lateral direction are arranged at a predetermined interval in the vertical direction. As shown in FIG. 10, the concavity channel 511 is formed in a cross-section of L shape whose rear part is bent downward, for example.

Figure 17:
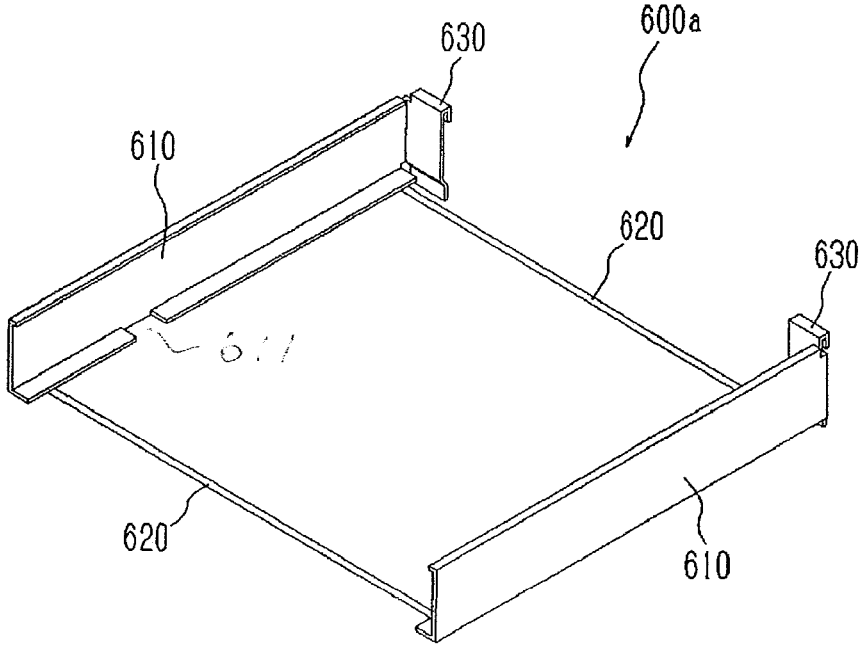
FIG. 17 is a perspective view showing two appearances of four types of tray attachments.
Figure 17:
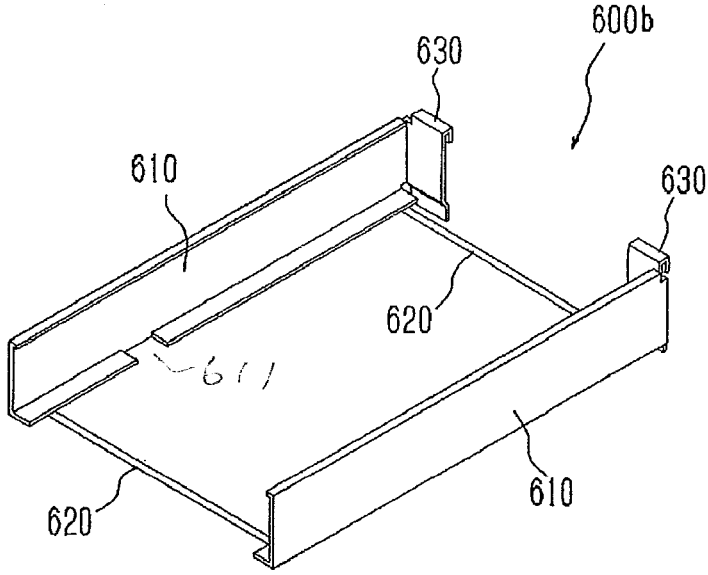
Figure 18:
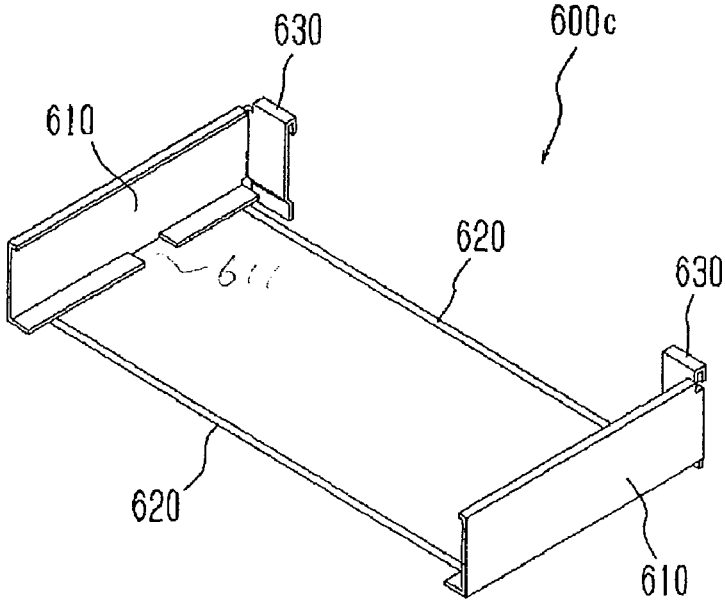
FIG. 18 is a perspective view showing two appearances of four types of tray attachments.
Figure 18:
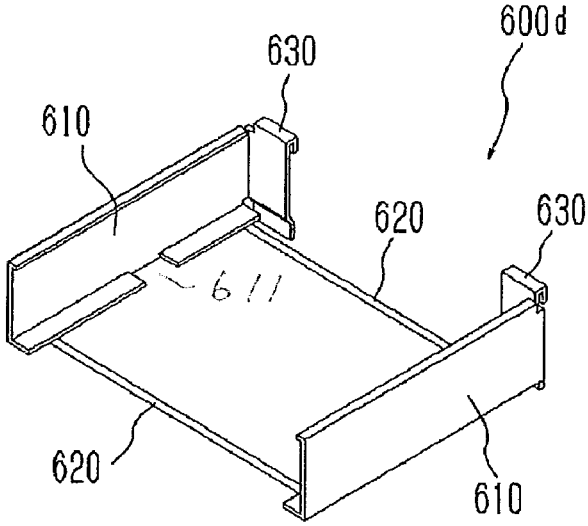

As shown in FIGS. 17 and 18, tray attachments 600*a* to 600*d* are formed in a structure capable of holding the tray units 200*a* to 200*d* respectively. More specifically, the tray attachment 600 has a pair of support frames 610 elongated in a direction from front to back.

The support frame 610 is made of a metal plate which is formed in a rail shape elongated in a direction from front to back for supporting the tray unit 200. The pair of support frames 610 is linked by link frames 620 elongated in the lateral direction at the front and back of the bottom surface.

Here, as mentioned above, there are four types of tray units 200 of combinations of two types of lateral widths and two types of lengths from front to back. Accordingly, there are four types of tray attachments 600*a* to 600*d* of combinations of two types of lateral widths and two types of lengths from front to back, corresponding to the tray units 200*a* to 200*d*.

Further, a guide concave part 611 is formed in the support frame 610 in the tray attachments 600*a* to 600*d*. The tray protrusion 201 of the tray unit engages with the guide concave part 611.

In the four types of tray units 200 and the four types of tray attachments 600, the tray protrusions 201 and the guide concave parts 611 are formed so that the positions of back parts of the tray unit 200 and the tray attachment 600 are lined up in well-positioned when the tray unit 200 is attached to the tray attachment 600. Further, the engagement mechanism 630 which detachably engages with the concavity channel 511 of the wall unit 500 is formed at the back end of the support frame 610.

Figure 19:
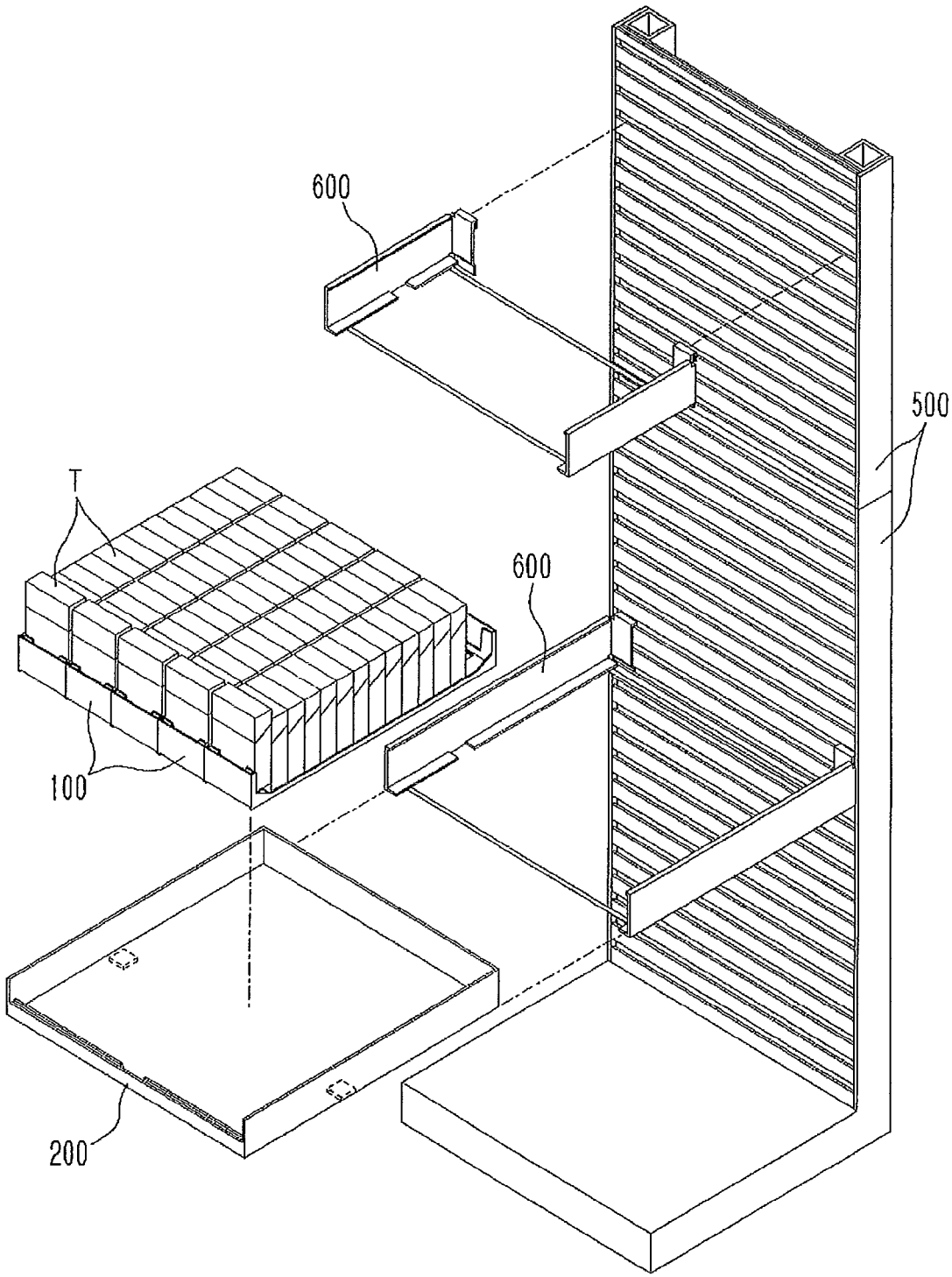
FIG. 19 is an exploded perspective view showing a condition in which a tray unit is being attached to a wall unit by a tray attachment.
Figure 20:
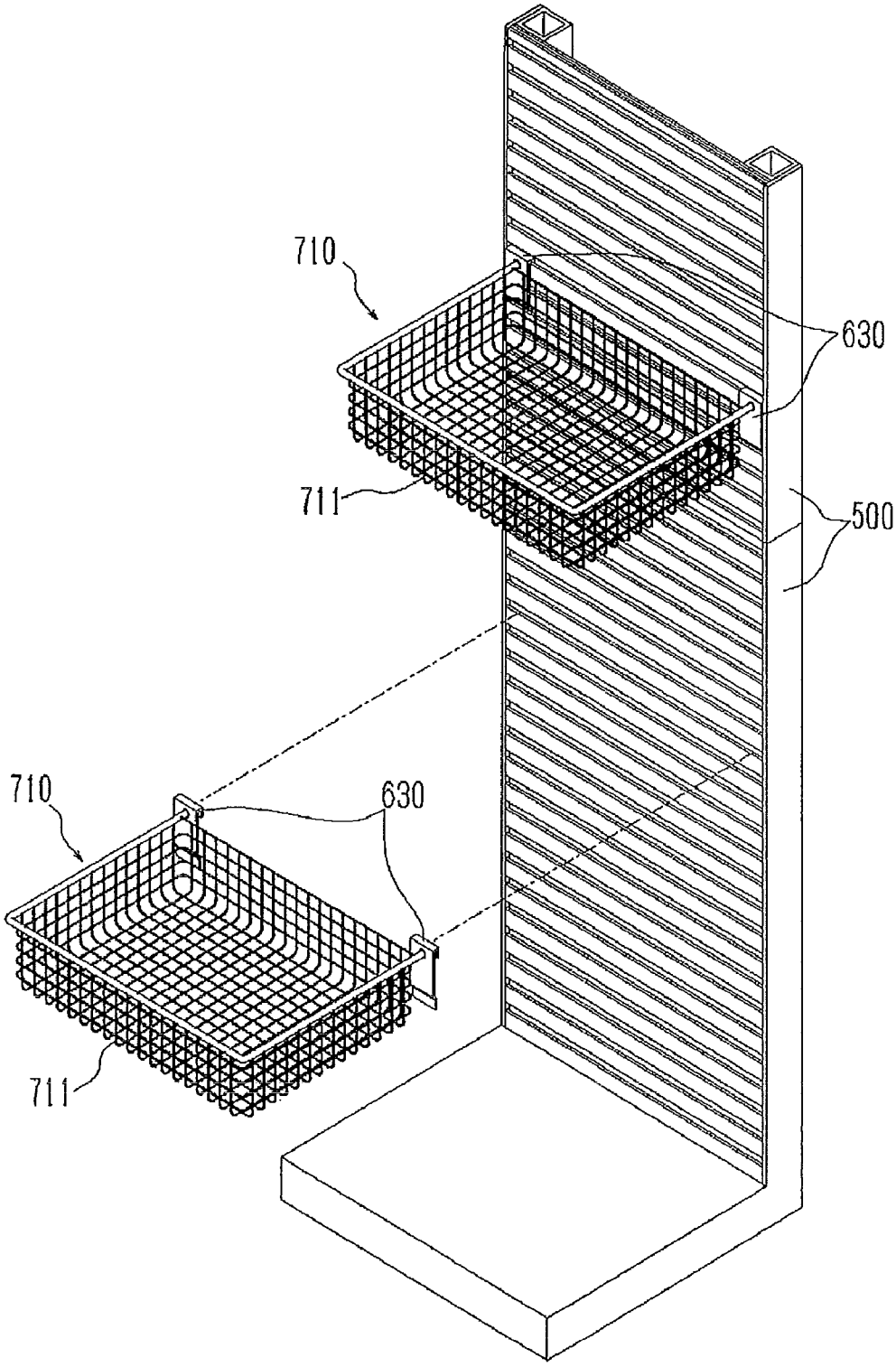
FIG. 20 is an exploded perspective view showing a condition in which a basket unit is being attached to a wall unit.

As mentioned above, there are two types of lateral widths in the tray units 200 and the tray attachments 600. Therefore, as shown in FIG. 19, the wall unit 500 is formed to have a lateral width which corresponds to the wide tray attachments 600*a* and 600*c*.

As mentioned above, since there are two types of lengths from front to back in the tray unit 200, the pedestal 520 of the base wall 500*a* is formed to have a length from front to back corresponding to that of the tray units 200*a* and 200*b* which have the longest length from front to back. Therefore, the tray unit 200 does not protrude forward beyond the pedestal 520 of the base wall 500*a*, regardless of the type of the tray unit 200.

As shown in FIG. 1 and other drawings, the cigarette display system 1000 of the embodiment may have various types of units which are detachably attached to the wall units 500, other than the tray units 200 mentioned above.

For example, as shown in FIGS. 1(*b*) and 20, a basket unit 710 includes a basket member 711 formed in the shape of a box with an opened top, and the engagement mechanism 630 formed at a rear part of the basket member 711.

Figure 21:
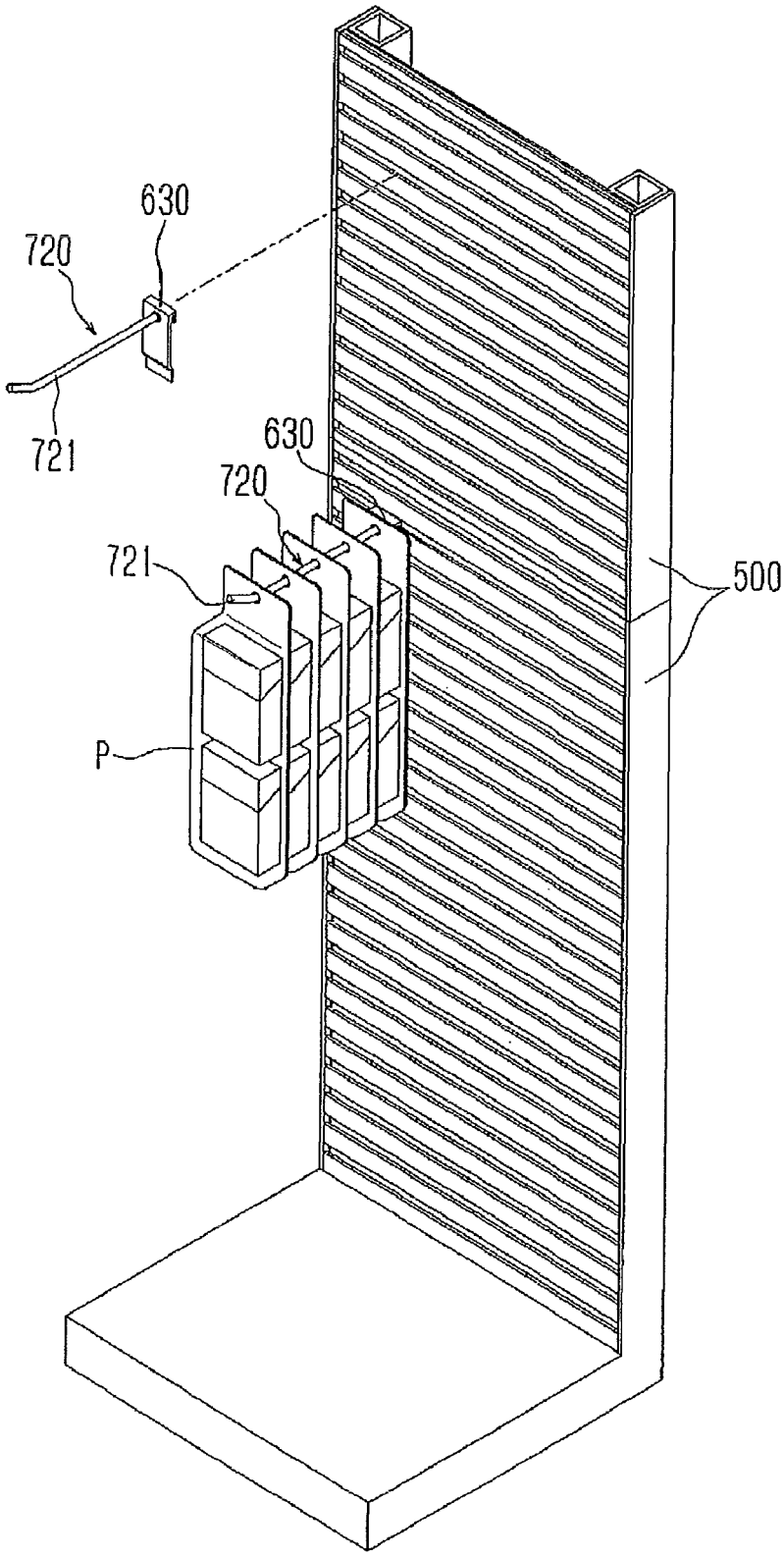
FIG. 21 is an exploded perspective view showing a condition in which a shaft unit is being attached to a wall unit.

Further, as shown in FIG. 1(*b*) and FIG. 21, a shaft unit 720 includes a shaft part 721 elongated in a direction from front to back and the engagement mechanism 630 formed at a rear part of the shaft part 721.

Further, as shown in FIGS. 1(*b*) and 22, the frame unit 300 is attached to the front surface of the wall unit 500 by a pair of frame attachments 700. The frame attachment 700 includes a support part 701 which is elongated in a direction from front to back and has a cross-section of L shape, and the engagement mechanism 630 formed at a rear part of the support part 701.

Figure 37:
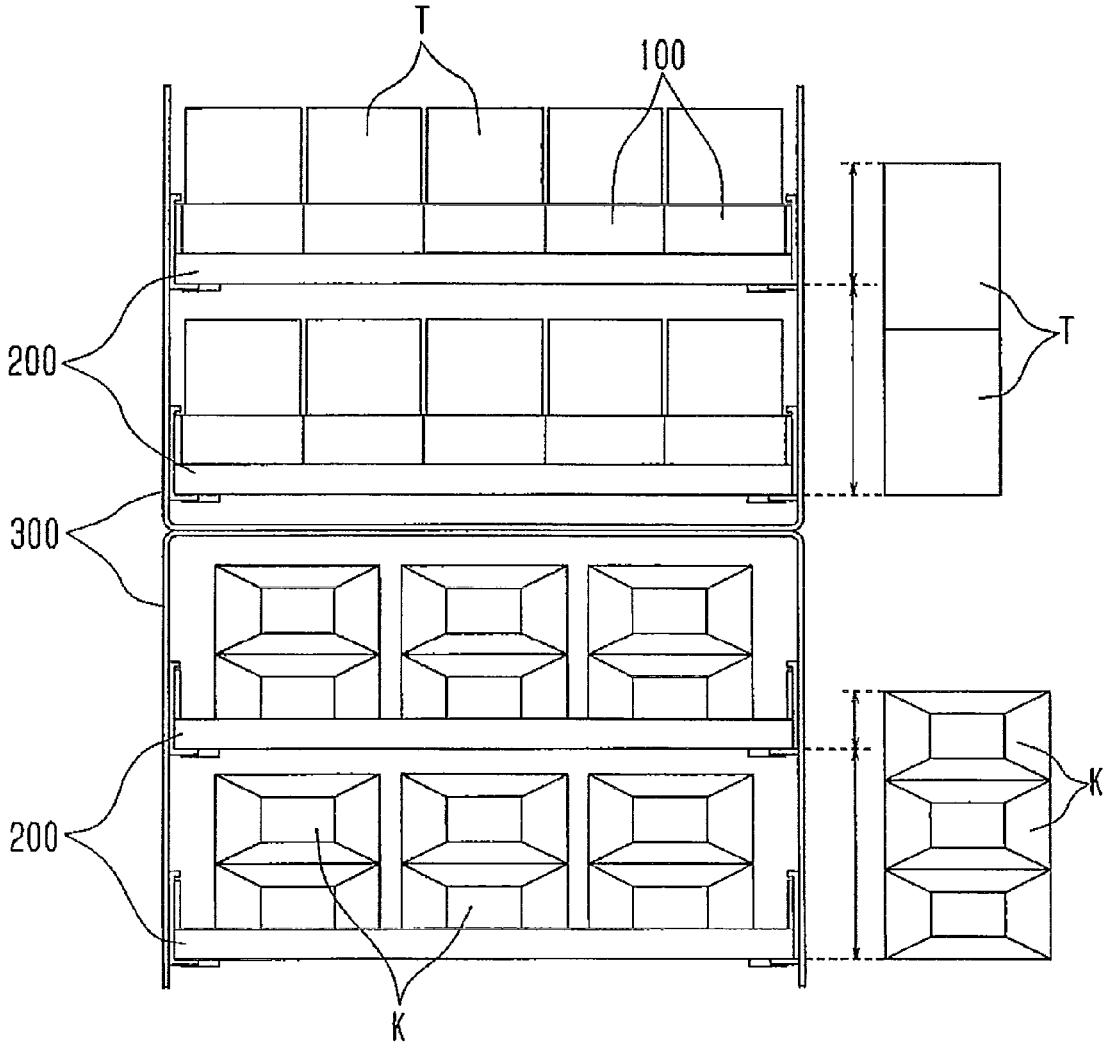
FIG. 37 is a front view showing a relationship between intervals of the tray units arranged in the vertical direction and sizes of accommodated cigarette packs and cigarette cartons.

In the frame unit 300, as shown in FIG. 37, a plurality of tray units 200 are arranged in the vertical direction at intervals of a length which is greater than or equal to the vertical height of a cigarette pack T elongated in the vertical direction and smaller than or equal to two times of the vertical height of the cigarette pack T. At the same time, the plurality of tray units 200 are arranged in the vertical direction at intervals of a length which is greater than or equal to two times of the vertical height of a cigarette carton K elongated in a direction from front to back and flattened in the vertical direction and smaller than or equal to three times of the vertical height of the cigarette carton K.

In a configuration as mentioned above, for the cigarette display system 1000 of the embodiment, even when making a combination of the four types of frame units 300 in the vertical and lateral directions as shown in FIG. 1(*a*) , or making a combination of the two types of wall units 500 in the vertical and lateral directions as shown in FIG. 1(*b*) , it is possible to form a whole system and freely adjust its vertical height and lateral width.

Because of this, the cigarette display system 1000 of the embodiment can have an outer shape suitable to an installation space. Therefore, it is possible to use space effectively, and generation of dead space can be prevented effectively.

Further, even when the cigarette display system 1000 is formed by the frame units 300, or formed by the wall units 500, the four types of tray units 200 and two types of magazine units 100 can be commonly used and freely installed. Because of this, by only mass-producing a small types of units 100 to 600 and the like, it is possible to provide extremely various cigarette display systems 1000 to stores.

Furthermore, in a store where the cigarette display system 1000 is used, the tray units 200 and magazine units 100 can be continuously used, even when the use of the wall units 500 is changed to the use of the frame units 300.

And, when the cigarette display system 1000 which is set up by the frame units 300 are used in some of a plurality of sales spaces and the cigarette display system 1000 which is set up by the wall units 500 are used in the other sales spaces, the tray units 200 and the magazine units 100 can be commonly used by both of the cigarette display systems 1000. In addition, when the cigarette display system 1000 is formed by the wall units 500, the frame units 300 can be used as its parts.

The cigarette display system 1000 can be set up by the frame units 300 as well as the wall units 500 as mentioned above. Therefore, since there is flexibility in the site of installation and the mode of display of the cigarette packs T, it is possible to set up a highly-appealing space.

Therefore, the owner or the like of the store can actively design a cigarette pack display configuration to set up a sales space which can attract attention effectively. Furthermore, companies which provide the cigarette packs T to stores can propose new display configurations.

In a case of a frame structure, since there are wide frame units 300*a*, 300*b* for holding five lines of cigarette packs T, and narrow frame units 300*c*, 300*d* for holding three lines of cigarette packs T, it is possible to have the system favorably correspond to a lateral width of installation space.

Further, since there are tall frame units 300*a*, 300*c* for holding three rows of cigarette packs T, and short frame units 300*b*, 300*d* for holding two rows of cigarette packs T, the cigarette display system 1000 can beset up so as to fit various height installation spaces.

The frame units 300*a* to 300*d* are linked in the vertical direction in a combination of frame units having the same width, while there is no limit on the combination of the frame units 300*a* to 300*d* when they are arranged in the lateral direction.

The tray units 200*a* to 200*d* are held by the frame units 300*a* to 300*d* having corresponding lateral widths, while there is no limit on a length from front to back of the tray unit 200 held by the frame unit 300.

Further, two or three tray units 200 are held by the frame unit 300. There is no limit on the minimum number of the tray units 200 held by the frame unit 300.

The tray units 200*a* to 200*d* are held by the tray attachments 600*a* to 600*d* respectively having a corresponding lateral width. However, as for the wall units 500, there is no limit on a location and the number of the tray units 200 attached to the wall units 500 by using the tray attachments 600 on the front surface of the wall units 500.

In addition, the frame units 300 are joined together in the vertical direction by the surface fasteners 311. Because of this, a plurality of frame units 300 can be joined together easily in the vertical direction without any tool or the like.

Furthermore, as shown in FIG. 15, it is possible to link, in the lateral direction, a plurality of frame units 300 which are alternately front-back inverted and arranged in the lateral direction as mentioned above, by using the clip members 331 and the fastener members 332.

Because of this, a plurality of frame units 300 can be linked together easily also in the lateral direction without requiring any tool or the like. Further, the surface fasteners 311 for linking the frame units 300 in the vertical direction are effectively used also for linking of the lateral direction as mentioned above.

It is possible to mount the magazine units 100 by using the tray units 200 in the frame units 300 set up in the vertical and lateral directions without any tool as mentioned above.

The wall units 500 are joined together in the vertical direction by engagements of the metal pipes 531 and 532. Because of this, a plurality of wall units 500 can be joined together easily and securely in the vertical direction without any tool or the like.

It is possible to arrange and place the wall units 500, which are linked in the vertical direction as described above, in the lateral direction. And, it is possible to mount the magazine units 100 by using the tray attachments 600 and tray units 200 in the wall units 500 set up in the vertical and lateral directions without any tool as mentioned above.

The cigarette display system 1000 of the embodiment can be easily set up without any tool, both when it is formed by the frame units 300 and when it is formed by the wall units 500 as mentioned above.

Because of this, the cigarette display system 1000 which is large and strong as a whole can be easily set up by using small and lightweight frame units 300 and wall units 500. Especially, since the cigarette packs T to be accommodated are lightweight, the cigarette display system 1000 relatively has high strength.

Therefore, bringing in and installation of the cigarette display system can be performed quickly while using a small space. For example, for a 24-hour convenience store, bringing in and installation of the cigarette display system 1000 need to be performed when a store is open to customers.

However, as mentioned above, the cigarette display system 1000 can be quickly brought in and installed using a small space. Therefore, it does not disturb a sales operation of the convenience store and the like.

Further, in the frame unit 300, a product which is used to join parts of automobiles can be used as the surface fastener 311. In that case, a plurality of frame units 300 can be joined together securely by the surface fasteners 311.

When a plurality of frame units 300 are joined together in the vertical direction as mentioned above, a pair of the protrusion parts 314 of a lower frame unit 300 engage with a pair of the frame through-holes 313 of an upper frame unit 300. Because of this, the relative positions of a plurality of frame units 300 in the vertical and lateral directions joined together in the vertical direction can be corrected easily and reliably.

In the wall units 500, the metal pipes 531, 532 which are used for linking the wall units 500 in the vertical direction have an additional function for reinforcing the structure. Because of this, the wall units 500 need a minimum number of parts, and also the wall units 500 become light-weighted and the productivity of the wall units 500 becomes good.

Furthermore, when the tray unit 200 is held by the frame unit 300 as mentioned above, the tray protrusion 201 engages with the guide concave part 321. Because of this, the tray unit 200 is easily and securely held by the frame unit 300 in a correct position.

In addition, although there is a plurality of types of tray units 200 having different lengths from front to back, the length from their front surfaces to the tray protrusion 201 is common. And, as for a plurality of types of frame units 300, the length from their front surfaces to the guide concave part 321 is common. Because of this, even when a plurality of types of tray units 200 are held by a plurality of types of frame units 300, positions of the front surfaces of the tray units 200 are lined up in well-positioned.

Especially, as for the frame units 300, as shown in FIG. 33, a length from front to back A of the main frame 310, a length B from a rear edge of the front main frame 310 to a front edge of the guide concave part 321, and a length C from a rear end of the guide concave part 321 to a front end of the rear main frame 310 satisfy:

$$B=A+C.$$

Because of this, it is easy to realize a structure in which positions of the guide concave parts 321 are lined up in well-positioned in a direction from front to back in the arrangement as mentioned above.

Furthermore, when a plurality of frame units 300 are arranged in the lateral direction, if the frame units 300 are alternately front-back inverted, positions of the guide concave parts 321 of the support frames 320 are lined up in well-positioned in a direction from front to back.

Because of this, even when the tray units 200 are held by a plurality of frame units 300 arranged in the lateral direction as mentioned above, positions of the front surfaces of the tray units 200 are lined up in well-positioned.

Therefore, in the cigarette display system 1000 of the embodiment, when the whole system is set up by the frame units 300, it is possible that positions of the front surfaces of the cigarette packs T displayed while being held by a plurality of units 100 to 300 are lined up in well-positioned, whereby the cigarette packs T can be displayed beautifully.

Especially, the magazine unit 100 pushes forward a plurality of accommodated cigarette packs T by the slider member 110. Because of this, the cigarette packs T accommodated in a plurality of magazine units 100 can be automatically displayed in a common position.

Further, the magazine units 100 and the tray units 200 are formed by a colorless, transparent resin. Accordingly, it is possible to display the cigarette cartons K accommodated in the tray units 200 and the cigarette packs T accommodated in the tray units 200 by using the magazine units 100, in a condition in which they are favorably seen.

In addition, the magazine unit 100 pushes up only one at the front end of the cigarette packs T accommodated by the magazine protrusion 107. Accordingly, it is easy to pick up a single cigarette pack from the accommodated plurality of cigarette packs T.

Figure 3:
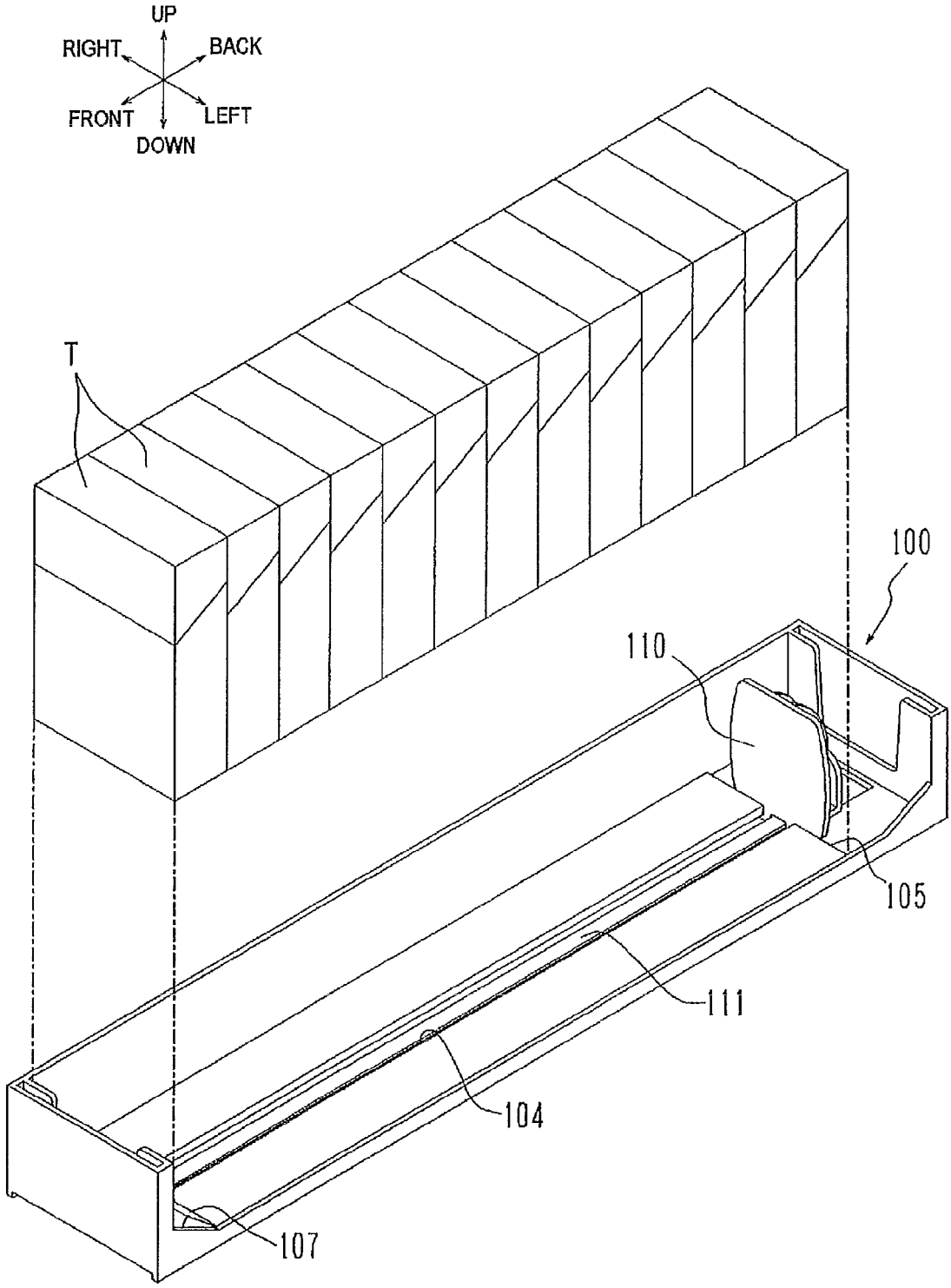
FIG. 3 is an exploded perspective view showing a condition in which cigarette packs are being accommodated in a magazine unit.

In the magazine unit 100, as shown in FIG. 3, by engaging the slider member 110, which is placed backward by sliding movement, with the step 105, the slider member 110 can be stopped against the tension of the plate spring 111. Accordingly, it is easy to replenish a plurality of cigarette packs T in the magazine unit 100.

Furthermore, when a plurality of frame units 300 are arranged in the lateral direction in a condition in which their direction from front to back are alternately inverted, it is possible to minimize gaps between the plurality of frame units 300 arranged in the lateral direction. Because of this, a display density of the cigarette packs T can be increased.

As for the frame unit 300, a plurality of support frames 320, each of which supports the tray unit 200, are arranged in the vertical direction and supported by a pair of main frames 310, and the pair of main frames 310 is arranged in a direction from front to back and supported by the plurality of support frames 320.

In short, the frame unit 300 is formed by bare minimum of the frames 310 and 320 which work as both functional parts and structural bodies. Because of this, the productivity of the frame units 300 becomes good and the frame unit 300 becomes lightweight.

Especially, since the support frame 320 is bent to have a cross-section of a square bracket shape, the support frame 320 has high rigidity. Since the main frame 310 is formed in a closed frame shape, the main frame 310 has high rigidity. And, these frames 310 and 320 are joined together in three dimensions. Because of this, the frame unit 300 has extremely high rigidity compared with conventional fittings formed by metal bars or the like.

Since the cigarette display system 1000 of the embodiment can be assembled by a freely combining the frame units 300, the wall units 500, the tray units 200, and magazine units 100 as mentioned above, it is easy to disassemble a part of the cigarette display system 1000 and clean it.

Especially, the magazine unit 100 of the embodiment has a flat bottom surface having no protrusion, at least in a range where sliding movement is allowed for the slider member 110. Accordingly, the bottom surface of the magazine unit 100, on which the cigarette packs T are directly placed and which is easy to be dirty, can be easily washed or cleaned.

In the cigarette display system 1000 of the embodiment, the magazine units 100*a* and 100*b* are held by the tray units 200*a* to 200*d* having a corresponding length from front to back. As shown in FIGS. 1(*a*) and 1(*b*), the cigarette carton K, the simple fittings F of the campaign packs P and the like can be directly held by the tray unit 200 without using the magazine unit 100 being held by the tray unit 200. In short, it is possible to display the cigarette carton K, the simple fittings F and the like which have a shape that cannot be accommodated in the magazine unit 100 as well.

As shown in FIG. 1(*a*), it is possible to place the above mentioned simple fittings F on a top surface of the frame unit 300, and also it is possible to arrange the simple fittings F in the frame unit 300 in which the tray units 200 are not set (not shown).

On the other hand, as shown in FIG. 1(*b*), the basket unit 710 can be attached to a desired position of the front surface of the wall units 500. Because of this, by using this basket unit 710, it is possible to favorably display the cigarette cartons K, the simple fittings F and the like.

In addition, the shaft unit 720 can be attached to a desired position of the front surface of the wall units 500. Because of this, by using this shaft unit 720, it is possible to favorably display campaign packs P and the like which are difficult to be displayed in a conventional cigarette display system.

At present, the cigarette packs T and the cigarette cartons K are packed in a cardboard box and provided to a store, and they are replenished into the magazine units 100 or the tray units 200 of the cigarette display system 1000 in the store.

However, it is also possible to provide the magazine units 100 filled with the cigarette packs T and the tray units 200 filled with the cigarette cartons K to a store, and collect empty magazine units 100 and empty tray units 200 from the store. In this case, since the operation to replenish the cigarette packs T and the cigarette cartons K into the magazine units 100 and the tray units 200 is not needed in the store, it is possible to increase sales efficiency.

As shown in FIG. 34(*a*) , each of the magazine units 100 includes a pocket 101 in which an advertisement card C or the like can be placed at a front part similarly to the conventional one. Because of this, it is possible to perform advertisement and promote sales for the cigarette packs T accommodated in each of the magazine units 100.

In addition, different from the conventional tray unit, the tray unit 200 includes a pocket 202 in which an advertisement card C or the like can be placed at a front part. Therefore, as shown in FIG. 34(*b*), it is possible to accommodate a plurality of types of cigarette packs T which are sold in series in the tray unit 200, and perform an advertisement common to the series of cigarette packs T.

Figure 35:
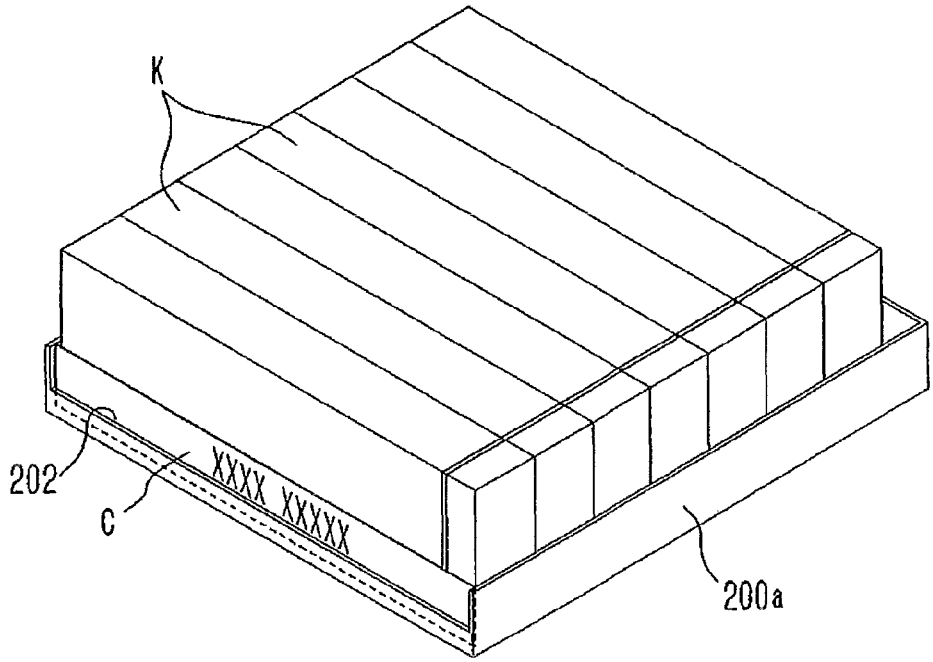
FIG. 35 is a perspective view showing a condition in which an advertisement card is placed in the tray unit accommodating cigarette cartons in a lateral long condition.

Further, as shown in FIG. 35, it is also possible to place an advertisement card C corresponding to the cigarette cartons K in the pocket 202 of the tray unit 200, and favorably advertise the cigarette cartons K accommodated in the lateral long condition.

Figure 36:
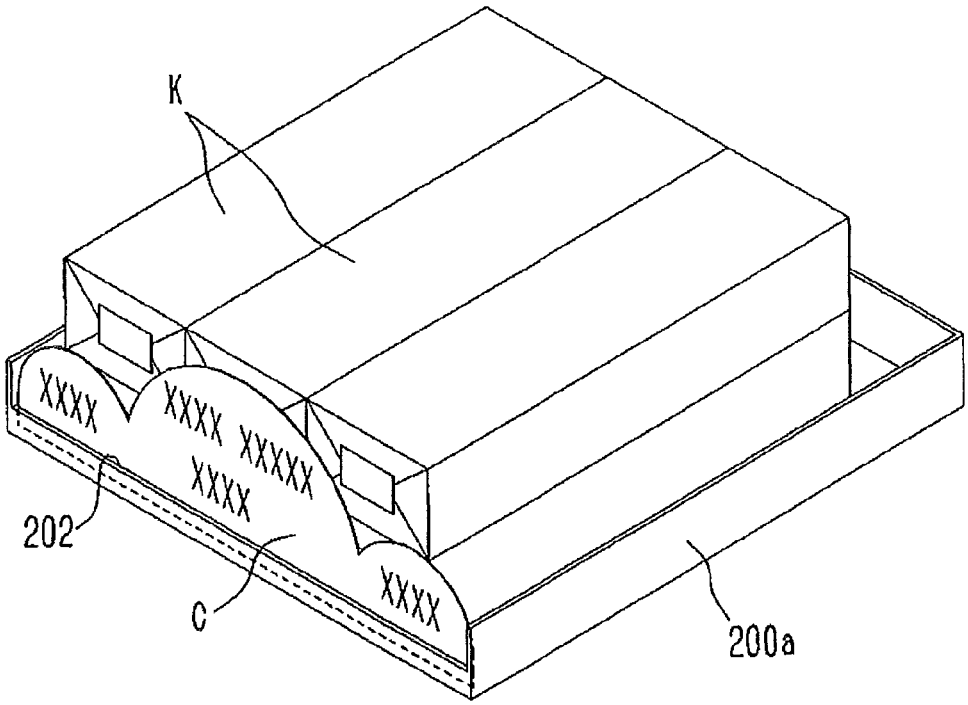
FIG. 36 is a perspective view showing a condition in which an advertisement card is placed in the tray unit accommodating cigarette cartons in three lines in the lateral direction.

Furthermore, as shown in FIG. 36, it is also possible to place an advertisement card C corresponding to a plurality of types of cigarette cartons K which are sold in series in the pocket 202 of the tray unit 200, and perform advertisement common to the series of cigarette cartons K accommodated in three lines in the lateral direction.

Therefore, in the cigarette display system 1000 of the present embodiment, it is also possible to advertise the variously displayed cigarette packs T and cigarette cartons K in an optimal condition for each of them, to promote sales.

In a conventional cigarette display system (not shown), although a plurality of magazine units are arranged in the vertical and lateral directions, there is no structure equivalent to the tray unit. Therefore, the conventional cigarette display system cannot accommodate cigarette cartons as mentioned above, and also cannot place the advertisement card C corresponding to the cigarette cartons.

In addition, as shown in FIG. 37, a plurality of tray units 200 supported by the frame unit 300 are arranged in the vertical direction at intervals of a length which is greater than or equal to the vertical height of a cigarette pack T elongated in the vertical direction and smaller than or equal to two times of the vertical height of the cigarette pack T. At the same time, the plurality of tray units 200 are arranged in the vertical direction at intervals of a length which is greater than or equal to two times of the vertical height of a cigarette carton K elongated in a direction from front to back and flattened in the vertical direction and smaller than or equal to three times of the vertical height of the cigarette carton K.

Because of this, in the cigarette display system 1000 of the present embodiment, by using a plurality of tray units 200 supported by the frame units 300, it is possible to accommodate and display the cigarette packs T and the cigarette cartons K with a good space efficiency in the vertical direction as well.

Further, in the magazine unit 100, a wide opening part is formed at a rear end of the opening 104 of the magazine main body 120. Because of this, as shown in FIG. 39, the slider member 110 can be attached to the magazine main body 120 so as to be slidable without any tool or the like.

Since the slider member 110 is attached to the opening 104 of the magazine main body 120 so as to be slidable like this manner, the bottom surface of the slider member 110 is located lower than the bottom surface of the magazine main body 120.

However, the protrusions 121 which are located lower than the bottom surface of the slider member 110 are formed at both left and right sides of the bottom surface of the magazine main body 120. Because of this, even when the magazine unit 100 is placed on the bottom surface of the tray unit 200, the slider member 110 slides without touching the bottom surface of the tray unit 200.

Further, as for the plate spring 111 which urges the slider member 110 of the magazine unit 100 forward, a part located forward of apart below the slider member 110 is located inside the opening 104 of the magazine main body 120. Therefore, as shown in FIG. 38(*b*), the plate spring 111 does not scratch the bottom surface of the cigarette packs T accommodated in the magazine unit 100.

Further, in the magazine main body 120, the engaging hook 122 is formed at the front center of the bottom surface. Because of this, the front end of the plate spring 111 can be easily attached to the front end of the magazine main body 120.

Further, the magazine main body 120 includes triangular protrusions 107 formed at both left and right sides of the bottom front thereof. Accordingly, a forefront one of the cigarette packs T among a line of cigarette packs T pushed by the slider member 110 can be displaced upward.

In addition, as shown in FIG. 38, the above mentioned triangular protrusions 107 are located at both left and right sides of the engaging hook 122. Because of this, as shown in FIG. 38(*b*), the engaging hook 122 for fixing the plate spring 111 does not hit the bottom of the cigarette packs T.

The present invention is not limited to the embodiment, and various modifications are allowed without departing from the scope of the invention. For example, in the above embodiment, it is exemplified that the whole configuration of the cigarette display system 1000 is formed by the frame units 300 or the wall units 500.

Figure 23:
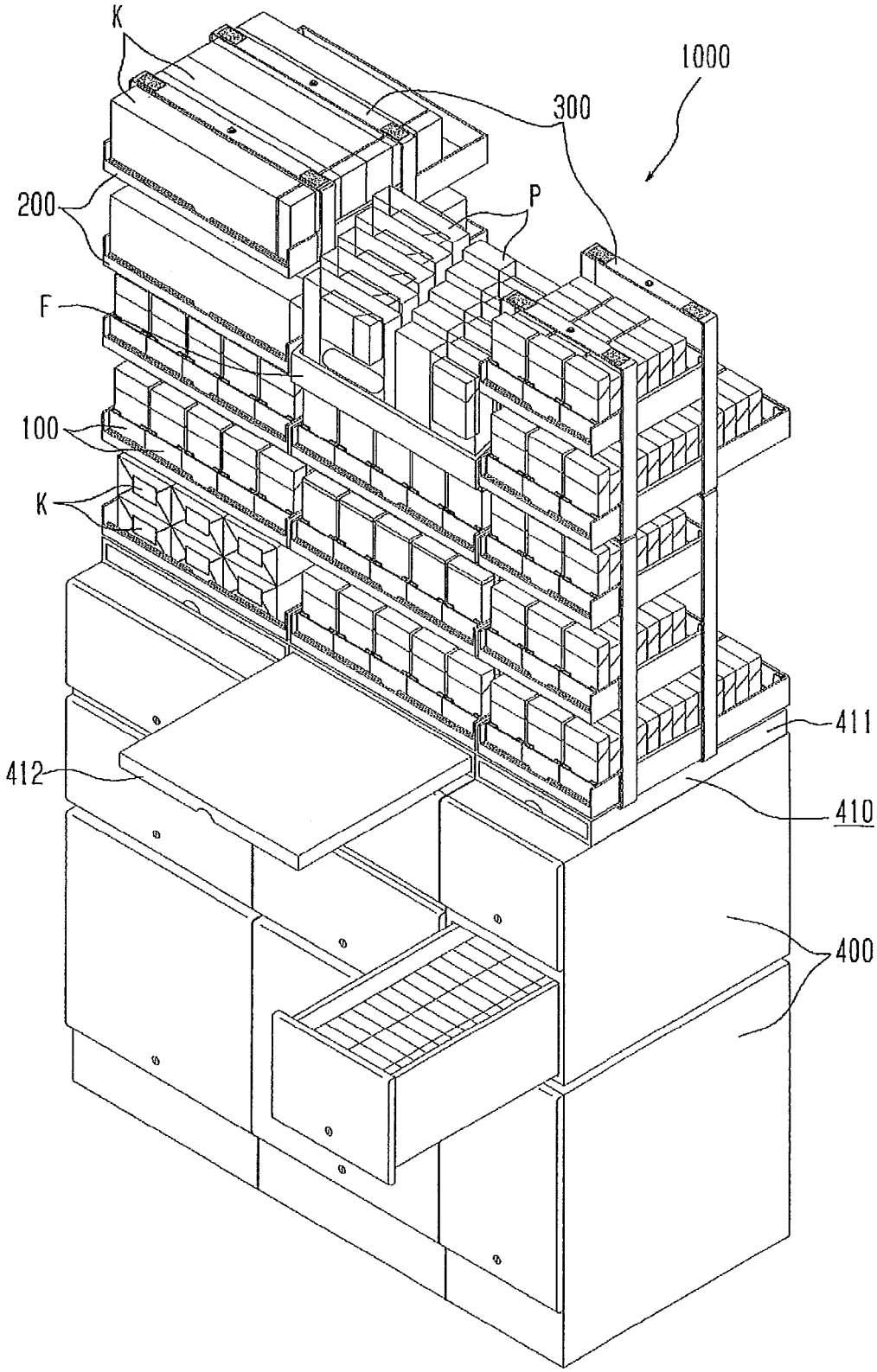
FIG. 23 is a perspective view showing an appearance of a modification of the cigarette display system having stocker units.
Figure 24:
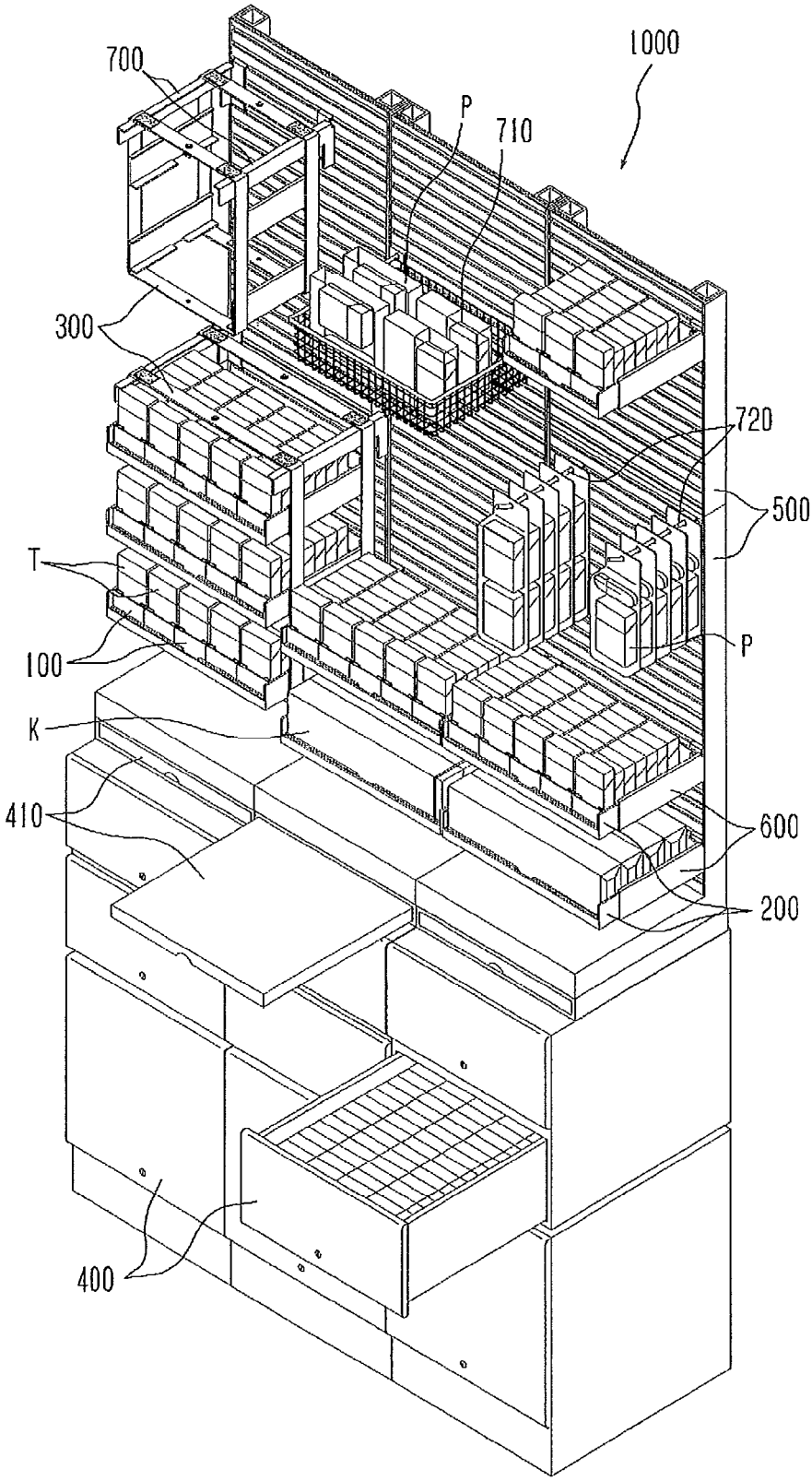
FIG. 24 is a perspective view showing an appearance of a modification of the cigarette display system having stocker units.

However, as shown in FIGS. 23 and 24, the cigarette display system 1000 can further includes stocker units 400 and table units 410. The stocker unit 400 is formed in the shape of a box having at least a flat top surface and a front surface, which can be opened and closed.

The table unit 410 is formed in the shape of a vertically flattened box having a flat top surface. In the table unit 410, a table part 412 is accommodated in a unit box 411 while allowing sliding movement of the table part 412 in a direction from front to back. Accordingly, it is possible to protrude the table part 412 forward and use it for a work.

As shown in FIG. 23, since the frame unit 300 has two types of lateral widths as described above, the above mentioned stocker units 400 and the table units 410 are formed to have two types of lateral widths which correspond to those of the frame units 300.

Because of this, it is possible to combine the stocker units 400 and the table units 410 corresponding to the frame units 300 to be used. Therefore, the cigarette display system 1000, as a whole, can have an appearance of unity, and generation of dead space can be prevented effectively.

On the other hand, as mentioned above, in the wall unit 500, the lateral width and the length from front to back of the pedestal 520 correspond to those of a largest tray unit 200. Therefore, as shown in FIG. 24, by combining with wide stocker units 400 and table units 410, also the cigarette display system 1000, as a whole, can have an appearance of unity.

In addition, as mentioned above, since the tray units 200 have two types of lengths from front to back, the above mentioned stocker units 400 and table units 410 are formed to have a length from front to back corresponding to that of the tray units 200*a* and 200*b* which have a longest length from front to back. Therefore, the tray unit 200 does not protrude outside the stocker unit 400, even when any type of tray unit 200 is used.

By using the stoker units 400 as mentioned above, the cigarette display system 1000 can be installed in a suitable condition even in a space having no counter. Furthermore, by using the table units 410 as mentioned above, it is possible to increase operational efficiency when replenishing the cigarette packs T, and at the same time the table units 410 are not cumbersome when not in use.

The stocker units 400 and the table units 410 may have a structure which can be linked in the vertical direction by using recesses/protrusions and surface fasteners formed on the top surface and the bottom surface (not shown), for example, similarly to the frame units 300 and the wall units 500.

In this case, for example, by making locations and structures of the recesses/protrusions and the surface fasteners common to the frame units 300, the frame units 300 can be correctly, easily and securely mounted on the stocker units 400 and table units 410. In this case, it is preferred that the surface fasteners are attached to a bottom surface of the pedestal 520 of the wall units 500 (not shown).

Figure 25:
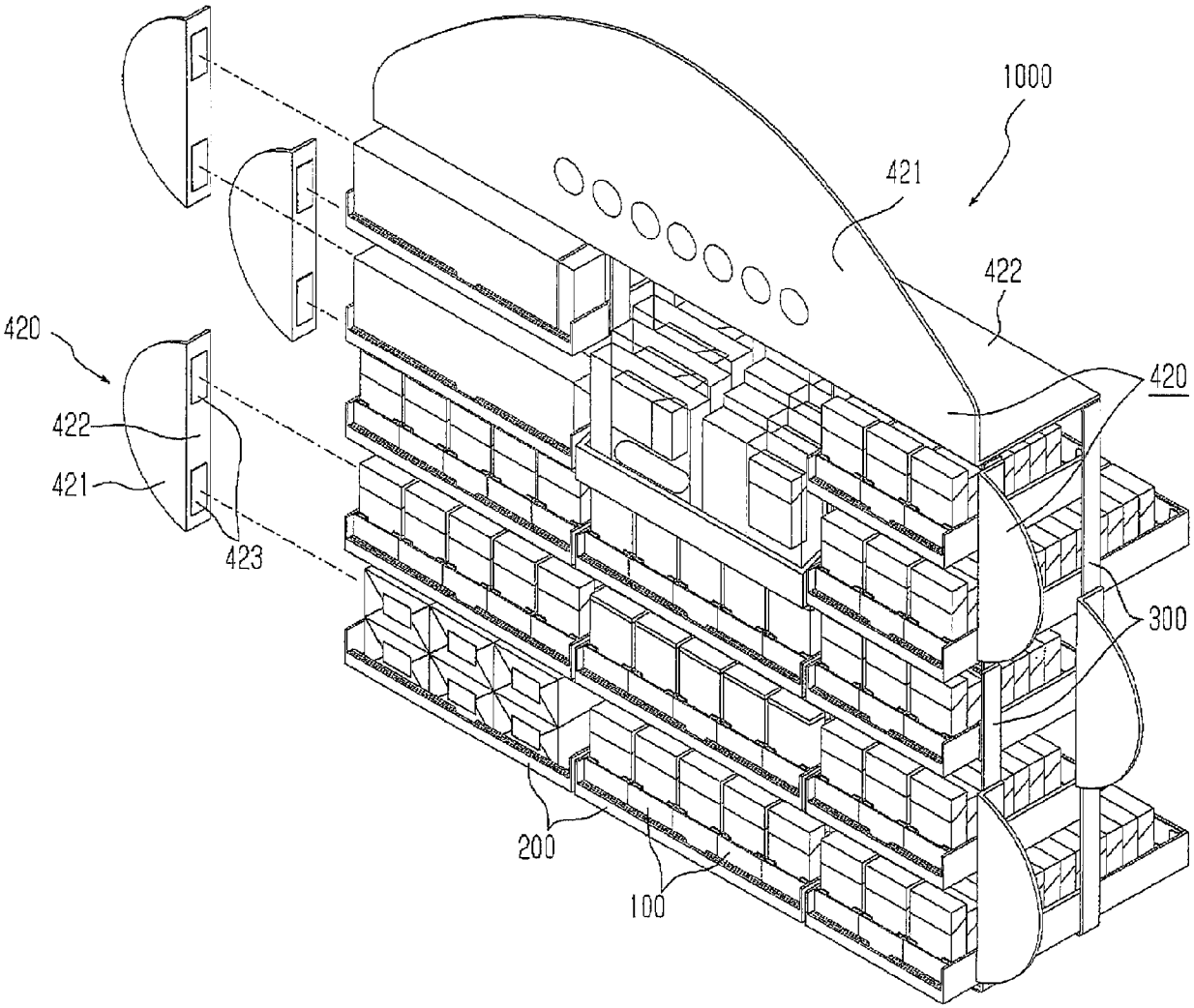
FIG. 25 is an exploded perspective view showing an appearance of another modification of the cigarette display system having presentment parts.

Furthermore, as shown in FIG. 25, the cigarette display system 1000 including frame units 300 may further includes presentment parts 420. The presentment parts 420 are made of a resin panel having a cross-section of L-shape, for example. Front parts 421 of the presentment parts 420 are formed to be an advertisement or decoration.

Magnets 423 sticking to the main frame 310 of the frame unit 300 are attached to parts 422 orthogonal to the above mentioned parts. Because of this, it is possible to easily attach the presentment parts 420 on the top surface and the side surfaces of the frame units 300. For example, when changing the cigarette packs T to be sold, it is easy to change the presentment parts 420. Also, the presentment parts 420 as mentioned above can be formed to have a total length corresponding to the vertical heights and the lateral widths of the plurality of types of frame units 300, for example.

It is possible to attach surface fasteners on the presentment parts 420 as mentioned above, and these surface fasteners may be joined to the surface fasteners 311 on the top surface of the frame unit 300. In this case, the presentment parts 420 can be more securely attached to the top surfaces of the frame units 300. Further, the frame units 300 arranged in the lateral direction can be linked by the presentment parts 420.

Further, in the above embodiment, it is exemplified that the slider member 110 which pushes the cigarette packs T forward by the resilient force of the plate spring 111 is attached to the magazine unit 100, and the cigarette cartons K can be directly accommodated in the tray unit 200.

Figure 26:
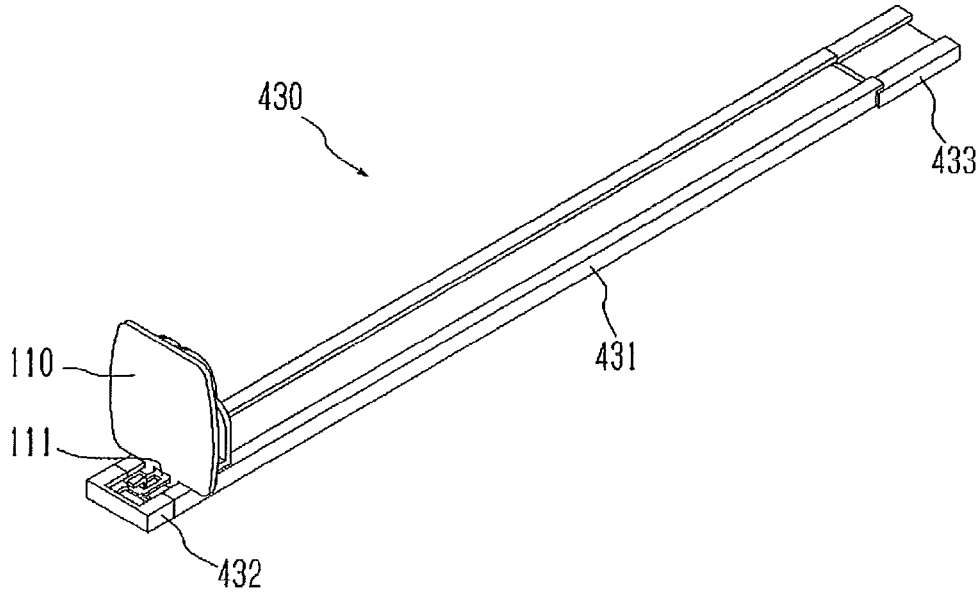
FIG. 26 is a perspective view showing appearances of a slider unit of another modification.
Figure 27:
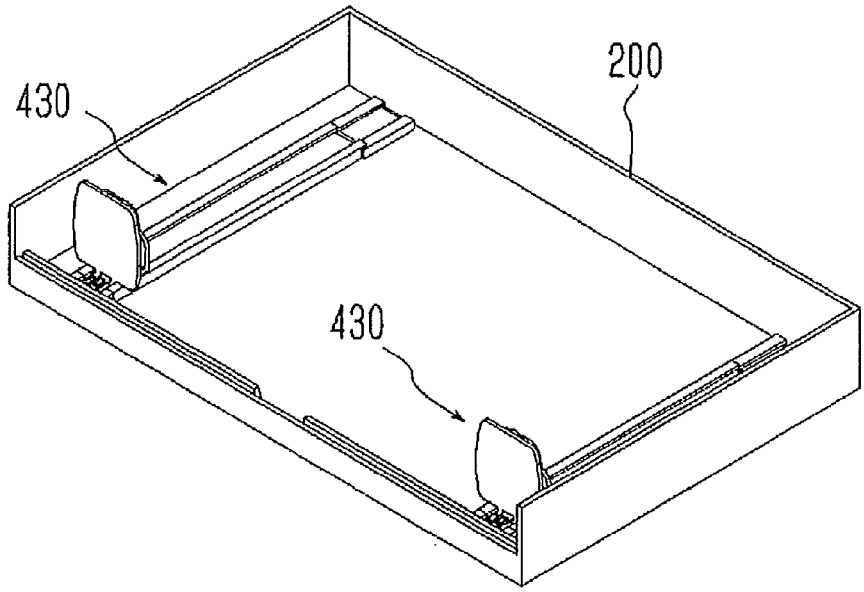
FIG. 27 is a perspective view showing a condition in which the slider units are attached to a tray unit.

However, the slider member 110 which pushes the cigarette cartons K forward by the resilient force of the plate spring 111 can be mounted in the tray unit 200. In that case, as shown in FIGS. 26 and 27, slider units 430 detachably attached to the tray unit 200 are prepared.

Figure 40:
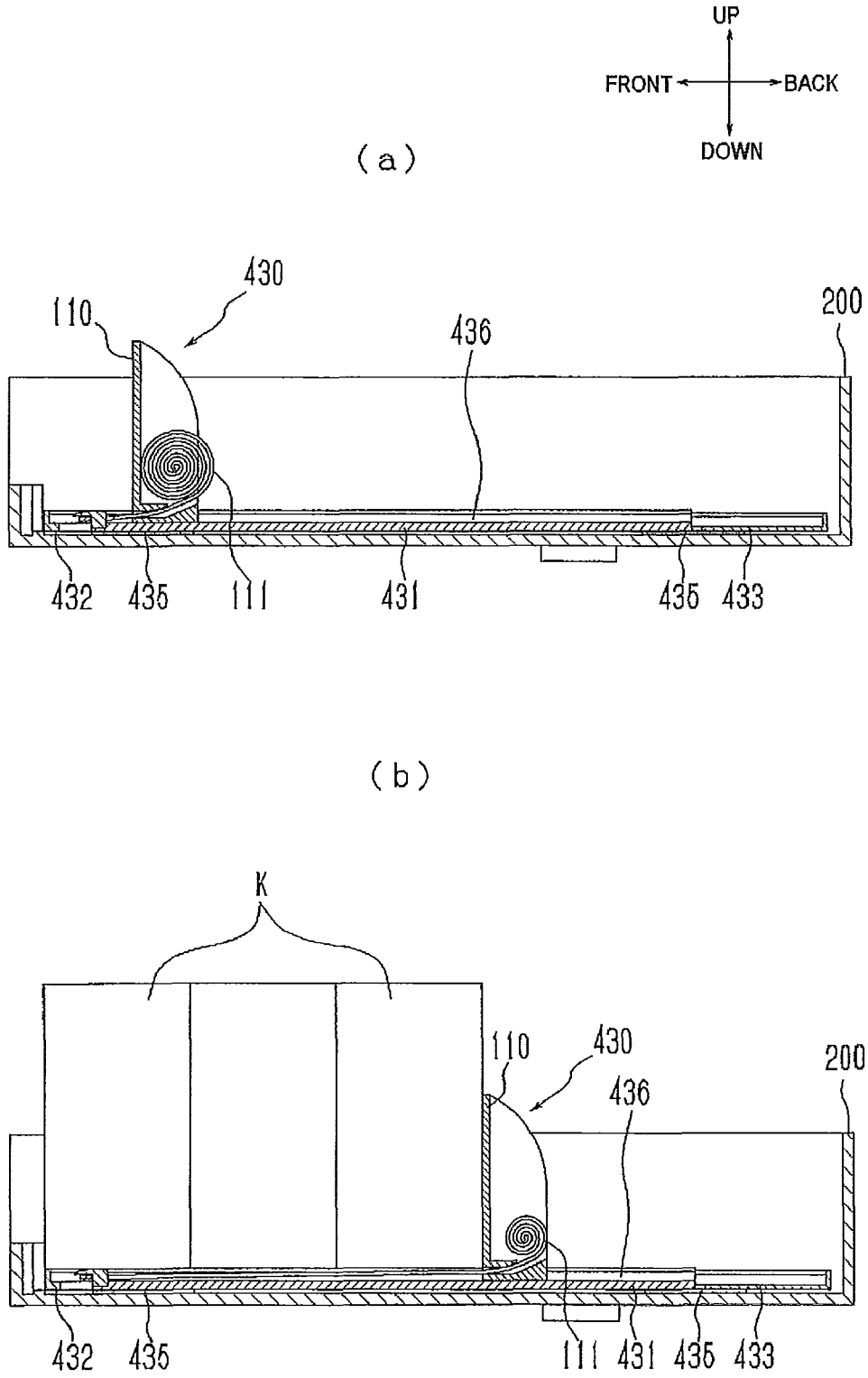
FIG. 40 is a vertical cross-sectional side view showing a condition in which the slider unit is attached to the tray unit and cigarette cartons are accommodated.
Figure 41:
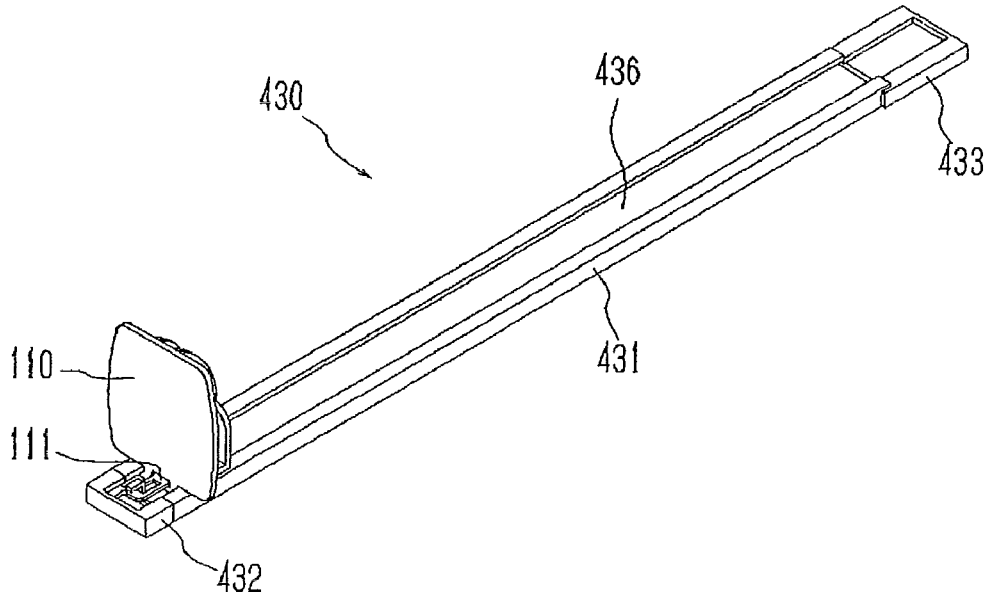
FIG. 41 is a perspective view showing a structure of the slider unit of the cigarette display system.
Figure 41:
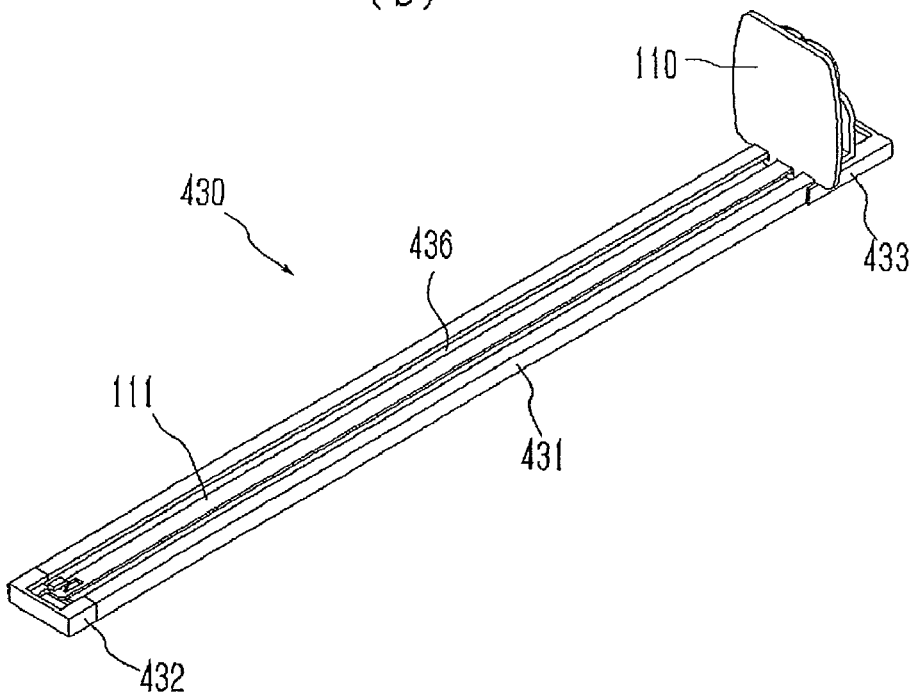
Figure 42:
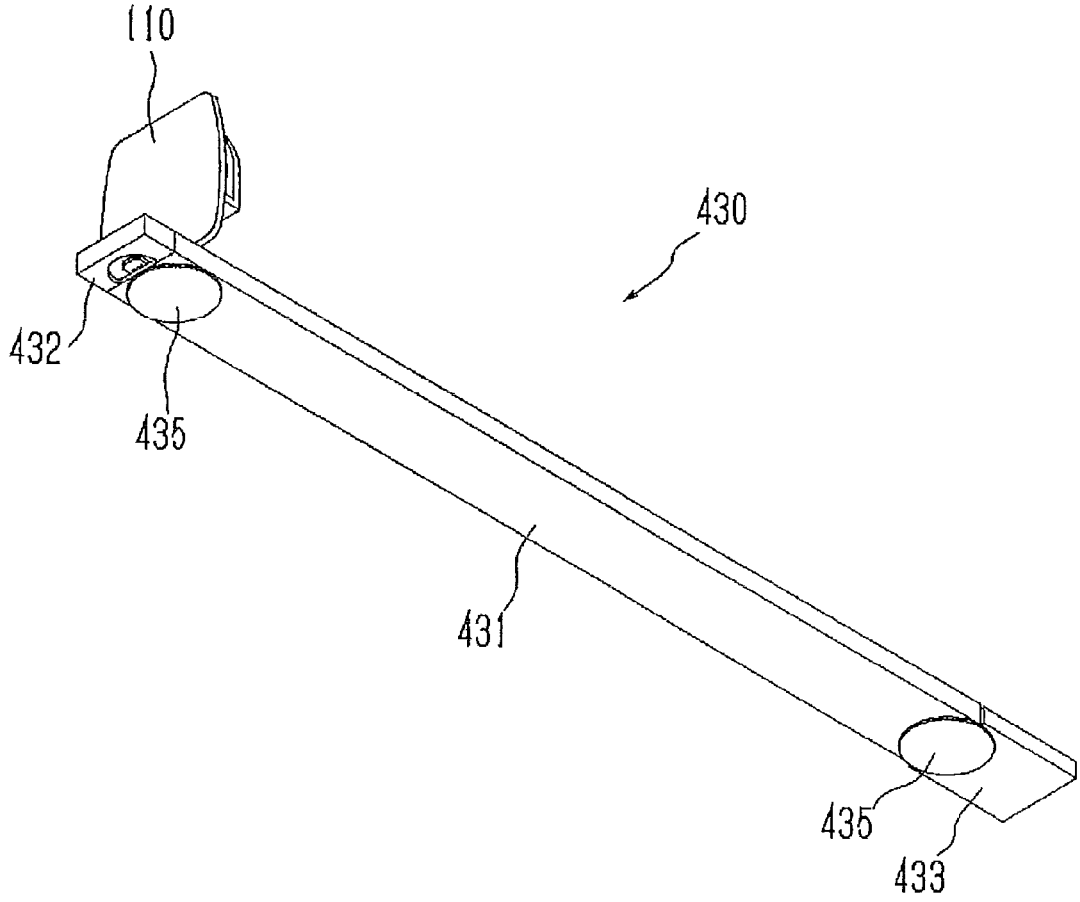
FIG. 42 is a perspective view showing an appearance of a bottom surface of the slider unit.

As shown in FIGS. 40 to 42, the slider units 430 includes a guide rail 431 elongated in a direction from front to back, adhesive sheets 435, attaching and removing mechanisms, for detachably attaching the guide rail 431 to the bottom surface of the tray unit 200, a slider member 110 which is supported by the guide rail 431 so as to be slidable, and a plate spring 111 which resiliently urges the slider member 110 forward.

In the slider unit 430, resin parts 432, 433 are attached to the front and back end of the guide rail 431. The slider member 110 is supported by the guide rail 431 to allow sliding movement, and one end of the plate spring 111 wound at the rear of the slider member 110 is linked to the front resin part 432.

The slider unit 430 uses parts such as the slider member 110 same as the magazine unit 100, and the slider unit 430 is formed to have a structure similar to that of the magazine unit 100 as a whole. Specifically, the guide rail 431 is provided with an opening 436 elongated in a direction from front to back formed in the center of the top surface thereof.

Concavity channels engaging with left and right edges of the opening 436 of the magazine main body so as to be slidable are formed at left and right at the bottom of the slider member 110. In this regard, the guide rail 431 is made of an aluminum alloy extrusion material or the like having a consistent cross sectional shape from the front end to the rear end.

Further, a front part 432 and a rear part 433 are attached to the front and the rear of the guide rail 431. Because of this, the slider member 110 provided to be slidable can be prevented from being dropped.

The front end of the plate spring 111 which is pulled out from the slider unit 430 is fixed to the front part 432. A step is formed between the guide rail 431 and a top surface of the rear part 433. Because of this, as shown in FIG. 41(*b*), a bottom end of a front surface of the slider member 110 which is located in the opening 436 of the rear part 433 detachably engages with a top end of a rear surface of the guide rail 431.

In this cigarette display system 1000, the slider unit 430 can be attached to the bottom surface of the tray unit 200. In that case, when a plurality of cigarette cartons K are arranged in a direction from front to back and placed on a part of the guide rail 431 which is located in front of the slider unit 430, the cigarette cartons K can be pushed forward by the slider member 110 which is urged by the plate spring 111.

Because of this, when a forefront cigarette carton K is picked up from the tray unit 200 and sold, the next cigarette carton K is automatically placed at the forefront. Therefore, the cigarette cartons K can be always automatically favorably displayed.

For this reason, it is possible to place the cigarette display system 1000 in a location facing customers so that the customers can directly pick up the cigarette carton K. In this case, it is possible to increase customer satisfaction and decrease work load on store clerks.

In addition, even when the cigarette carton K is picked up as mentioned above, an alignment of the cigarette cartons K automatically becomes an optimal condition by the slider unit 430. Because of this, even when a customer picks up a cigarette carton K, the cigarette cartons K does not become disordered and the store can maintain a highly-appealing sales space.

In addition, since the slider unit 430 is detachably attached to the tray unit 200, the tray unit 200 can hold the magazine units 100 when the slider unit 430 is removed as mentioned above.

Especially, since the adhesive sheets 435 are attached on the bottom surface of the guide rail 431, the slider unit 430 can be easily attached on the bottom surface of the tray unit 200 without any tool or the like.

Further, in the slider unit 430, the front part 432 and the rear part 433 are attached to the front and the rear of the guide rail 431. Because of this, slider member 110 provided to be slidable can be prevented from being dropped without modifying the guide rail 431 made from a hard aluminum alloy.

In addition, the front end of the plate spring 111 which is pulled out from the slider unit 430 is fixed to the front part 432. Because of this, the front end of the plate spring 111 is held at an appropriate position, without modifying the guide rail 431 made from a hard aluminum alloy.

Further, the plate spring 111 laid across in a tensioned state between the front part 432 and the slider unit 430 is located inside the opening 436 of the guide rail 431. Because of this, bottom surfaces of the cigarette cartons K are not scratched by the plate spring 111.

Furthermore, as shown in FIG. 41(*b*), the slider member 110 can be suspended by engaging the bottom end of the front surface of the slider member 110 which is located in the opening 436 of the rear part 433 with the top end of the rear surface of the guide rail 431. Therefore, the cigarette cartons K can be easily replenished in the tray unit 200 with the slider member 430.

In addition, the step with which the slider member 110 engages is formed as a boundary between the guide rail 431 and the rear part 433. Because of this, a structure for suspending the slider member 110 at a rear position is realized, without modifying the guide rail 431 made from a hard aluminum alloy.

Further, both of the slider unit 430 and the magazine unit 100 can use the slider member 110 and the plate spring 111. Because of this, productivity of the whole system can be increased.

Figure 28:
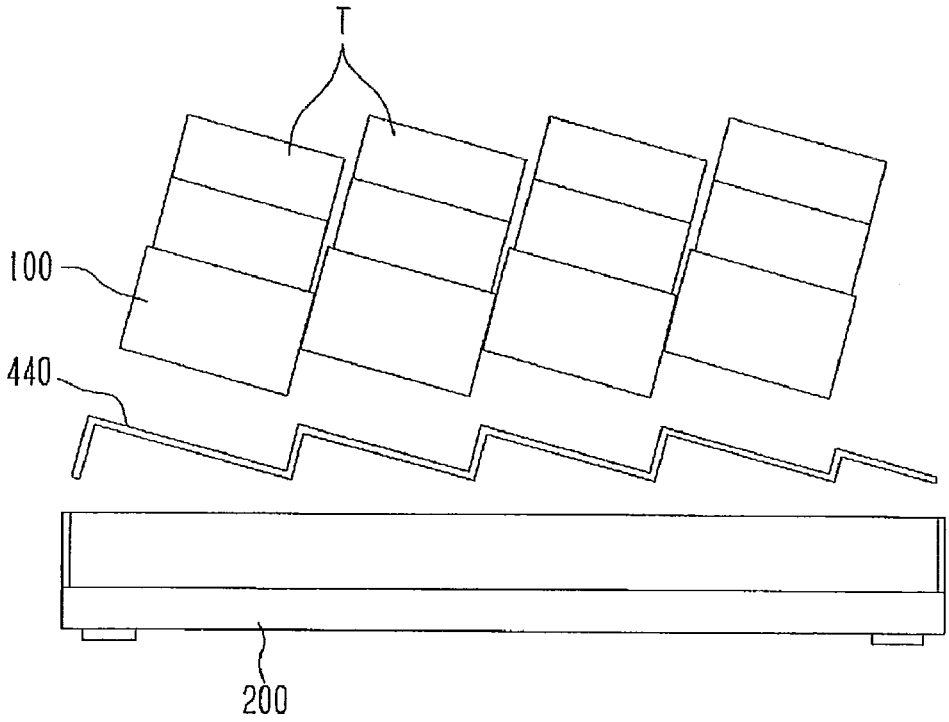
FIG. 28 is a plan view showing a condition of another modification in which cigarette packs are being accommodated in a tray unit using a resin panel.
Figure 28:
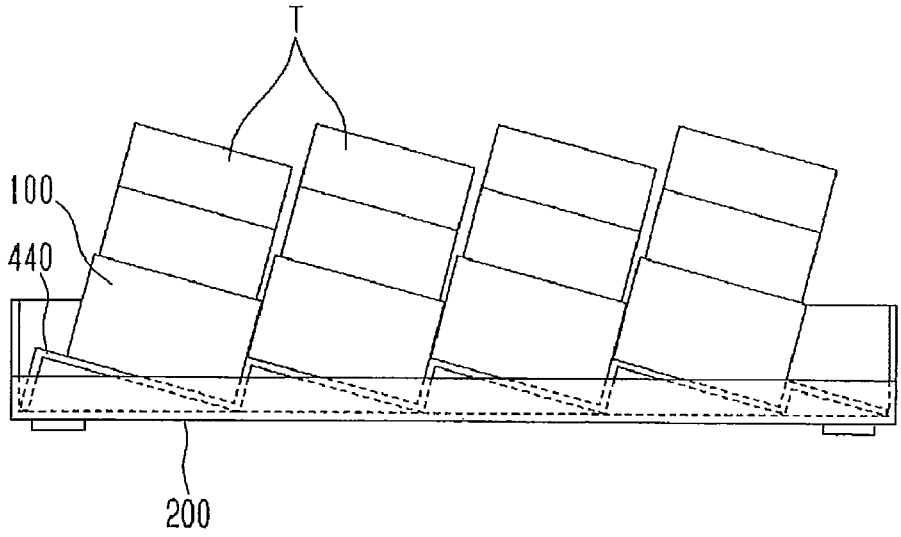

And, in the above embodiment, it is exemplified that the cigarette packs T are accommodated in the tray unit 200 in an upright condition using the magazine units 100. However, as shown in FIG. 28, it is possible to set a resin panel 440 having a bent shape into a waveform or the like on the bottom surface of the tray unit 200, and accommodate the cigarette packs T with the magazine units 100 in a slant condition into the tray unit 200.

In this case, since only four columns of cigarette packs T can be accommodated in the tray unit 200 which can accommodate five columns of cigarette packs T, the accommodation efficiency decreases. However, it is possible to make variations to the display of the cigarette packs T.

Further, in the above embodiment, it is exemplified that the magazine units 100 and the tray units 200 are formed by a colorless, transparent resin. However, the magazine units 100 or the like may be formed by a fluorescent colored resin.

In that case, for example, it is possible to accommodate and display general cigarette packs T in colorless, transparent magazine units 100, and accommodate and display newly marketed cigarette packs T in fluorescent colored magazine units 100. In this case, it is possible to favorably attract attention to specific cigarette packs T.

Figure 29:
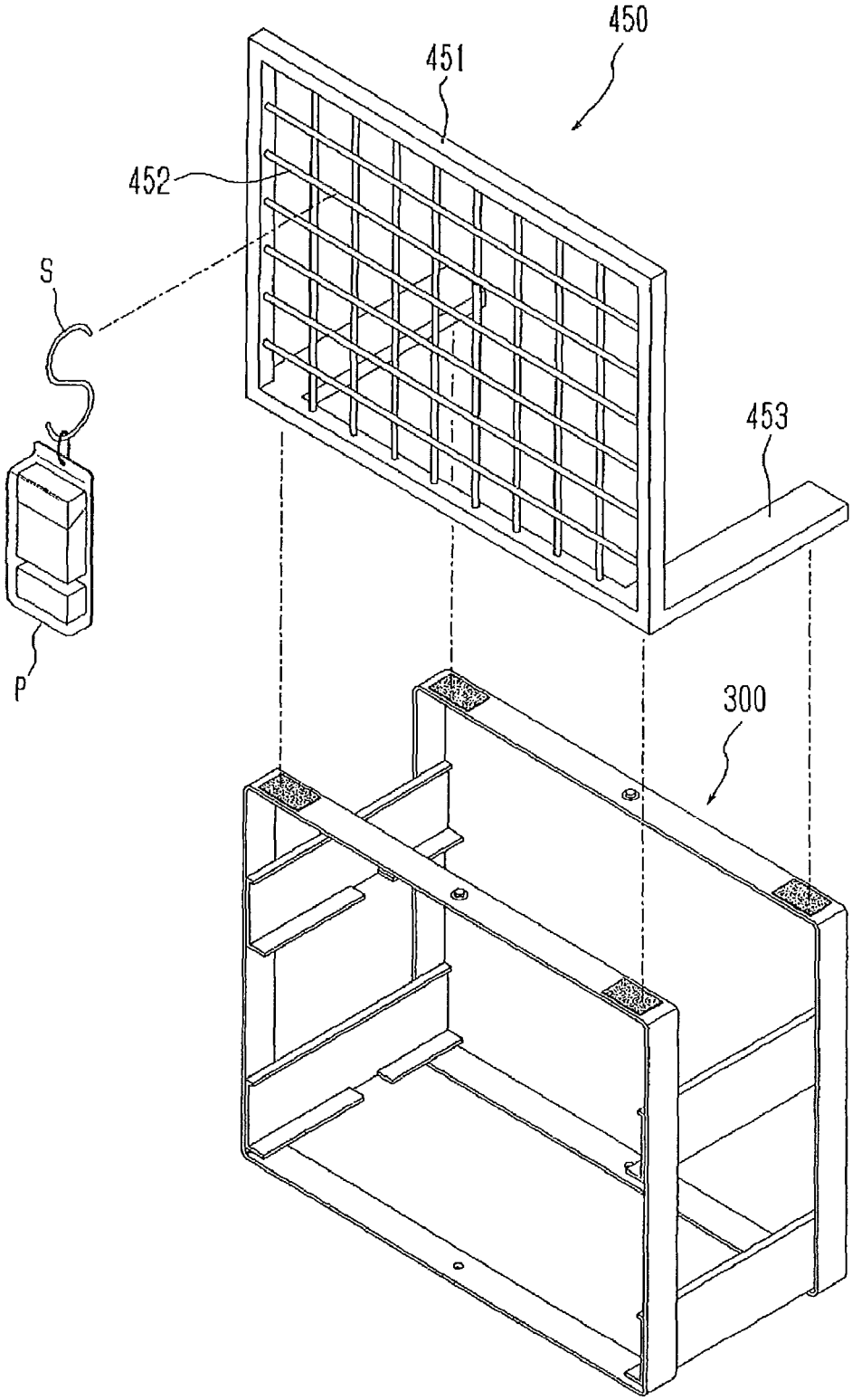
FIG. 29 is a perspective view showing a condition of another modification in which a campaign pack of a cigarette pack is being displayed by using a mesh unit.

And, in the above embodiment, it is exemplified that the cigarette packs T, the campaign packs P, and the like are displayed in the frame units 300 by using the tray units 200, the magazine units 100 and the like. However, as shown in FIG. 29, the campaign pack P and the like may be displayed by using a mesh unit 450 which is detachably attached to the frame unit 300.

The mesh unit 450 has a frame part 451 whose front surface shape is rectangle, a mesh part 452 arranged within the frame part 451, and a base part 453 extending backward from a bottom part of the frame part 451.

The base part 453 is formed to have a lateral width and a length from front to back corresponding to the top surface of the frame unit 300. On the bottom surface of the base part 453 of the mesh unit 450, surface fasteners (not shown) are attached. These surface fasteners are detachably attached to the surface fasteners 311 on the top surface of the frame unit 300.

When such a mesh unit 450 is attached on the top surface of the frame unit 300, it becomes possible to suspend the campaign pack P on the mesh part 452 by using an S pipe S.

At present, when the cigarette pack T displayed in the cigarette display system 1000 is sold, the sales information is collected by an electronic cash register (not shown).

Further, when the cigarette packs T or the like are replenished in the cigarette display system 1000, the replenishment information and inventory information are collected by a handy terminal (not shown) or the like.

However, it is also possible to provide function for collecting such sales information, replenishment information, and inventory information to the cigarette display system 1000. For example, at present, it is considered to mount an RFID (Radio Frequency Identification) chip (not shown) on various commodities such as the cigarette packs T.

Accordingly, installing an RFID reader (not shown) in the cigarette display system 1000 makes it possible to collect the sales information, the replenishment information, and the inventory information of the cigarette display system 1000.

For example, the RFID reader as mentioned above can be installed in the magazine unit 100, the tray unit 200, the frame unit 300, the wall unit 500 and the like, and also it may be a unit detachably attached to the magazine unit 100, the tray unit 200, the frame unit 300, the wall unit 500 and the like.

When providing the cigarette display system 1000 to a store, it is obvious that a combination of necessary units 100 to 500 is different in each store. In that case, necessary units 100 to 500, and the like are considered at store side. And it is possible to provide a display simulator 800 to support the consideration to the store.

Figure 30:
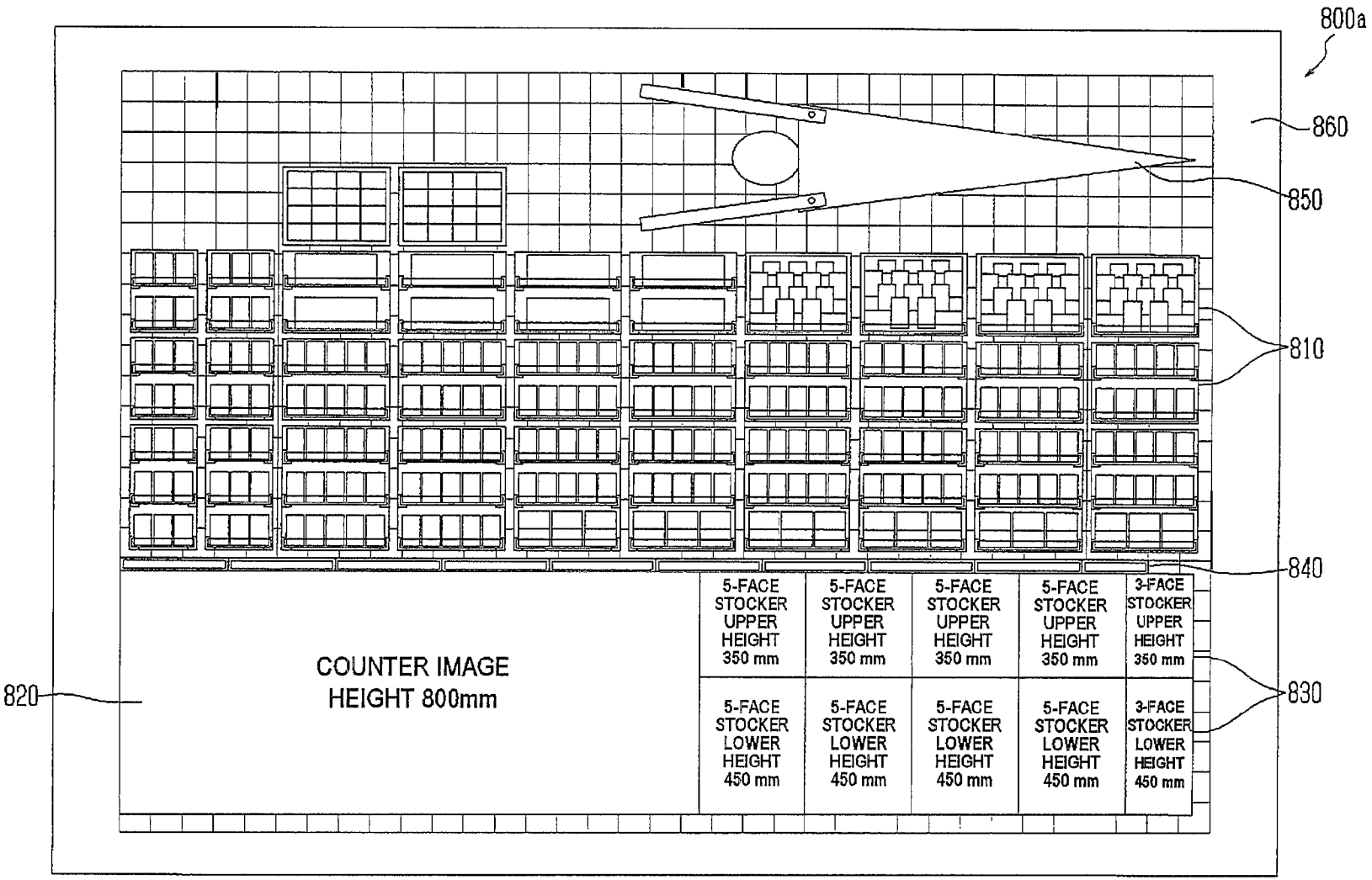
FIG. 30 is a plan view showing an appearance of a display simulator of another modification.

For example, a display simulator 800*a* for a frame structure, as shown in FIG. 30, includes: flat plate unit models 810 simulating the front surface shape of the frame units 300 at a predetermined scale; a counter model 820 simulating a front surface shape of a store counter (not shown) at the same scale as that of the unit models 810; stocker models 830 simulating the front surface shape of the stocker units 400 at the same scale; table models 840 simulating the front surface shape of the table units 410 at the same scale; a flat plate human model 850 simulating a front surface shape of a person at the same scale; and a layout board 860 on which the plurality of models 810 to 840 are laid out and detachably attached and at the same time the human model is detachably attached.

Figure 31:
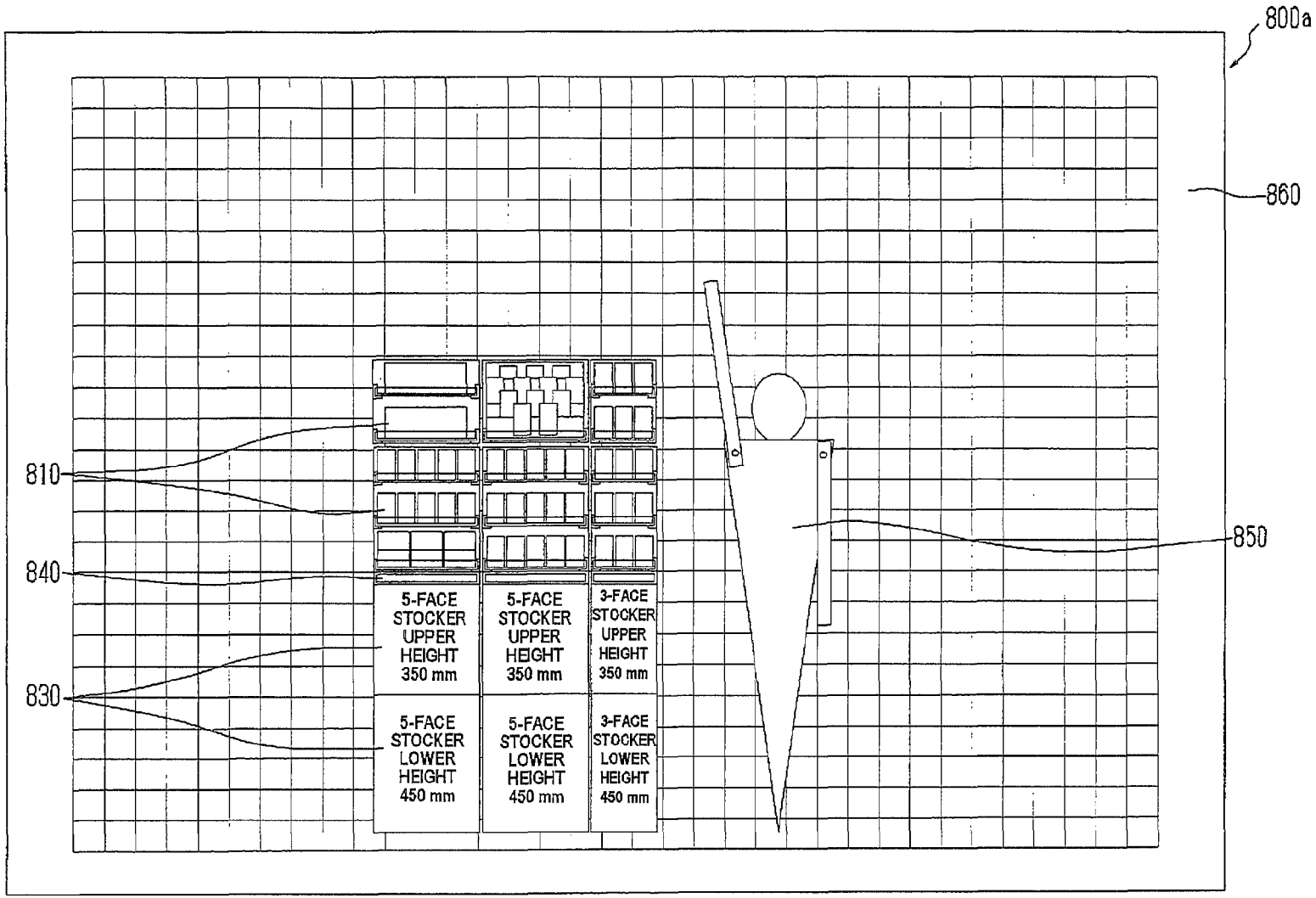
FIG. 31 is a plan view showing a condition in which the display simulator is used.

The layout board 860 is formed by a magnetic sheet and the models 810 to 850 are formed by a magnet sheet. In a store to which such a display simulator 800*a* is provided, by laying out various models 810 to 830 on the layout board 860, as shown in FIG. 31, it is possible to consider a combination of various units 100 to 500 and the like of the cigarette display system 1000.

In addition, since this display simulator 800*a* includes the human model 850 on a unified scale, it is possible to check a relative relationship between the cigarette display system 1000 and a person.

Especially, the human model 850 is formed so that an arm part is rotatable. Accordingly, it is possible to check whether the cigarette display system 1000 can be set up within an area in which a person operates.

Furthermore, it is possible that a manufacturer of the cigarette display system 1000 collects the display simulator 800*a* in which various models 810 to 830 are laid out on the layout board 860 in a store, and then provides various units 100 to 500 and the like to the store corresponding to the layout.

Figure 32:
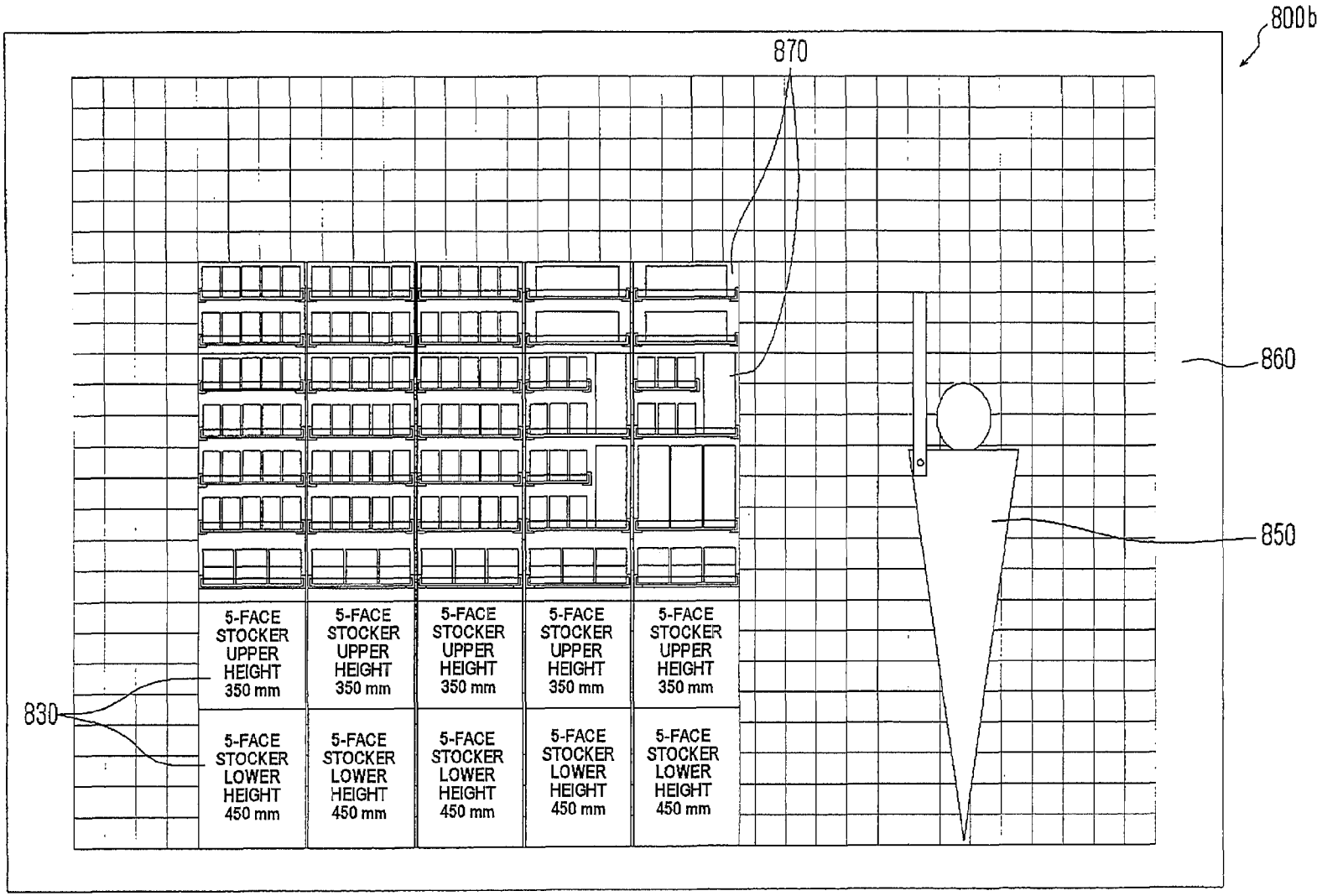
FIG. 32 is a plan view showing an appearance of a display simulator of another modification.

Of course, as shown in FIG. 32, it is possible, in the same way, to form a display simulator 800*b* including flat plate unit models 870 simulating the shape of the front surface of the wall units 500 on a predetermined scale.

Furthermore, it is possible to provide a display simulator in which both of the above mentioned unit models 810 and 870 for the frame units 300 and wall units 500 are prepared (not shown) to a store.

The invention claimed is:

1. A cigarette display system for displaying cigarette packs to be sold, said cigarette display system comprising:

a frame main body formed in the shape in which box structures with an opened front are successively arranged both in vertical and lateral directions;

a wall main body formed in a flat plate shape flattened in a direction from front to back, having a front surface with recesses and protrusions of a predetermined shape, said wall main body being a body separate from said frame main body;

a plurality of magazine units formed in the shape of a box which is elongated in a direction from front to back and has an opened top, said magazine units having a shape which allows a plurality of said cigarette packs to be held therein while being arranged in the direction from front to back;

a plurality of tray units formed in the shape of a box having an opened top, said tray units having a shape which allows a plurality of said magazine units arranged in the lateral direction to be held detachably;

a plurality of tray support members provided at vertically different positions to be separated apart in each of a plurality of said box structures in said frame main body, said tray support members detachably holding said tray units respectively; and a plurality of tray attachments for detachably engaging with said recesses and protrusions of said wall main body, said tray attachments detachably holding said tray units.

2. The cigarette display system according to claim 1, wherein said frame main body includes:

a plurality of frame units each of which is foamed in said box structure and formed separately from each other; and a frame link mechanism for linking a plurality of said frame units in the vertical direction, and said wall main body includes:

a plurality of wall units each of which has a front surface on which recesses and protrusions are formed and is formed separately from each other; and a wall link mechanism for linking a plurality of said wall units in the vertical direction.

3. The cigarette display system according to claim 2, further comprising a frame attachment having an engagement mechanism for detachably engaging with said recesses and protrusions of said wall unit and a frame suspension member for suspending said frame unit.

4. The cigarette display system according to claim 2, wherein said tray units include a plurality of types of tray units whose lateral widths are different from one another corresponding to the number of said magazine units to be held, said frame main body includes a plurality of types of frame units whose lateral widths are different from one another corresponding to said plurality of types of said tray units, said wall units are formed to have a lateral width corresponding to a largest lateral width of said plurality of types of said tray units, and said tray attachments include a plurality of types of tray attachments whose lateral widths are different from one another corresponding to said plurality of types of said tray units.

5. The cigarette display system according to claim 2, further comprising a stocker unit formed in the shape of a box which has at least a flat top surface and a front surface, which can be opened and closed, wherein said stocker unit includes a plurality of types of stocker units whose lateral widths of said top surface are different from one another corresponding to said plurality of types of said frame units.

6. The cigarette display system according to claim 2, wherein said frame units include a plurality of types of frame units whose heights are different from one another corresponding to the number of said tray units to be held.

7. The cigarette display system according to claim 2, wherein said frame unit includes:

a plurality of main frames made of a metal plate which is bent so that a front shape becomes rectangular, said main frames being arranged in a direction from front to back; and a plurality of said tray support members made of a metal plate which is formed in a rail shape elongated in a direction from front to back for supporting said tray unit, each pair of said support frames being arranged in the vertical direction and joined to an inner surface of said plurality of main frames.

8. The cigarette display system according to claim 2, wherein said wall units include:

a base wall with a pedestal integrally formed at a bottom end and in which a said wall link mechanism is mounted at the top end; and a panel wall in which said wall link mechanisms are mounted at the bottom end and the top end.

9. The cigarette display system according to claim 1, wherein said wall main body is formed in a shape in which a plurality of said recesses and protrusions each going through in the lateral direction are arranged in a predetermined interval in the vertical direction.

10. The cigarette display system according to claim 1, wherein said magazine units include a plurality of types of magazine units whose lengths from front to back are different from one another corresponding to the number of said cigarette packs to be held, said tray units include a plurality of types of tray units whose lengths from front to back are different from one another corresponding to said plurality of types of said magazine units, said frame main body holds said plurality of types of said tray units whose lengths from front to back are different from one another in an arrangement in which the positions of the front surfaces of said tray units are lined up in well-positioned, and said tray attachments include a plurality of types of tray attachments whose lengths from front to back are different from one another corresponding to said plurality of types of said tray units.

11. The cigarette display system according to claim 1, wherein said cigarette pack is formed in a rectangular solid shape, there is a rectangular solid shape cigarette carton including a packaged plurality of said cigarette packs, and said tray unit is formed in a shape in which said cigarette carton is arranged to elongate in the lateral direction.

12. The cigarette display system according to claim 1, wherein said magazine unit includes a slider member arranged on a bottom surface on which said cigarette packs are placed so as to be slidable in a direction from front to back, and an urging mechanism which resiliently urges said slider member forward, and said bottom surface is made in a flat plane without a protrusion at least in a range where sliding movement is allowed for said slider member.

13. The cigarette display system according to claim 1, further comprising a slider unit which is detachably attached to a bottom surface of said tray unit, wherein said slider unit includes:

a guide rail elongated in a direction from front to back, an attaching and removing mechanism which detachably attaches said guide rail to said bottom surface of said tray unit, a slider member which is supported by said guide rail so as to be slidable, and an urging mechanism which resiliently urges said slider member forward.

* * * * *